US011551656B2

(12) United States Patent
Hakuta et al.

(10) Patent No.: US 11,551,656 B2
(45) Date of Patent: Jan. 10, 2023

(54) SOUNDPROOF STRUCTURE

(71) Applicant: FUJIFILM Corporation, Tokyo (JP)

(72) Inventors: Shinya Hakuta, Ashigara-kami-gun (JP); Takafumi Hosokawa, Ashigara-kami-gun (JP); Shogo Yamazoe, Ashigara-kami-gun (JP)

(73) Assignee: FUJIFILM Corporation, Tokyo (JP)

( * ) Notice: Subject to any disclaimer, the term of this patent is extended or adjusted under 35 U.S.C. 154(b) by 418 days.

(21) Appl. No.: 16/851,655

(22) Filed: Apr. 17, 2020

(65) Prior Publication Data

US 2020/0243058 A1 Jul. 30, 2020

Related U.S. Application Data

(63) Continuation of application No. PCT/JP2018/040488, filed on Oct. 31, 2018.

(30) Foreign Application Priority Data

Nov. 7, 2017 (JP) ..... JP2017-214342
Mar. 2, 2018 (JP) ..... JP2018-037684
(Continued)

(51) Int. Cl.
*G10K 11/172* (2006.01)

(52) U.S. Cl.
CPC ..... *G10K 11/172* (2013.01)

(58) Field of Classification Search
CPC ..... G10K 11/172
See application file for complete search history.

(56) References Cited

U.S. PATENT DOCUMENTS 5,241,512 A * 8/1993 Argy ..... G10K 11/172 181/207
8,869,933 B1 * 10/2014 McKnight ..... G10K 11/172 181/207
(Continued)

FOREIGN PATENT DOCUMENTS

EP 1100071 A2 5/2001
JP 2005-266399 A 9/2005
(Continued)

OTHER PUBLICATIONS

Extended European Search Report, dated Nov. 30, 2020, for European Application No. 18877189.3.
(Continued)

*Primary Examiner* — Forrest M Phillips
(74) *Attorney, Agent, or Firm* — Birch, Stewart, Kolasch & Birch, LLP

(57) ABSTRACT

Provided is a soundproof structure that is small and light and can sufficiently reduce noise with a high natural frequency of a sound source. There is provided a soundproof structure including a frame having an opening, and at least one membrane-like member fixed to an opening surface where the opening of the frame is formed, in which a rear surface space is formed to be surrounded by the frame and the membrane-like member, and a sound is absorbed due to vibration of the membrane-like member, and a sound absorption coefficient of the vibration of the membrane-like member at a frequency in at least one high-order vibration mode existing at frequencies of 1 kHz or higher is higher than a sound absorption coefficient at a frequency in a fundamental vibration mode.

17 Claims, 26 Drawing Sheets

(30) Foreign Application Priority Data

Jun. 6, 2018 (JP) ..... JP2018-108674
Oct. 11, 2018 (JP) ..... JP2018-192710

(56) References Cited

U.S. PATENT DOCUMENTS 10,704,255 B2 * 7/2020 Hakuta ..... E04B 1/8409
2013/0087407 A1 * 4/2013 McKnight ..... G10K 11/172 181/287
2015/0047923 A1 * 2/2015 Chang ..... G10K 11/172 181/286
2018/0114516 A1 * 4/2018 Hakuta ..... B32B 15/043

FOREIGN PATENT DOCUMENTS

JP 2009-167701 A 7/2009
JP 2010-102013 A 5/2010
JP 4832245 B2 12/2011
WO WO 2016/208580 A1 12/2016
WO WO 2017/033804 A1 3/2017

OTHER PUBLICATIONS

Zhao et al., "Membrane acoustic metamaterial absorbers with magnetic stiffness", J. Acoust. Soc. Am., Feb. 2017 (published online Feb. 15, 2017). vol. 141, No. 2, pp. 840-846 (7 pages).
International Preliminary Report on Patentability and Written Opinion of the International Searching Authority (Forms PCT/IB/326, PCT/IB/373, PCT/ISA/237) for International Application No. PCT/JP2018/040488, dated May 22, 2020, with English translation.
International Search Report (Form PCT/ISA/210) for International Application No. PCT/JP2018/040488, dated Jan. 15, 2019, with English translation.
Ba et al., "Soft 3D printed membrane type-acoustic meta materials," 23rd International Congress on Sound & Vibration, Athens, Greece, Jul. 10-14, 2016, pp. 1-7.
Japanese Office Action for corresponding Japanese Application No. 2019-552740, dated Mar. 16. 2021, with English translation.

* cited by examiner

SOUNDPROOF STRUCTURE

CROSS-REFERENCE TO RELATED APPLICATIONS

This application is a Continuation of PCT International Application No. PCT/JP2018/040488 filed on Oct. 31, 2018, which claims priority under 35 U.S.C. § 119(a) to Japanese Patent Application No. 2017-214342, filed on Nov. 7, 2017, Japanese Patent Application No. 2018-037684, filed on Mar. 2, 2018, Japanese Patent Application No. 2018-108674, filed on Jun. 6, 2018 and, Japanese Patent Application No. 2018-192710, filed on Oct. 11, 2018. Each of the above applications is hereby expressly incorporated by reference, in its entirety, into the present application.

BACKGROUND OF THE INVENTION

1. Field of the Invention

The present invention relates to a soundproof structure.

2. Description of the Related Art

Along with multifunctionality and high performance, it is necessary that various electronic apparatuses such as a copier, electronic devices mounted on vehicles, an electronic apparatus of household appliances, home appliances, various moving objects such as robots are driven at a high voltage and current, and electric output has increased. In addition, with an increase in output and reduction in size, the necessity of controlling heat or air for cooling has increased, and fans and the like have become important.

The electronic apparatus or the like includes an electronic circuit, a power electronics device, and an electric motor that are noise sources, and each of the electronic circuit, the power electronics device, and the electric motor (hereinafter, also referred to as a sound source) generates a sound with a great sound volume with a natural frequency. In a case where the output of the electric system increases, a sound volume with this frequency further increases which causes a problem as noise.

For example, in a case of an electric motor, noise (electromagnetic noise) with a frequency corresponding to a rotation speed is generated. In a case of an inverter, noise (switching noise) is generated according to a carrier frequency. In a case of a fan, noise with a frequency corresponding to a rotation speed is generated. The volume of these noises is greater than that of a sound with a similar frequency.

Generally, a porous sound absorbing body such as urethane foam or felt is often used as a sound reduction means. In a case where a porous sound absorbing body is used, a sound reduction effect is obtained in a wide frequency range. Therefore, in a case of the noise having no frequency dependency such as white noise, a suitable sound reduction effect is obtained.

However, sound sources such as various electronic apparatuses generate loud sounds at their natural frequencies. In particular, as various electronic apparatuses operate at higher speeds and with higher output, the sound at a specific frequency becomes extremely high and large.

An ordinary porous sound absorbing body such as urethane foam or felt reduces the sound with a wide frequency range, and accordingly, noise with a natural frequency of the sound source may not be sufficiently reduced, and not only the noise with the natural frequency, but also sounds at other frequencies are reduced. Accordingly, the situation where the sound with the natural frequency is more audible prominently than the sounds at other frequencies does not change. Therefore, only a specific frequency width exists for a loud sound with respect to noise that is broad in frequency such as white noise and pink noise, and there is a problem in that noise in a narrow frequency band such as a single frequency sound is easily sensed by human.

Therefore, in a case of such noise generated by the electronic apparatus or the like as described above, there has been a problem that even after the countermeasure is taken with the porous sound absorbing body, the sound at a specific frequency becomes relatively more audible than sounds at other frequencies.

Further, in order to reduce a louder sound using the porous sound absorbing body, it is necessary to use a large amount of the porous sound absorbing body. An electronic apparatus and the like are often required to be reduced in size and weight, and it is difficult to ensure a space for disposing a large amount of porous sound absorbing body in the vicinity of an electronic circuit, an electric motor, and the like of the electronic apparatus.

As a means for reducing a sound at a specific frequency more significantly, a sound reduction means using membrane vibration is known. The sound reduction means using the membrane vibration is small and light and can appropriately reduce a sound at a specific frequency.

For example, JP4832245B discloses a sound absorbing body including a frame in which a through hole is formed, and a sound absorbing material covering one opening of the through hole, in which a first storage elastic modulus E1 of the sound absorbing material is $9.7\times10^6$ or more, and a second storage elastic modulus E2 is 346 or less. JP4832245B discloses that this sound absorbing material has a plate shape or a membrane shape, and in a case where sound waves are incident to the sound absorbing body, resonance (membrane vibration) occurs to absorb a sound (see paragraph [0009], FIG. 1 and the like of JP4832245B).

SUMMARY OF THE INVENTION

With a further increase in speed and output of various electronic apparatuses, a frequency of noise generated by the above-described electronic circuits and electric motors has become higher. In a case of reducing such a sound at a high frequency by the sound reduction means using membrane vibration, it is considered to increase a natural frequency of the membrane vibration by adjusting a hardness of the membrane and a size of the membrane, in consideration of the examples in which a membrane type sound absorbing body is applied to a low frequency.

However, according to the study of the inventors, it was found that, in the sound reduction means using the membrane vibration, in a case where the natural frequency of the membrane vibration was increased by adjusting the hardness of the membrane and the size of the membrane, the sound absorption coefficient was low at high frequencies.

In addition, the hardness of the membrane used for the sound reduction means using the membrane vibration is changed due to a change in ambient temperature, a change in humidity, and the like. As the hardness of the membrane changes, the natural frequency of the membrane vibration changes significantly. For this reason, it was found that, in a case of the sound reduction means using the membrane vibration, there is a problem that the frequency at which the sound can be reduced changes according to a change in the surrounding environment (temperature, humidity).

An object of the invention to solve the problems of the technologies of the related art to provide a soundproof structure that are small and light, and can sufficiently reduce noise with a high natural frequency of a sound source and has robustness against a change in the surrounding environment.

The inventors have conducted intensive studies to achieve the above object, and as a result, the inventors have found that the above problems can solved by including a soundproof structure including: at least one membrane-like member; a support which supports the membrane-like member so as to perform membrane vibration, in which a rear surface space is formed on one surface side of the membrane-like member, a sound is reduced due to vibration of the membrane-like member, and a sound absorption coefficient of the vibration of the membrane-like member at a frequency in at least one high-order vibration mode existing at frequencies of 1 kHz or higher is higher than a sound absorption coefficient at a frequency in a fundamental vibration mode, and completed the invention.

That is, the inventors have found that the above problem can be solved by the following configurations.

[1] A soundproof structure including: at least one membrane-like member; and a support which supports the membrane-like member so as to perform membrane vibration, in which a rear surface space is formed on one surface side of the membrane-like member, and a sound is absorbed due to vibration of the membrane-like member, and a sound absorption coefficient of the vibration of the membrane-like member at a frequency in at least one high-order vibration mode existing at frequencies of 1 kHz or higher is higher than a sound absorption coefficient at a frequency in a fundamental vibration mode.

[2] The soundproof structure according to [1], in which, in a case where a Young's modulus of the membrane-like member is set as E (Pa), a thickness of the membrane-like member is set as t (m), a thickness of the rear surface space is set as d (m), and an equivalent circle diameter of a region where the membrane-like member vibrates is set as $\Phi$(m), a hardness $E\times t^3$ ($Pa\cdot m^3$) of the membrane-like member is $21.6\times d^{-1.25}\times\Phi^{4.15}$ or less.

[3] The soundproof structure according to [2], in which the hardness $E\times t^3$ ($Pa\cdot m^3$) of the membrane-like member is $2.49\times10^{-7}$ or more.

[4] The soundproof structure according to any one of [1] to [3], in which each of sound absorption coefficients at frequencies in two or more high-order vibration modes is 20% or more.

[5] The soundproof structure according to [4], in which two or more high-order vibration modes with frequencies having sound absorption coefficients of 20% or more continuously exist.

[6] The soundproof structure according to any one of [1] to [5], in which a frequency in the high-order vibration mode having a sound absorption coefficient of 20% or more is in a range of 1 kHz to 20 kHz.

[7] The soundproof structure according to any one of [1] to [6], in which, regarding a sound incident in a direction of each of angles of 0°, 30°, and 60° with respect to a direction perpendicular to a surface of the membrane-like member, a sound absorption coefficient at a frequency in the high-order vibration mode is higher than a sound absorption coefficient at a frequency in the fundamental vibration mode.

[8] The soundproof structure according to any one of [1] to [7], in which the support is a frame having an opening, the membrane-like member is fixed to an opening surface of the frame where the opening is formed, and the rear surface space is a space surrounded by the frame and the membrane-like member.

[9] The soundproof structure according to [8], in which the frame is a cylindrical member in which both ends of the opening are opened, and in a case where a length from the membrane-like member fixed to one opening surface of the frame to the other opening surface of the frame is set as $L_1$, an opening end correction distance is set as $\delta$, and a wavelength at a frequency in any high-order vibration mode of the membrane-like member is set as $\lambda_a$, and n is an integer of 0 or more, $((\lambda_a/4-\lambda_a/8)+n\times\lambda_a/2-6)\leq L_1\leq((\lambda_a/4+\lambda_a/8)+n\times\lambda_a/2-\delta)$ is satisfied.

[10] The soundproof structure according to [9], in which n is 0, and thus $(\lambda_a/4-\lambda_a/8-\delta)\leq L_1\leq(\lambda_a/4+\lambda_a/8-\delta)$ is satisfied.

[11] The soundproof structure according to [8], in which the opening of the frame has a bottom surface.

[12] The soundproof structure according to any one of [8] to [11], which a through hole is provided in at least one of the frame or the bottom surface.

[13] The soundproof structure according to [11], in which a rear surface space is a closed space.

[14] The soundproof structure according to any one of [1] to [12], in which the membrane-like member has a through hole.

[15] The soundproof structure according to any one of [1] to [12], in which the membrane-like member has one or more cut portions penetrating from one surface to the other surface.

[16] The soundproof structure according to any one of [1] to [15], in which a sound absorption coefficient at a frequency in the high-order vibration mode is 20% or more.

[17] The soundproof structure according to any one of [1] to [16], in which a frequency having a maximum sound absorption coefficient in an audible range is 2 kHz or more.

[18] The soundproof structure according to any one of [1] to [17], in which a thickness of the rear surface space is 10 mm or less.

[19] The soundproof structure according to any one of [1] to [18], in which a thickness of a thickest portion of the soundproof structure is 10 mm or less.

[20] The soundproof structure according to any one of [1] to [19], in which a thickness of the membrane-like member is less than 100 μm.

[21] The soundproof structure according to any one of [1] to [20], in which a material of the membrane-like member is a metal.

[22] The soundproof structure according to any one of [8] to [21], in which the frame is an air-containing structure which is at least one of a foamed structure, a closed-cell foamed structure, a hollow structure, or a porous material.

[23] The soundproof structure according to any one of [1] to [22], further including a porous sound absorbing body in at least a part of the rear surface space.

According to the present invention, it is possible to provide a soundproof structure that are small and light, and can sufficiently reduce noise with a high natural frequency of a sound source.

DESCRIPTION OF THE PREFERRED EMBODIMENTS

Figure 1:
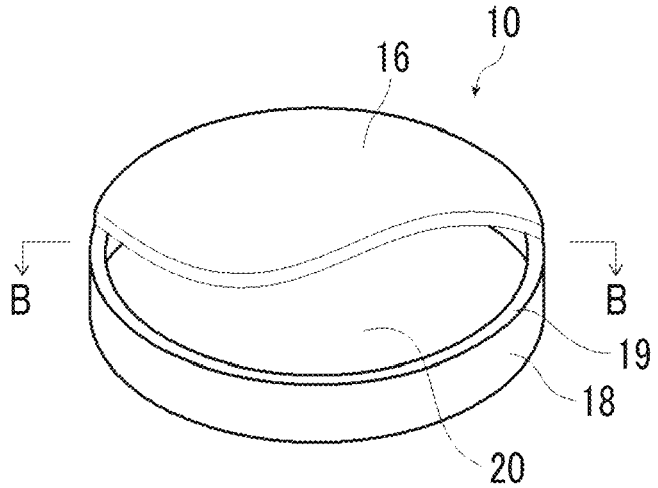
FIG. 1 is a perspective view schematically showing one example of a soundproof structure of the invention.

Hereinafter, the invention will be described in detail.

The description of the constituent elements described below may be made based on typical embodiments of the invention, but the invention is not limited to such embodiments.

In this specification, a numerical range expressed using "to" means a range including numerical values described before and after "to" as a lower limit value and an upper limit value.

Further, in this specification, for example, angles such as "45°", "parallel", "vertical", and "perpendicular" mean that a difference from an exact angle is within a range of less than 5 degrees, unless otherwise specified. The difference from the exact angle is preferably less than 4 degrees and more preferably less than 3 degrees.

In this specification, "the same" or "identical" include an error range generally accepted in the technical field. In this specification, "entire part", "all", and "entire surface" may be 100%, and may include an error range generally accepted in the technical field, for example, 99% or more, 95% or more, or 90% or more.

[Soundproof Structure]

There is provided a soundproof structure of the invention, including at least one membrane-like member, a support which supports the membrane-like member so as to perform membrane vibration, in which a rear surface space is formed on one surface side of the membrane-like member, and a sound is absorbed due to vibration of the membrane-like member, and a sound absorption coefficient of the vibration of the membrane-like member at a frequency in at least one high-order vibration mode existing at frequencies of 1 kHz or higher is higher than a sound absorption coefficient at a frequency in a fundamental vibration mode.

The soundproof structure of the invention can be suitably used as a sound reduction means for reducing sounds generated by various kinds of electronic apparatuses, transportation apparatuses, and the like.

The electronic apparatus includes household appliance such as an air conditioner, an air conditioner outdoor unit, a water heater, a ventilation fan, a refrigerator, a vacuum cleaner, an air purifier, an electric fan, a dishwasher, a microwave oven, a washing machine, a television, a mobile phone, a smartphone, and a printer; office equipment such as a copier, a projector, a desktop PC (personal computer), a notebook PC, a monitor, and a shredder; computer apparatuses that uses high power such as a server and a supercomputer; scientific laboratory equipment such as a constant-temperature tank, an environmental tester, a dryer, an ultrasonic cleaner, a centrifugal separator, a cleaner, a spin coater, a bar coater, and a transporter.

The transportation apparatus includes a vehicle (including a bus, a taxi, and the like), a motorcycle, a train, an aviation instrument (an airplane, a fighter, a helicopter, and the like), a ship, a bicycle (particularly an electric bicycle), an aerospace instrument (a rocket and the like), and a personal mobility. Particularly in a hybrid vehicle, an electric vehicle, and a plug-in hybrid vehicle (PHV), there is a problem that a specific sound caused by a motor and a power control unit (PCU: including an inverter, a battery voltage boosting unit and the like) mounted inside the vehicle can be heard even in the vehicle interior.

Journal of the Japan Society of Mechanical Engineers 2007. 7 Vol. 110 No. 1064, "Vibration noise phenomena of hybrid vehicles and reduction technology thereof" discloses motor electromagnetic noise and switching noise, a reason thereof and typical noise frequencies. According to a comparison table disclosed in Table 1, it is disclosed that the motor electromagnetic noise at several hundred Hz to several kHz and the switching noise at several kHz to several tens kHz are noise on a high frequency side than other noise frequencies.

In addition, for example, on p. 30 of the Toyota Motor Corporation PRIUS Manual (2015) discloses "operating noise of an electric motor from an engine room ("sound" at the time of accelerating, and "sound" at the time of decelerating)" as "specific sound and vibration of the hybrid vehicles".

In addition, EV-9 of the manual (2011) of Nissan Motor LEAF, which is an electric vehicle, discloses "sound of a motor generated from a motor room" as "sound and vibration".

As described above, as vehicles become hybrid and electric vehicles, noise on a high frequency side, which has not generated in the past, is generated with a magnitude that can be heard in a vehicle interior.

Examples of a moving object include a consumer robot (a cleaning use, a communication use such as a pet use and a guidance use, and a movement assisting use such as a automatic wheelchair) and an industrial robot.

In addition, the structure can also be used for an apparatus set to emit at least one or more specific single frequency sounds as a notification sound or a warning sound in order to send notification or warning to a user.

Further, the soundproof structure of the invention can also be applied to a room, a factory, a garage, and the like in which the above-described apparatuses are housed.

An example of a sound source of a sound which is to be reduced by the soundproof structure of the invention is an electronic part or a power electronics device part including an electric control device such as an inverter, a power supply, a booster, a large-capacity condenser, a ceramic condenser, an inductor, a coil, a switching power supply, and a transformer; a rotary part such as an electric motor or a fan; and a mechanical part such as a moving mechanism using a gear and an actuator, which are included in the various apparatuses described above.

In a case where the sound source is an electronic part such as an inverter, the sound source generates a sound (switching noise) according to a carrier frequency.

In a case where the sound source is an electric motor, the sound source generates a sound (electromagnetic noise) with a frequency corresponding to a rotation speed. At this time, the frequency of the generated sound is not necessarily limited by the rotation speed or a multiple thereof, but there is a strong relationship that the sound increases as the rotation speed increases.

That is, each of the sound sources generates a sound with a natural frequency of the sound source.

The sound source with a natural frequency often has a physical or electrical mechanism that performs oscillation at a specific frequency. For example, in a rotating system (such as a fan), a frequency determined by the number of blades and the rotation speed, and a multiple thereof are directly emitted as a sound. In addition, a portion receiving an AC electric signal of an inverter often emits a sound corresponding to the AC frequency. Therefore, the rotating system or an AC circuit system is a sound source with a natural frequency of the sound source.

More generally, the following experiment can be performed to determine whether a sound source has a natural frequency.

The sound source is placed in an anechoic room or a semi-anechoic room, or in a situation surrounded by a sound absorbing body such as urethane. By setting a sound absorbing body in the periphery, the influence of reflection interference of a room or a measurement system is eliminated. Then, the sound source is allowed to generate a sound and measurement is performed with a microphone from a separated position to obtain frequency information. A distance between the sound source and the microphone can be appropriately selected depending on the size of the measurement system, and it is desirable to perform the measurement at a distance of appropriately 30 cm or more.

In the frequency information of the sound source, a maximum value is referred to as a peak, and a frequency thereof is referred to as a peak frequency. In a case where the maximum value is higher than that of a sound with a peripheral frequency by 3 dB or higher, the sound with the peak frequency can be sufficiently recognized by human beings, and accordingly, it can be referred to as a sound source with a natural frequency. In a case where the maximum value is higher by 5 dB or more, it can be more recognized, and in a case where the maximum value is higher by 10 dB or more, it can be even more recognized. The comparison with the peripheral frequencies is made by evaluating a difference between a minimum value of the nearest frequency at which the frequency is minimum excluding signal noise and fluctuation, and the maximum value.

In addition, in a case where the sound emitted from the sound source resonates in a housing of various apparatuses, a volume of a sound with the resonance frequency or the frequency of the overtone may increase. Alternatively, in a case where the sound emitted from the sound source in a room, a factory, a garage, and the like in which the above-described apparatuses are housed is resonated, a volume of a sound with the resonance frequency or the frequency of the overtone may increase.

In addition, due to resonance occurring due to a space inside a tire and a cavity inside a sport ball, in a case where vibration is applied, a sound corresponding to the cavity resonance or a high-order mode thereof may also greatly oscillate.

In addition, the sound emitted from the sound source is emitted with a resonance frequency of a mechanical structure of a housing of various apparatuses, or a member disposed in the housing, and a volume of a sound with the resonance frequency or a frequency of the overtone thereof may increase. For example, even in a case where the sound source is a fan, a resonance sound may be generated at a rotation speed much higher than the rotation speed of the fan due to the resonance of the mechanical structure.

The structure of the invention can be used by directly attaching to a noise-generating electronic part or a motor. In addition, it can be disposed in a ventilation section such as a duct portion and a sleeve and used for sound reduction of a transmitted sound. Further, it can also be attached to a wall of a box having an opening (a box or a room containing various electronic devices) to be used as a sound reduction structure for noise emitted from the box. Furthermore, it can also be attached to a wall of a room to suppress noise inside the room. It can also be used without limitation thereto.

An example of the soundproof structure of the invention will be described with reference to FIGS. 1 and 2.

FIG. 1 is a schematic perspective view showing an example of the soundproof structure of the invention. FIG. 2 is a cross-sectional view taken along line B-B of the soundproof structure shown in FIG. 1. In FIG. 1, a membrane-like member 16 is partially omitted for the sake of description.

Figure 2:
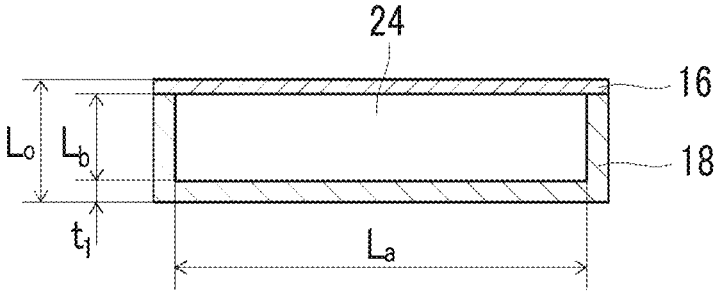
FIG. 2 is a cross-sectional view taken along line B-B of FIG. 1.

As shown in FIGS. 1 and 2, a soundproof structure 10 includes a frame 18 having an opening 20 and a membrane-like member 16 (also simply referred to as a "membrane") fixed to an opening surface 19 of the frame 18.

The soundproof structure 10 exhibits a sound absorbing function by using membrane vibration and selectively reduces a sound at a specific frequency (frequency band).

In the example shown in FIGS. 1 and 2, the frame 18 has a cylindrical shape and includes an opening 20 having a bottom surface formed on one surface thereof. That is, the frame 18 has a bottomed cylindrical shape opened to one surface. The frame 18 corresponds to the support of the invention.

The membrane-like member 16 is a member having a membrane shape, covers the opening surface 19 of the frame 18 where the opening 20 is formed, and has a peripheral portion fixed to and supported by the frame 18 to be able to vibrate.

In addition, on the rear surface side (the frame 18 side) of the membrane-like member 16 of the soundproof structure 10, a rear surface space 24 surrounded by the frame 18 and the membrane-like member 16 is formed. In the example shown in FIGS. 1 and 2, the rear surface space 24 is a closed space.

Here, in the soundproof structure 10 of the invention, a sound absorption coefficient of the membrane vibration of the membrane-like member 16 supported by the frame 18 at a frequency in at least one high-order vibration mode existing at 1 kHz or higher is higher than a sound absorption coefficient at a frequency in a fundamental vibration mode.

As described above, various electronic devices such as copiers include sound sources such as electronic circuits and electric motors, that are noise sources, and these sound sources generate loud sounds with specific frequencies.

In a porous sound absorbing body that is generally used as a sound reduction means, noise with a natural frequency of the sound source was difficult to be sufficiently reduced, since the porous sound absorbing body reduces a sound at a wide frequency, and accordingly, the noise may be audible relatively more than sounds at other frequencies. In addition, in order to reduce a louder sound using the porous sound absorbing body, it is necessary to use a large amount of the porous sound absorbing body, and it is difficult to reduce the size and weight.

In addition, as a means for reducing a sound at a specific frequency more significantly, a sound reduction means using a fundamental vibration mode of membrane is known.

Here, with a further increase in speed and output of various electronic apparatuses, a frequency of noise generated by the above-described electronic circuits and electric motors has become higher. In a case of reducing such a sound at a high frequency by the sound reduction means using membrane vibration, it is considered to increase a natural frequency of the membrane vibration by adjusting a hardness of the membrane and a size of the membrane.

However, according to the study of the inventors, it was found that, in the sound reduction means using the membrane vibration, in a case where the natural frequency of the membrane vibration in a fundamental mode was increased by adjusting the hardness of the membrane and the size of the membrane, the sound absorption coefficient was low at high frequencies.

Specifically, in order to absorb a sound with a high frequency, it is necessary to increase the natural frequency of the membrane vibration. Here, in the sound reduction means using the membrane vibration in the related art, a sound is absorbed mainly by using the membrane vibration in the fundamental vibration mode. In a case where using the membrane vibration in the fundamental vibration mode, it is necessary to increase a frequency (primary natural frequency) in the fundamental vibration mode by making the membrane harder and thicker. However, according to the study of the inventors, in a case where the membrane is excessively hard and thick, a sound tends to be reflected by the membrane. Therefore, as shown in FIG. 3, as the frequency in the fundamental vibration mode increases, the absorption of sound (sound absorption coefficient) due to the membrane vibration decreases.

The higher the frequency of the sound, the smaller the force interacting with the membrane vibration. On the other hand, it is necessary to harden the membrane in order to increase the frequency of the natural vibration of the membrane. Hardening the membrane leads to greater reflection at the membrane surface. A sound with a higher frequency needs a harder membrane for resonance, and accordingly, it is thought that, most of the sound reflected by the membrane surface, rather than being absorbed by the resonance vibration, thereby reducing the absorption.

Therefore, it was clear that a large sound absorption at a high frequency is difficult with the sound reduction means using the membrane vibration using the fundamental vibration mode based on the design theory of the related art. This feature is not suitably used in the sound reduction of a specific sound with a high frequency.

Figure 3:
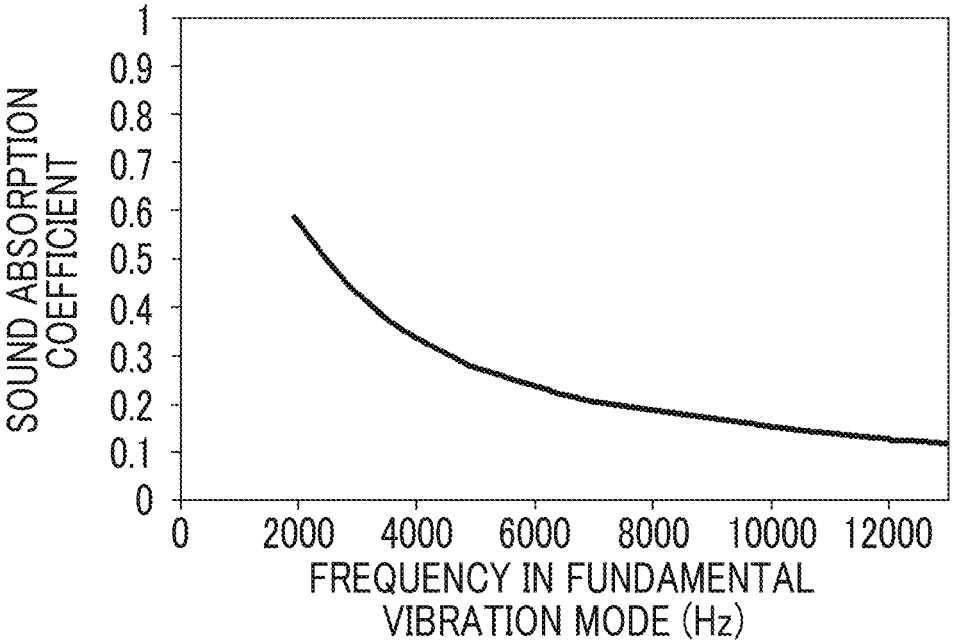
FIG. 3 is a graph showing a relationship between a frequency in a fundamental vibration mode and a sound absorption coefficient.

A graph shown in FIG. 3 is a result of a simulation performed using finite element method calculation software COMSOL ver.5.3 (COMSOL Inc.). A calculation model was a two-dimensional axially symmetric structure calculation model, a frame was cylindrical, a diameter of an opening was 10 mm, and a thickness of a rear surface space (hereinafter also referred to as the rear surface distance) was 20 mm. A thickness of a membrane-like member was 250 μm, and a Young's modulus, which is a parameter indicating a hardness of the membrane, was variously changed in a range of 0.2 GPa to 10 GPa. The evaluation was performed in a normal incidence sound absorption coefficient arrangement, and a maximum value of a sound absorption coefficient and a frequency at that time were calculated.

In addition, the hardness of the membrane used for the sound reduction means using the membrane vibration is changed due to a change in ambient temperature, a change in humidity, and the like. As the hardness of the membrane changes, the natural frequency of the membrane vibration changes significantly. For this reason, it was found that, in a case of the sound reduction means using the membrane vibration, there is a problem that the frequency at which the sound can be reduced changes according to a change in the surrounding environment (temperature, humidity). According to the study of the inventors, it was found that this problem is remarkably observed in the fundamental vibration mode.

In contrast, in the soundproof structure 10 of the invention, a sound absorption coefficient of the membrane vibration of the membrane-like member 16 supported by the frame 18 at a frequency in at least one high-order vibration mode existing at 1 kHz or higher is higher than a sound absorption coefficient at a frequency in a fundamental vibration mode.

By using a configuration of absorbing a sound by membrane vibration in the high-order vibration mode by increasing a sound absorption coefficient at a frequency in a high-order vibration mode, that is, at a high-order natural frequency such as a secondary- or tertiary-order natural frequency, it is not necessary to make the membrane hard and thick, and accordingly, it is possible to prevent reflection of a sound by the membrane and obtain a high sound absorbing effect even at a high frequency.

In addition, the natural frequency in the high-order vibration mode is hard to change even in a case where the hardness of the membrane changes, accordingly, by using the membrane vibration in the high-order vibration mode, it is possible to reduce a high-order natural frequency and reduce an amount of change in frequency of a sound to be reduced, even in a case where the hardness of the membrane is changed due to a change of the surrounding environment. That is, it is possible to increase the robustness against environmental changes.

In addition, since the soundproof structure 10 of the invention absorbs a sound by using membrane vibration, the soundproof structure 10 is small and light and can appropriately reduce a sound at a specific frequency.

The inventors have surmised a mechanism of exciting the high-order vibration modes as follows.

There are frequency bands in the fundamental vibration mode and the high-order vibration mode determined by the conditions of the membrane (thickness, hardness, size, fixing method, and the like), and a distance (thickness[ of the rear surface space determines which mode in which the frequency is strongly excited to contribute to the sound absorption. This will be described below.

The portion where resonance occurring in the sound absorbing structure using a membrane may be divided into a membrane portion and a rear surface space portion. Accordingly, the sound absorption occurs by the interaction between these.

In a case where an acoustic impedance of the membrane is set as Zm and an acoustic impedance of the rear surface space is set as Zb in terms of mathematical expressions, a total acoustic impedance is expressed as Zt=Zm+Zb. A resonance phenomenon occurs in a case where the total acoustic impedance coincides with an acoustic impedance of a fluid (such as air). Here, the acoustic impedance Zm of the membrane is determined by the membrane portion. For example, the resonance in the fundamental vibration mode occurs, in a case where a portion according to the equation of motion due to a mass of the membrane (mass law), and a portion under the control of a tension such as a spring due to the fixation of the membrane (stiffness law) coincide with each other. In the same manner as described above, in the high-order vibration mode, the resonance also occurs due to a more complicated form of the membrane vibration than the fundamental vibration.

In a case where a high-order vibration mode does not easily occur in the membrane, such as in a case where the membrane has a large thickness, the band in the fundamental vibration mode becomes wider. However, as described above, the sound absorption is reduced because the membrane is hard and easily reflects. Under conditions where the high-order vibration mode is likely to occur in the membrane, such as by reducing the thickness of the membrane, the frequency bandwidth in which the fundamental vibration mode occurs becomes smaller, and the high-order vibration mode is in a high frequency range.

The acoustic impedance Zb of one rear surface space is different from the impedance of the open space because the flow of the airborne sound is restricted by the closed space or the through hole portion. For example, an effect of hardening of the rear surface space is obtained, as the thickness of the rear surface space becomes smaller. Qualitatively, as the rear surface distance becomes shorter, it becomes a distance suitable for a sound with a shorter wavelength, that is, a high frequency sound. In this case, a sound at a lower frequency has a smaller resonance because the rear surface space is too small with respect to the wavelength. That is, a change in rear surface distance determines which frequency of sound can be resonated.

Summarizing these, it is determined in which frequency region the fundamental vibration will occur depending on the membrane portion and high-order vibration will occur in another band. The rear surface space determines which frequency band of sound is easily excited, and accordingly, by setting this to a frequency corresponding to high-order vibration, it is possible to increase the sound absorption coefficient caused by the high-order vibration mode. This is the mechanism here.

Therefore, it is necessary to determine both the membrane and the rear surface space so as to excite the high-order vibration mode.

In regard to this point, a simulation was performed using an acoustic module of the finite element method calculation software COMSOL ver.5.3 (COMSOL Inc.).

In the calculation model of the soundproof structure 10, the frame 18 had a cylindrical shape as shown in FIG. 1 and an opening having a diameter of 20 mm. A thickness of the membrane-like member 16 was set as 50 μm, and a Young's modulus thereof was 4.5 GPa which is a Young's modulus of a polyethylene terephthalate (PET) film.

The calculation model was a two-dimensional axially symmetric structure calculation model.

In such a calculation model, the thickness of the rear surface space was changed from 10 mm to 0.5 mm by 0.5 mm, and the coupled calculation of sound and structure was performed, the structural calculation was performed regarding the membrane, and numerical calculation regarding the rear surface space was performed by calculating airborne of the sound. The evaluation was performed in a normal incidence sound absorption coefficient arrangement, and a maximum value of a sound absorption coefficient and a frequency at that time were calculated.

Figure 4:
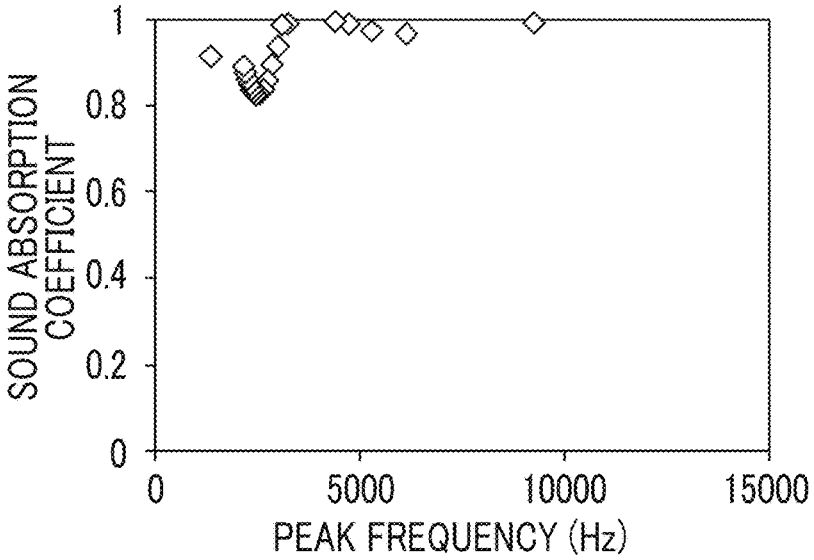
FIG. 4 is a graph showing a relationship between a peak frequency and a sound absorption coefficient.

The results thereof are shown in FIG. 4. FIG. 4 is a graph in which a frequency at which a sound absorption coefficient is maximum in each calculation model (hereinafter, referred to as a peak frequency) and a sound absorption coefficient at this peak frequency are plotted.

As shown in FIG. 4, it is found that a high absorption coefficient can be obtained even at a high frequency.

In addition, the order of the vibration mode of the peak frequency in each calculation model was analyzed.

Figure 5:
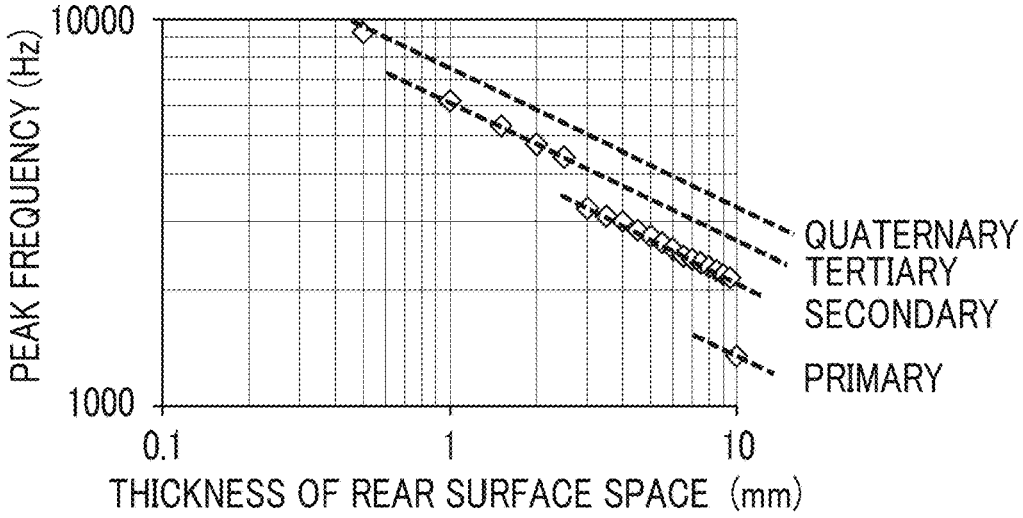
FIG. 5 is a graph showing a relationship between a thickness of a rear surface space and a peak frequency.
Figure 6:
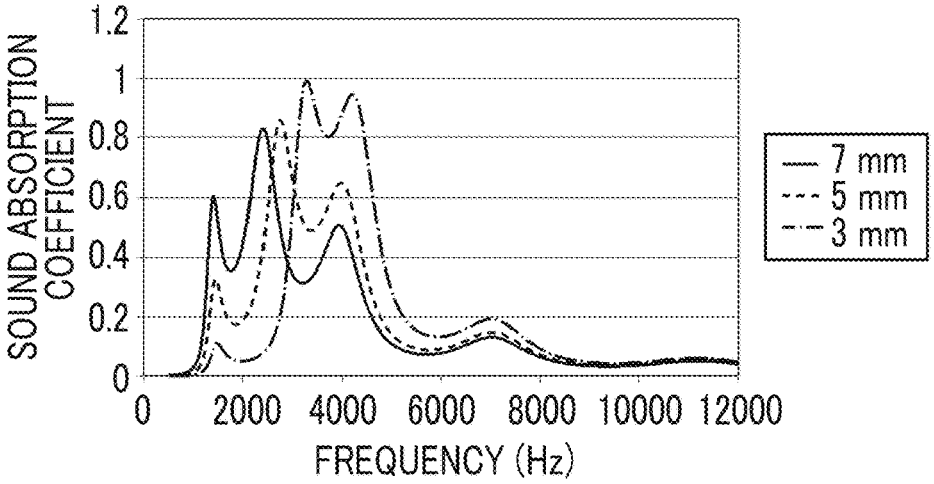
FIG. 6 is a graph showing a relationship between a frequency and a sound absorption coefficient.
Figure 7:
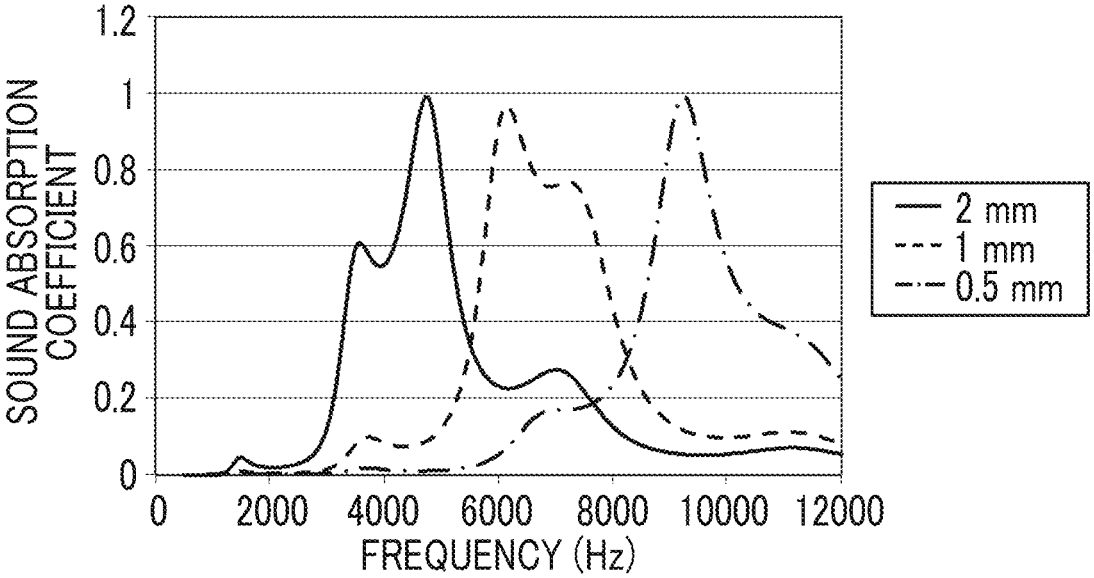
FIG. 7 is a graph showing a relationship between a frequency and a sound absorption coefficient.

FIG. 5 shows a graph in which a relationship between a peak frequency of each calculation model and a thickness of a rear surface space is plotted in a log-log graph, and a line is drawn for each order of the vibration mode. FIGS. 6 and 7 are graphs showing a relationship between a frequency and a sound absorption coefficient in each calculation model in a case where the thickness of the rear surface space is 7 mm, 5 mm, 3 mm, 2 mm, 1 mm, and 0.5 mm.

As clearly seen from FIG. 5, a peak frequency of the sound absorption coefficient is increased by reducing the thickness of the rear surface space. Here, it is found that the peak frequency is not continuously increased on the log-log axes by decreasing the thickness of the rear surface space, but a plurality of discontinuous changes are generated on the log-log axes. This characteristic indicates that the vibration mode in which the sound absorption coefficient becomes maximum shifts from the fundamental vibration mode to the high-order vibration mode or a higher-order mode of the high-order vibration mode. That is, it was found that the high-order vibration mode was easily excited by the thin membrane, and that the effect of the sound absorption by the high-order vibration mode rather than the fundamental vibration mode was significantly exhibited by reducing the thickness of the rear surface space. Therefore, a large sound absorption coefficient in a high frequency range is not caused by the fundamental vibration mode, but is caused by resonance in the higher order vibration mode. From a line drawn for each order of the vibration mode shown in FIG. 5, it is found that, in a case where the hardness of the membrane is constant, as the thickness of the rear surface space becomes thinner, the frequency in the higher-order vibration mode becomes a peak frequency, that is, a frequency in which the sound absorption coefficient is maximum.

For exciting of the high-order vibration mode, it is important to make the membrane soft by reducing the membrane thickness of the membrane-like member to 50 μm. The high-order vibration mode has a complicated vibration pattern on the membrane as compared with the fundamental vibration mode. That is, it has antinodes of a plurality of amplitudes on the membrane. Therefore, it is necessary to bend in a smaller plane size as compared with the fundamental vibration mode, and there are many modes that need to bend near the membrane fixing portion. Since the smaller the thickness of the membrane is, the more easily it bends, it is important to reduce the membrane thickness in order to use the high-order vibration mode. In addition, by reducing the length of the rear surface space to several mm, a system is obtained in which the sound absorption can be efficiently excited in the high-order vibration mode than in the fundamental vibration mode, which is the important point of the present invention.

In addition, since the hardness of the membrane is small due to the small film thickness, it is considered that reflection is small and a large sound absorption coefficient is generated even on a high frequency side.

From FIGS. 6 and 7, it is found that, in each calculation model, the sound absorption coefficient has maximum values (peaks) at a plurality of frequencies. The frequency at which the sound absorption coefficient has a maximum value is a frequency in a certain vibration mode. Among these, a lowest frequency of approximately 1,500 Hz is a frequency in the fundamental vibration mode. That is, all of the calculation models have the frequency of the fundamental vibration mode as approximately 1,500 Hz. In addition, a frequency having the maximum value existing at a frequency higher than the fundamental vibration mode of 1,500 Hz is the frequency in the high-order vibration mode. In all of the calculation models, the sound absorption coefficient at the frequency in the high-order vibration mode is higher than the sound absorption coefficient at the frequency in the fundamental vibration mode.

From FIGS. 6 and 7, it is found that, the smaller the thickness of the rear surface space, the lower the sound absorption coefficient at the frequency in the fundamental vibration mode, and the higher the sound absorption coefficient at the frequency in the high-order vibration mode.

In addition, it is found that, in a case where the thickness of the rear surface space of FIG. 7 is 0.5 mm, a large sound absorption coefficient of almost 100% can be obtained in an extremely high frequency region of 9 kHz or higher.

From FIGS. 6 and 7, it is found that there are a plurality of high-order vibration modes, each of which has a high sound absorption peak (maximum value of the sound absorption coefficient) at each frequency. Therefore, it is also found that the high sound absorption peaks are overlapped and exhibit a sound absorption effect over a comparatively wide band.

From the above, it is found that, by adopting a configuration in which the sound absorption coefficient at the frequency in the high-order vibration mode is higher than the sound absorption coefficient at the frequency in the fundamental vibration mode, a higher sound absorption effect can be obtained even at a higher frequency.

As is well known, the fundamental vibration mode is a vibration mode that appears on the lowest frequency side, and the high-order vibration mode is a vibration mode other than the fundamental vibration mode.

Whether the vibration mode is the fundamental vibration mode or the high-order vibration mode can be determined from the state of the membrane-like member. In the membrane vibration in the fundamental vibration mode, the center of gravity of the membrane has the largest amplitude, and the amplitude near the fixed end in the periphery is small. In addition, the membrane-like member has a speed in the same direction in all regions. On the other hand, in the membrane vibration in the high-order vibration mode, the membrane-like member has a portion having a speed in a direction opposite depending on a position.

Alternatively, in the fundamental vibration mode, the fixing portion of the membrane becomes a node of vibration, and no node exists on the other membrane surface. On the other hand, in the high-order vibration mode, since there is a portion that becomes a node of vibration on the membrane in addition to the fixed portion according to the above definition, it can be actually measured by the method described below.

In the analysis of the vibration mode, direct observation of the vibration mode is possible by measuring the membrane vibration using laser interference. Alternatively, the positions of the nodes can be visualized by sprinkling salt or white fine particles over the surface of the membrane and vibrating them, so that direct observation is possible using this method. This visualization of mode is known as the Chladni figure.

In addition, in a case of a circular membrane or a rectangular membrane, the frequency can be obtained analytically. In a case of using a numerical calculation method such as a finite element method calculation, the frequency in each vibration mode for any membrane shape can be obtained.

In addition, the sound absorption coefficient can be obtained by sound absorption coefficient evaluation using an acoustic tube. The evaluation is performed by producing a measurement system for the normal incidence sound absorption coefficient based on JIS A 1405-2. The same measurement can be performed using WinZacMTX manufactured by Japan Acoustic Engineering. An inner diameter of the acoustic tube is set as 20 mm, and a soundproof structure is disposed at the end of the acoustic tube with the membrane-like member facing up, a reflectivity is measured to acquire (1−reflectivity), and the evaluation of the sound absorption coefficient was is performed.

The smaller the diameter of the acoustic tube, the higher the frequency can be measured. In this case, a sound tube having a diameter of 20 mm is selected because it is necessary to measure the sound absorbing properties up to high frequencies.

The soundproof structure for which an experiment was performed in examples which will be described later has a structure in which a rear surface plate is attached as a bottom surface of a rear surface space. In the experiment, a comparison was made between a case where the measurement was performed using only the structure and a case where the measurement was performed under the condition in which an aluminum plate having a thickness of 100 mm was placed in contact with the back of the structure to make the body rigid. As a result, at any level, a result of the sound absorption coefficient did not change with the presence or absence of the thick aluminum plate. In other words, it was confirmed that the rear surface plate on the bottom surface of the structure functioned as a sufficiently rigid body, so that the sound did not leak and pass through the acoustic tube, and the incident sound was either reflected or absorbed. In addition, in the example, the result in a case of only the structure without disposing the aluminum plate was shown.

In the soundproof structure 10 of the invention, in order to have a configuration in which a sound absorption coefficient at a frequency in at least one high-order vibration mode is higher than a sound absorption coefficient at a frequency in a fundamental vibration mode, a thickness of the rear surface space 24, a size, a thickness, or a hardness of the membrane-like member 16, and the like may be adjusted.

Specifically, the thickness of the rear surface space 24 is preferably 10 mm or less, more preferably 5 mm or less, even more preferably 3 mm or less, and particularly preferably 2 mm or less, in order to absorb a sound on a high frequency side.

In a case where the thickness of the rear surface space 24 is not uniform, an average value may be within the above range.

The thickness of the membrane-like member 16 is preferably less than 100 μm, more preferably 70 μm or less, and even more preferably 50 μm or less. In a case where the thickness of the membrane-like member 16 is not uniform, an average value may be within the above range.

On the other hand, in a case where the thickness of the membrane is excessively thin, handling becomes difficult. The membrane thickness is preferably 1 μm or more, and more preferably 5 μm or more.

The Young's modulus of the membrane-like member 16 is preferably from 1,000 Pa to 1,000 GPa, more preferably from 10,000 Pa to 500 GPa, and most preferably from 1 MPa to 300 GPa.

The density of the membrane-like member 16 is preferably 10 $kg/m^3$ to 30,000 $kg/m^3$, more preferably 100 $kg/m^3$ to 20,000 $kg/m^3$, and most preferably 500 $kg/m^3$ to 10,000 $kg/m^3$.

A shape of the membrane-like member 16 (shape of a region where the membrane vibrates), that is, a shape of an opening cross section of the frame 18 is not particularly limited and may be, for example, a polygonal shape including a square such as a square, a rectangle, a rhombus, or a parallelogram, a triangle such as a regular triangle, an isosceles triangle, or a right triangle, a regular polygon such as a regular pentagon or a regular hexagon, a circle, an ellipse, or an indeterminate shape.

The size of the membrane-like member 16 (the size of the region where the membrane vibrates), that is, the size of an opening cross section of the frame 18 is preferably 1 mm to 100 mm, more preferably 3 mm to 70 mm, and even more preferably 5 mm to 50 mm, in terms of a equivalent circle diameter ($L_a$ in FIG. 2).

Here, the inventors have studied in more detail about the mechanism of exciting the high-order vibration mode in the soundproof structure 10.

As a result, in a case where the Young's modulus of the membrane-like member is set as E (Pa), the thickness is set as t (m), the thickness of the rear surface space (rear surface distance) is set as d (m), and the equivalent circle diameter of the region where the membrane-like member vibrates, that is, a total circle length diameter of the opening of the frame, in a case where the membrane-like member is fixed to the frame is set as Φ(m), the hardness of the membrane-like member $E\times t^3$ ($Pa\cdot m^3$) is preferably set as $21.6\times d^{-1.25}\times \Phi^{4.15}$ or less. In addition, in a case where the coefficient a is represented as $a\times d^{-1.25}\times\Phi^{4.15}$, it is found that a smaller coefficient a is preferable, as the coefficient a is 11.1 or less, 8.4 or less, 7.4 or less, 6.3 or less, 5.0 or less, 4.2 or less, and 3.2 or less.

It was found that, the hardness $E\times t^3$ ($Pa\cdot m^3$) of the membrane-like member is preferably $2.49\times10^{-7}$ or more, more preferably $7.03\times10^{-7}$ or more, even more preferably $4.98\times10^{-6}$ or more, still preferably $1.11\times10^{-5}$ or more, particularly preferably $3.52\times10^{-5}$ or more, and most preferably $1.40\times10^{-4}$ or more.

By setting the hardness of the membrane-like member in the above range, the high-order vibration mode can be suitably excited in the soundproof structure 10.

This will be described in detail below.

First, as physical properties of the membrane-like member, in a case where the hardness of the membrane-like members and the weight of the membrane-like members are respectively the same, it is considered that the properties of the membrane vibration are the same, even in a case where the materials, the Young's moduli, the thicknesses, and the densities are different. The hardness of the membrane-like member is a physical property represented by (Young's modulus of the membrane-like member)×(thickness of the membrane-like member)$^3$. In addition, the weight of the membrane-like member is a physical property proportional to (density of the membrane-like member)×(thickness of the membrane-like member).

Here, the hardness of the membrane-like member corresponds to a hardness in a case where tension is set as zero, that is, a case where the membrane-like member is attached to the frame without being stretched, for example, just being placed on a base. In a case where the membrane-like member is attached to the frame while applying tension, the same properties can be obtained by correcting the Young's modulus of the membrane-like member to include the tension.

Figure 27:
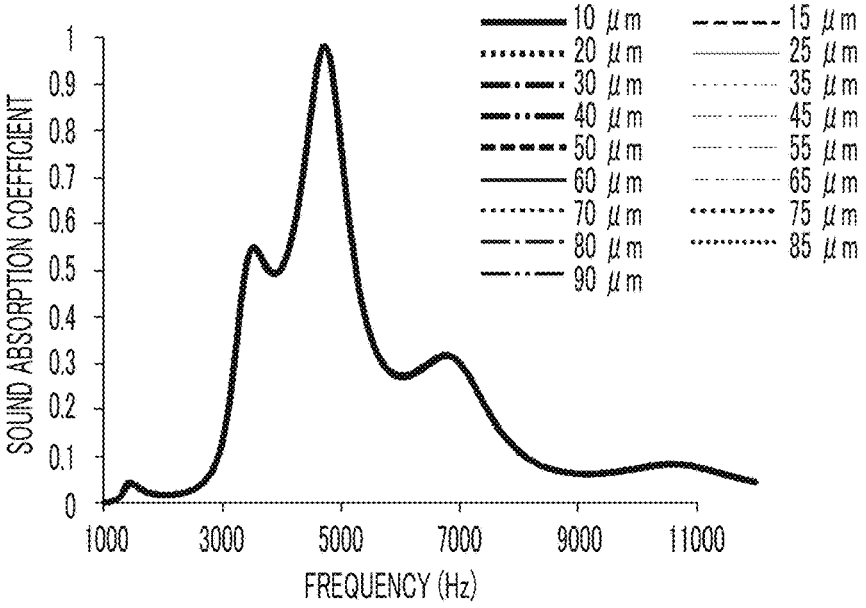
FIG. 27 is a graph showing a relationship between a frequency and a sound absorption coefficient.
Figure 28:
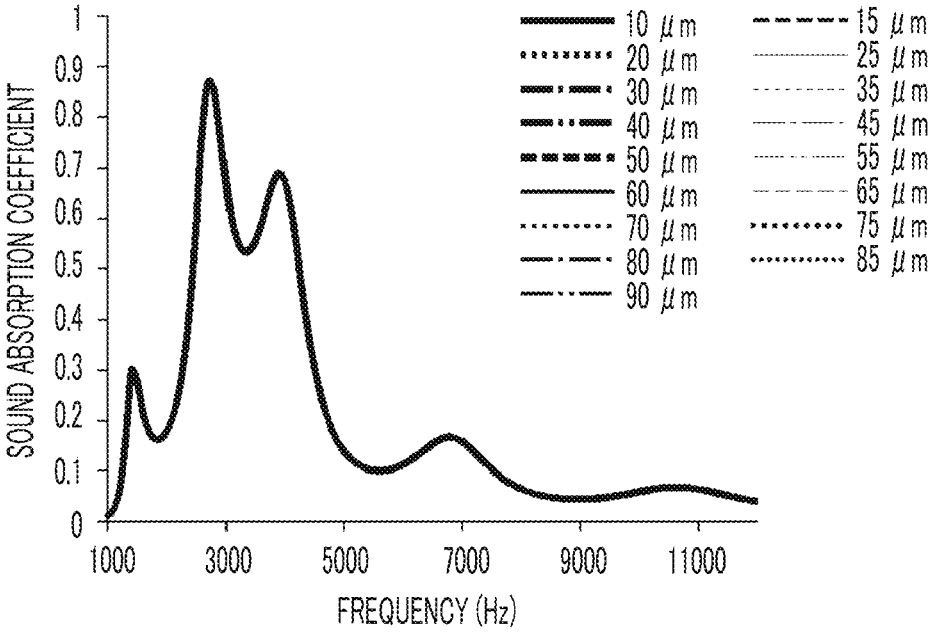
FIG. 28 is a graph showing a relationship between a frequency and a sound absorption coefficient.

FIGS. 27 and 28 show graphs showing results in which sound absorption coefficients by the soundproof structure are obtained by the simulation, in a case where the thickness of the membrane-like member is changed from 10 μm to 90 μm in increments of 5 μm, while keeping the hardness of the membrane-like member=(Young's modulus of the membrane-like member)×(thickness of the membrane-like member)$^3$ and the weight of the membrane-like member ≈ (density of the membrane-like member)×(thickness of the membrane-like member) constant. The simulation was performed using an acoustic module of the finite element method calculation software COMSOL ver.5.3 (COMSOL Inc.), in the same manner as described above.

The thickness, the Young's modulus, and density of the membrane-like member were changed according to the thickness of the membrane-like member by setting the thickness of 50 μm, the Young's modulus of 4.5 GPa, and the density of 1.4 $g/cm^3$ (corresponding to a PET film) as references.

The diameter of the opening of the frame was set as 20 mm.

FIG. 27 shows a result in a case where the rear surface distance is set as 2 mm, and FIG. 28 shows a result in a case where the rear surface distance is set as 5 mm.

As shown in FIG. 27 and FIG. 28, it is found that the same sound absorbing performance was obtained, although the thickness of the membrane-like member was changed from 10 μm to 90 μm. That is, it is found that, in a case where the hardness of the membrane-like members and the weight of the membrane-like members are respectively the same, the same properties are exhibited, even in a case where the thicknesses, the Young's moduli, and the densities are different.

Figure 29:
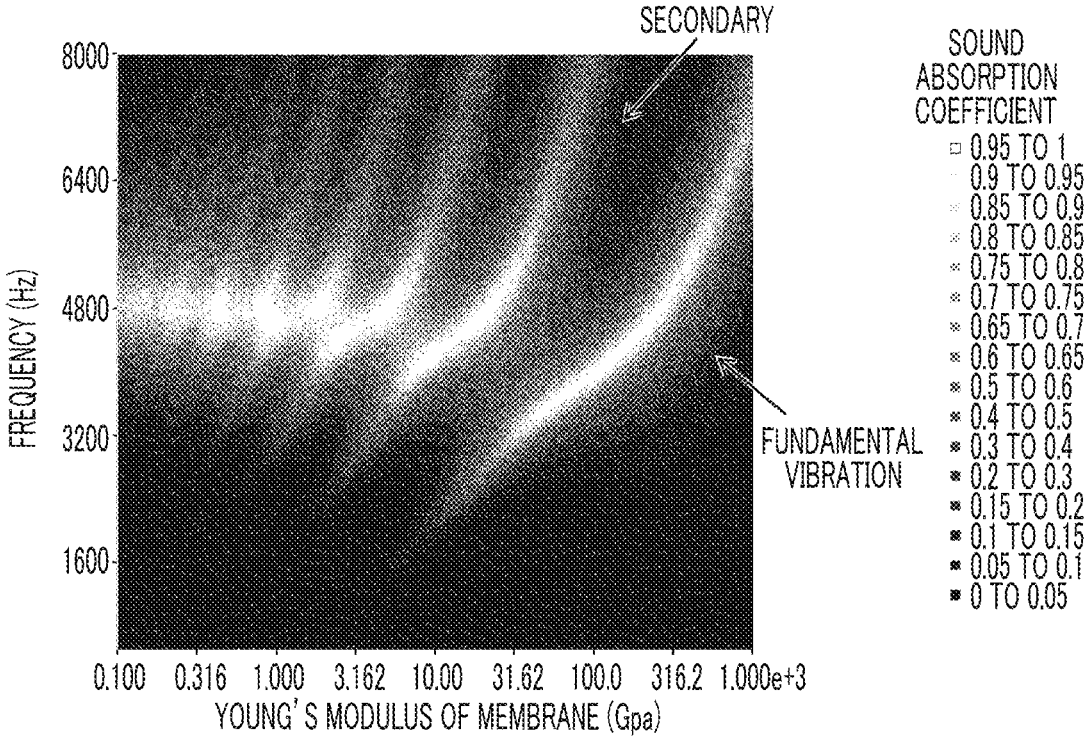
FIG. 29 is a graph showing a relationship between a Young's modulus of a membrane, a frequency, and a sound absorption coefficient.

Next, by setting the thickness of the membrane-like member as 50 μm, the density as 1.4 g/cm 3, the diameter of the opening of the frame as 20 mm, and the rear surface distance as 2 mm, the simulation was performed respectively by changing the Young's modulus of the membrane-like member from 100 MPa to 1000 GPa, and sound absorption coefficients were obtained. The calculation was performed by increasing an index from $10^8$ Pa to $10^{12}$ Pa in 0.05 steps. The results thereof are shown in FIG. 29. FIG. 29 is a graph showing a relationship between a Young's modulus of the membrane-like member, a frequency, and a sound absorption coefficient. This condition can be converted so that the same hardness is obtained for different thicknesses, depending on the result of the above simulation.

In the graph shown in FIG. 29, a band-like region on the rightmost side in the graph, that is, on a side where the Young's modulus is high and the sound absorption coefficient is high, is a region where the sound absorption caused by the fundamental vibration mode occurs. The fact that the mode is the fundamental vibration mode can be confirmed by the appearance of no low-order mode and visualization of the membrane vibration in the simulation. It can also be confirmed experimentally by measuring the membrane vibration.

A band-like region on the left side, that is, on a side where the Young's modulus of the membrane-like member is small and the sound absorption coefficient is high, is a region where the sound absorption caused by the secondary vibration mode occurs. In addition, a band-like region on the left side thereof where the sound absorption coefficient is high is a region where the sound absorption caused by the tertiary vibration mode occurs. Further, the sound absorption due to a higher-order vibration mode occurs, towards the left side, that is, as the membrane-like member becomes softer.

From FIG. 29, it is found that, in a case where the Young's modulus of the membrane-like member is high, that is, the membrane-like member is hard, sound absorption in the fundamental vibration mode becomes dominant, and as the membrane-like member becomes softer, sound absorption in the high-order vibration mode becomes more dominant.

Figure 30:
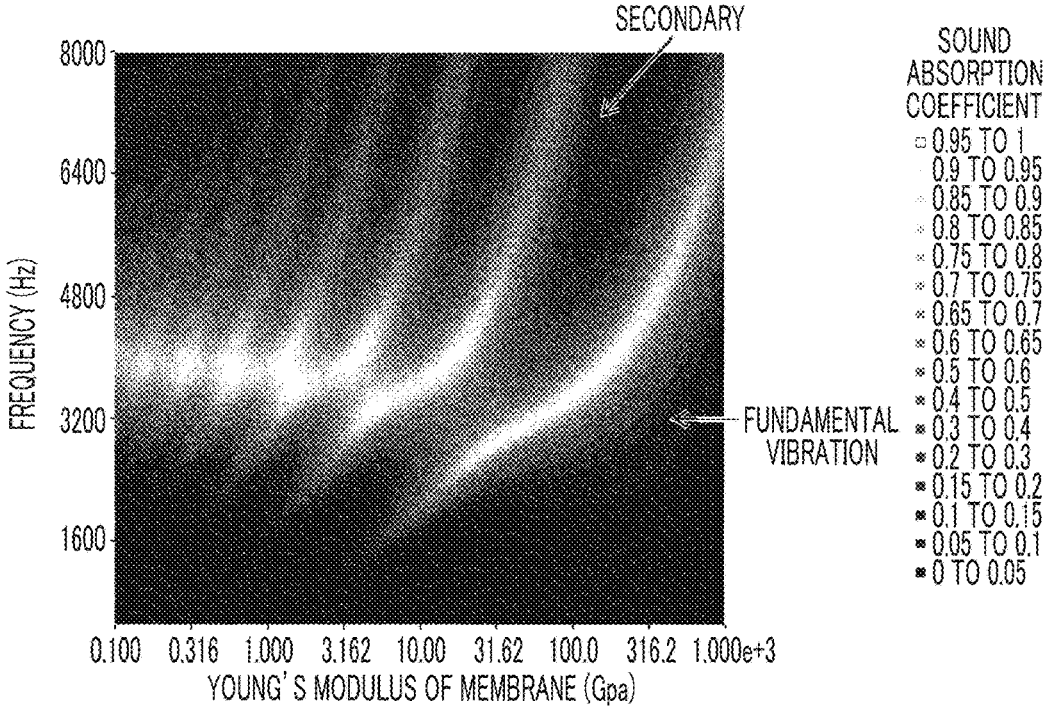
FIG. 30 is a graph showing a relationship between a Young's modulus of a membrane, a frequency, and a sound absorption coefficient.
Figure 31:
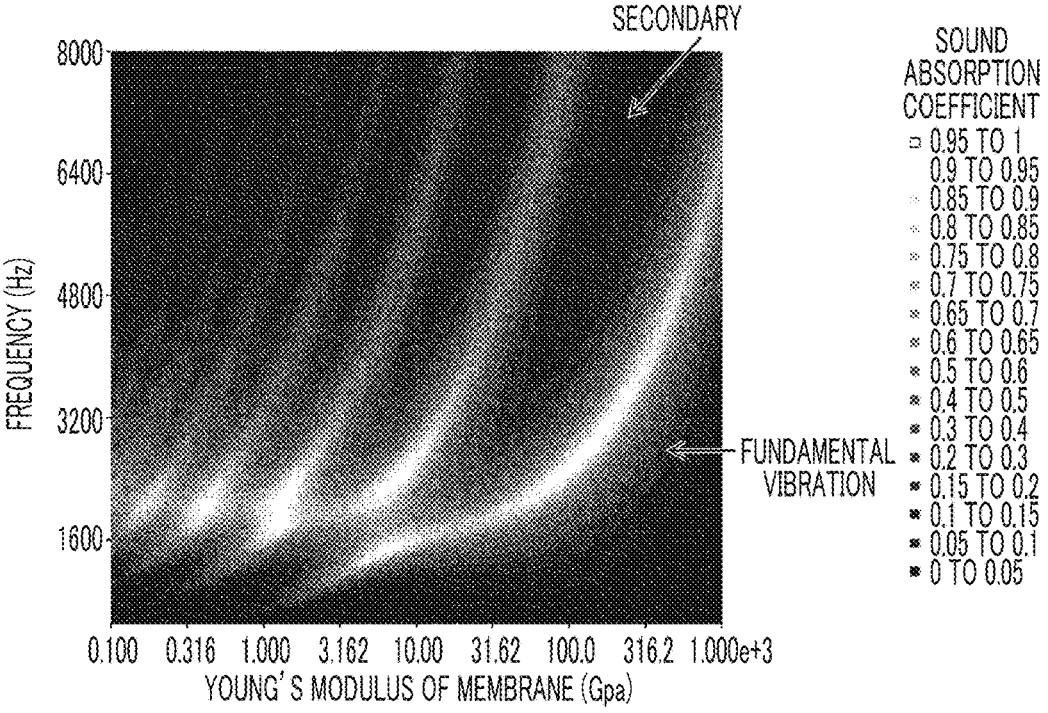
FIG. 31 is a graph showing a relationship between a Young's modulus of a membrane, a frequency, and a sound absorption coefficient.

FIGS. 30 and 31 show results in which sound absorption coefficients are obtained by performing the simulations by changing the Young's modulus of the membrane-like member in various ways in the same manner as described above except that the rear surface distance was set to 3 mm and 10 mm.

From FIGS. 30 and 31, it is also found that, in a case where the membrane-like member is hard, sound absorption in the fundamental vibration mode becomes dominant, and as the membrane-like member becomes softer, sound absorption in the high-order vibration mode becomes more dominant.

From FIG. 29 to FIG. 31, it is found that, in a case of sound absorption in the fundamental vibration mode, the frequency (peak frequency) at which the sound absorption coefficient becomes highest with respect to a change in the Young's modulus of the membrane-like member easily changes. In addition, it is found that, the higher the order, the smaller the change in the peak frequency even in a case where the Young's modulus of the membrane-like member changes.

Further, on the side where the hardness of the membrane-like member is small (in the range of 100 MPa to 5 GPa), even in a case where the hardness of the membrane-like member changes, the sound absorption frequency hardly changes, and the vibration mode switches to a different order vibration mode. Therefore, even in a case where the softness of the membrane greatly changes due to an environmental change or the like, it can be used without substantially changing the sound absorption frequency.

In addition, it is found that the peak sound absorption coefficient is small in the region where the membrane-like member is soft. This is because the sound absorption due to the bending of the membrane-like member becomes small, and only the mass (weight) of the membrane-like member becomes important.

In addition, it is found from the comparison in FIGS. 29 to 31 that the peak frequency decreases as the rear surface distance increases. That is, it is found that the peak frequency can be adjusted by the rear surface distance.

Here, from FIG. 29, the Young's modulus at which the sound absorption coefficient in the higher-order (secondary) vibration mode is higher than the sound absorption coefficient in the fundamental vibration mode (hereinafter, also referred to as "high-order vibration Young's modulus") was 31.6 GPa. In the same manner, from FIGS. 30 and 31, the Young's moduli at which the sound absorption coefficient in the higher-order (secondary) vibration mode is higher than the sound absorption coefficient in the fundamental vibration mode were respectively 22.4 GPa and 4.5 GPa.

In addition, in cases of the rear surface distances of 4 mm, 5 mm, 6 mm, 8 mm, and 12 mm, a simulation was performed by variously changing the Young's modulus of the membrane-like member in the same manner as described above to obtain the sound absorption coefficient, and the Young's modulus at which the sound absorption in the high-order (secondary) vibration mode was higher than the sound absorption coefficient in the fundamental vibration mode was read.

Figure 32:
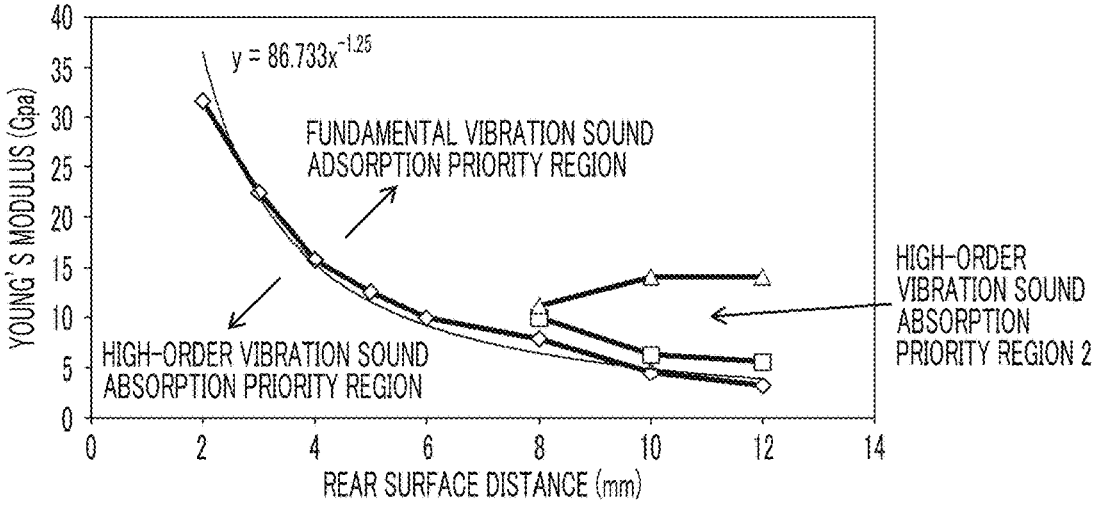
FIG. 32 is a graph showing a condition in which a sound absorption coefficient in a high-order vibration mode is higher than a sound absorption coefficient in a fundamental vibration mode, using a rear surface distance and a Young's modulus as parameters.

The results are shown in FIG. 32 and Table 1. FIG. 32 is a graph in which the values of the rear surface distance and the Young's modulus where the sound absorption coefficient in the high-order vibration mode is higher than the sound absorption coefficient in the fundamental vibration mode are plotted. In a case where the rear surface distance is 8 mm, 10 mm, or 12 mm, the sound absorption coefficient in the fundamental vibration mode decreases as the Young's modulus of the membrane-like member decreases, but there is a region where the sound absorption coefficient once increases in a case where the sound absorption coefficient further decreases. Therefore, in a region where the Young's modulus of the membrane-like member is low, there is a region where the sound absorption coefficient in the high-order vibration mode and the sound absorption coefficient in the fundamental vibration mode are reversed again.

TABLE 1

| Rear surface distance mm | High-order vibration Young's modulus GPa | Second reverse lower limit Young's modulus GPa | Second reverse upper limit Young's modulus GPa |
|---|---|---|---|
| 2 | 31.6 | — | — |
| 3 | 22.4 | — | — |
| 4 | 15.8 | — | — |
| 5 | 12.6 | — | — |
| 6 | 10 | — | — |
| 8 | 7.9 | 10 | 11.2 |
| 10 | 4.5 | 6.3 | 14.1 |
| 12 | 3.2 | 5.6 | 14.1 |

In FIG. 32, a region on the lower left side of a line connecting the plotted points is a region where sound absorption in the high-order vibration mode is higher (high-order vibration sound absorption priority region), and a region on the upper right side is a region where sound absorption in the fundamental vibration mode is higher (fundamental vibration sound absorption priority region).

A boundary line between the high-order vibration sound absorption priority region and the fundamental vibration sound absorption priority region was represented by an approximate expression, $y=86.733\times x^{-1.25}$.

Figure 33:
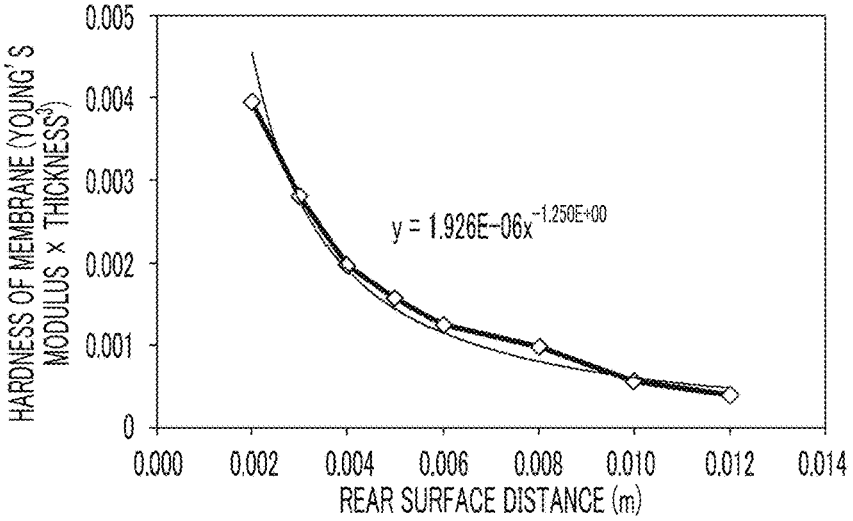
FIG. 33 is a graph showing a condition in which a sound absorption coefficient in a high-order vibration mode is higher than a sound absorption coefficient in a fundamental vibration mode, using a rear surface distance and a hardness of the membrane as parameters.

In addition, FIG. 33 shows a result of converting the graph shown in FIG. 32 into a relationship between the hardness ((Young's modulus)×(thickness)$^3$ (Pa·m$^3$)) of the membrane-like member and the rear surface distance (m). From FIG. 33, a boundary line between the high-order vibration sound absorption priority region and the fundamental vibration sound absorption priority region was represented by an approximate expression, $y=1.926\times10^{-6}\times x^{-1.25}$. That is, in order to have a configuration in which the sound absorption coefficient at the frequency in the high-order vibration mode is higher than the sound absorption coefficient at the frequency in the fundamental vibration mode, it is necessary to satisfy $y\leq1.926\times10^{-6}\times x^{-1.25}$.

In a case where the Young's modulus of the membrane-like member is set as E (Pa), the thickness is set as t (m), and the thickness of the rear surface space (rear surface distance) is set as d (m), the above equation is expressed as $E\times t^3$ (Pa·m$^3$)$\leq1.926\times10^{-6}\times d^{-1.25}$.

Next, the influence of the diameter of the opening of the frame (hereinafter, also referred to as the frame diameter) was examined.

In cases where the rear surface distance was 3 mm and the diameters of the opening of the frame were set as 15 mm, 20 mm, 25 mm, and 30 mm, the simulation was performed by variously changing the Young's modulus of the membrane-like member in the same manner as described above, and the sound absorption coefficient was calculated, and a graph as shown in FIG. 29 was obtained. From the obtained graph, the Young's modulus at which the sound absorption in the high-order vibration mode was higher than the sound absorption in the fundamental vibration mode was read.

Figure 34:
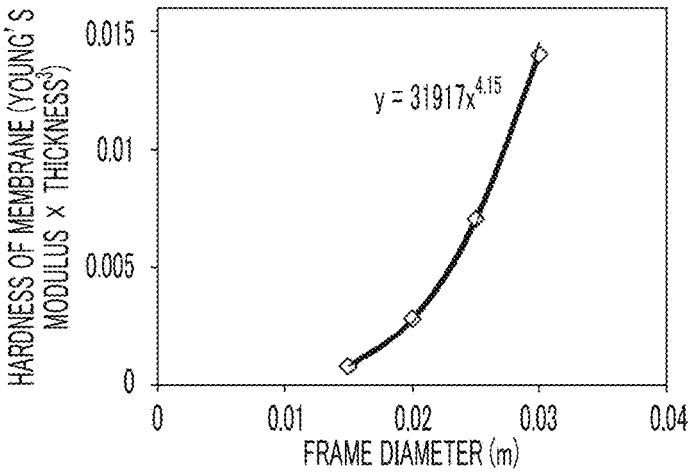
FIG. 34 is a graph showing a condition in which a sound absorption coefficient in a high-order vibration mode is higher than a sound absorption coefficient in a fundamental vibration mode, using a frame diameter and a hardness of the membrane as parameters.

The Young's modulus was converted into the hardness (Pa·m$^3$) of the membrane-like member, and the graph of the frame diameter (m) and the hardness of the membrane-like member shows points plotted where the sound absorption in the high-order vibration mode is higher than the sound absorption in the fundamental vibration mode. The results thereof are shown in FIG. 34. In FIG. 34, a line connecting the plotted points was represented by an approximate expression, $y=31917\times x^{4.15}$.

Figure 35:
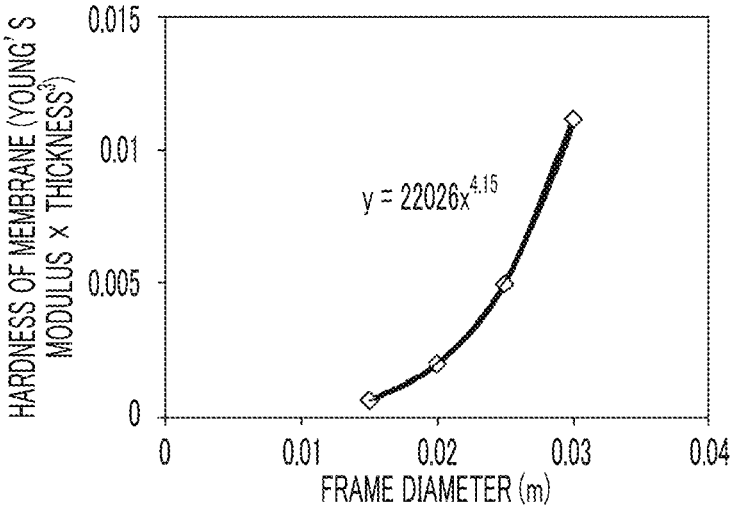
FIG. 35 is a graph showing a condition in which a sound absorption coefficient in a high-order vibration mode is higher than a sound absorption coefficient in a fundamental vibration mode, using a frame diameter and a hardness of the membrane as parameters.

The simulation was performed in the same manner for the case where the rear surface distance was 4 mm, and a graph plotting points where the sound absorption coefficient in the high-order vibration mode was higher than the sound absorption coefficient in the fundamental vibration mode was obtained. The results thereof are shown in FIG. 35. In FIG. 35, a line connecting the plotted points was represented by an approximate expression, $y=22026\times x^{4.15}$.

The same simulations were performed for other rear surface distances to obtain an approximate equation representing the boundary line between the high-order vibration sound absorption priority region and the fundamental vibration sound absorption priority region. In this case, the coefficients were different, but the index applied to the variable x was constant as 4.15.

The relational expression $E\times t^3$(Pa·m$^3$)$\leq1.926\times10^{-6}\times d^{-1.25}$ between the hardness (Pa·m$^3$) of the membrane-like member and the rear surface distance (m) obtained above is obtained in a case where the frame diameter is 20 mm, and accordingly, in a case where the frame diameter Φ(m) is incorporated as a variable in this equation using the frame diameter of 20 mm as a reference, $E\times t^3$ (Pa·m$^3$)$\leq1.926\times10^{-6}\times d^{-1.25}\times(\Phi/0.02)^{4.15}$ is obtained. Summarizing this, $E\times t^3$ (Pa·m$^3$)$\leq21.6\times d^{-1.25}\times\Phi^{4.15}$.

That is, by setting the hardness $E\times t^3$ (Pa·m$^3$) of the membrane-like member to be $21.6\times d^{-1.25}\times\Phi^{4.15}$ or less, the sound absorption coefficient in the high-order vibration mode can be higher than the sound absorption coefficient in the fundamental vibration mode.

As described above, the frame diameter Φ is a diameter of the opening of the frame, that is, a diameter of the region where the membrane-like member vibrates. In a case where the shape of the opening is other than a circle, the equivalent circle diameter may be used as Φ.

Here, the equivalent circle diameter can be obtained by calculating the area of the membrane vibrating portion region and calculating a diameter of a circle having the same area as the area.

From the above results, since the soundproof structure of the invention uses the high-order vibration mode of the membrane-like member, a resonance frequency (sound absorption peak frequency) thereof is substantially determined by the size and rear surface distance of the membrane-like member, and it is found that, even in a case where the hardness (Young's modulus) of the membrane changes due to a change in the surrounding environment, a change width of the resonance frequency is small, and the robustness against the environmental change is high.

Next, the density of the membrane-like member was examined.

By setting the density of the membrane-like member as 2.8 g/cm$^3$, thickness of the membrane-like member as 50 μm, the diameter of the opening of the frame as 20 mm, and the rear surface distance as 2 mm, the simulation was performed respectively by changing the Young's modulus of the membrane-like member from 100 MPa to 1000 GPa, and sound absorption coefficients were obtained.

Figure 36:
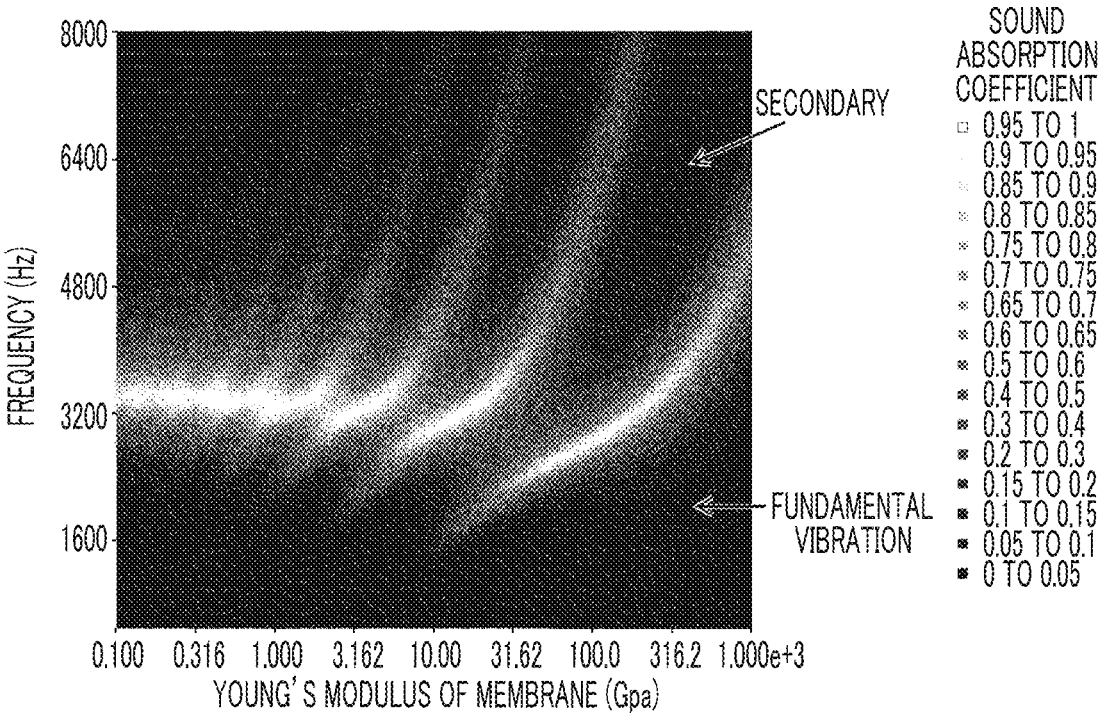
FIG. 36 is a graph showing a relationship between Young's modulus of a membrane, a frequency, and a sound absorption coefficient.

The results thereof are shown in FIG. 36.

From FIG. 36, in the same manner as in the simulation results described above, it is found that, sound absorption in the fundamental vibration mode is dominant in a region where the Young's modulus of the membrane-like member is large, and the sound absorption frequency thereof is highly dependent on the hardness of the membrane. It is found that, in the region where the Young's modulus of one of the membrane-like members is small, the sound absorption frequency hardly changes, even in a case where the hardness of the membrane changes.

From the comparison between FIG. 36 and FIG. 29 in which only the density of the membrane-like member is different, it is found that, the frequency in the region where the membrane is soft is shifted to the low frequency side, by increasing the density of the membrane-like member, that is, by increasing the mass of the membrane-like member (3.4 kHz in the simulation shown in FIG. 29, and 4.9 kHz in the simulation shown in FIG. 36).

From FIG. 36, the Young's modulus at which the sound absorption coefficient in the high-order vibration mode was higher than the sound absorption coefficient in the fundamental vibration mode was 31.6 GPa. This value is the same as the result of FIG. 29 in which only the density of the membrane-like member is different. Therefore, it is found that, although the frequency changes depending on the mass of the membrane-like member, the hardness of the membrane in which sound absorption in the high-order vibration mode is higher than sound absorption in the fundamental vibration mode does not depend on the mass of the membrane.

The simulation was performed in the same manner as the simulation shown in FIG. 36, except that the rear surface distances were changed to 3 mm, 4 mm, and 5 mm, and the Young's modulus at which the sound absorption coefficient in the high-order vibration mode was higher than the sound absorption coefficient in the fundamental vibration mode was obtained. The results thereof are shown in Table 2.

TABLE 2

| Rear surface distance | High-order vibration Young's modulus GPa |
|---|---|
| 2 | 31.6 |
| 3 | 22.4 |
| 4 | 15.8 |
| 5 | 12.6 |

From the comparison between Table 2 and Table 1, it is found that, even in a case where the mass of the membrane-like member is different, in a case where the rear surface distance is as small as 2 mm to 5 mm, the high-order vibration Young's modulus does not change without depending on the mass of the membrane-like member.

In addition, by setting the density of the membrane-like member as 4.2 g/cm$^3$, thickness of the membrane-like member as 50 μm, the diameter of the opening of the frame as 20 mm, and the rear surface distance as 2 mm, the simulation was performed respectively by changing the Young's modulus of the membrane-like member from 100 MPa to 1000 GPa, and sound absorption coefficients were obtained.

Figure 37:
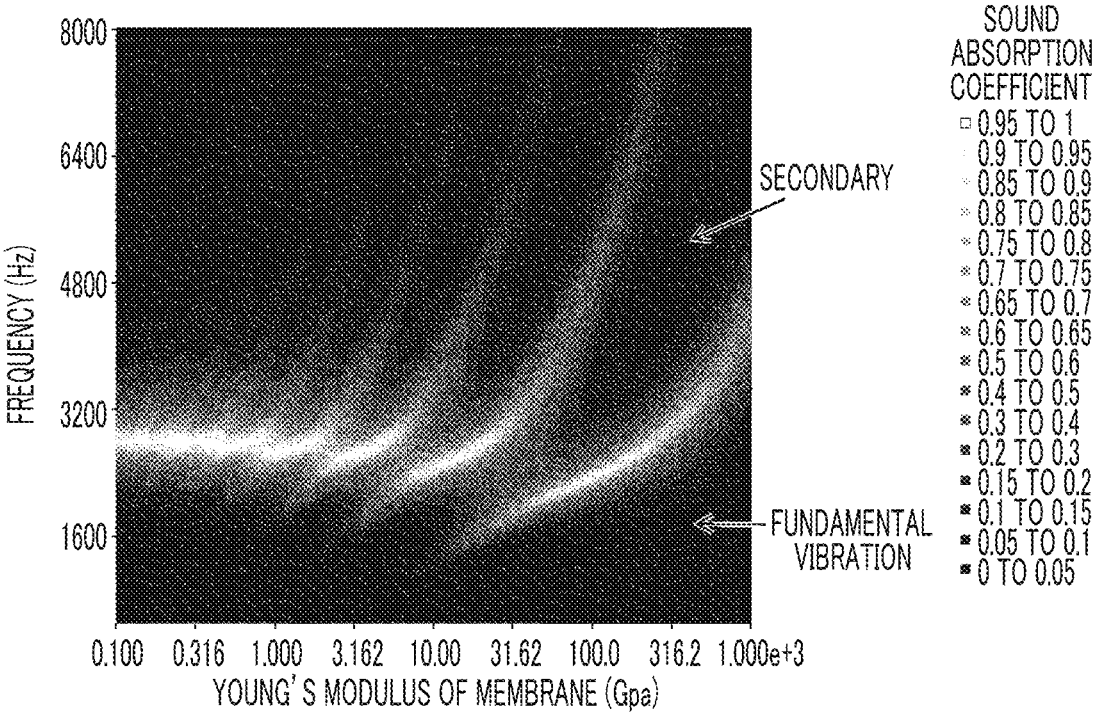
FIG. 37 is a graph showing a relationship between Young's modulus of a membrane, a frequency, and a sound absorption coefficient.

The results thereof are shown in FIG. 37.

From FIG. 37, even in a case where the density of the membrane-like member is higher, there is a region where the sound absorption coefficient in the high-order vibration mode is higher than the sound absorption coefficient in the fundamental vibration mode, and the Young's modulus at that time was 31.6 GPa.

Therefore, it is found that, although the sound absorption peak frequency depends on the density of the membrane-like member, a relationship between the Young's modulus where the sound absorption coefficient in the high-order vibration mode is higher than the sound absorption coefficient in the fundamental vibration mode, and the rear surface distance does not change.

From the above, it is found that the relational expression $E\times t^3$ (Pa·m$^3$)$\leq 21.6\times d^{-1.25}\times\Phi^{4.15}$ obtained above can be applied, even in a case where the density of the membrane-like member changes.

Here, in a case where the rear surface distance was 2 mm and the diameter of the opening of the frame was 20 mm, corresponding to FIG. 29, the sound absorption peaks respectively in the sound absorption in the fundamental vibration mode, the sound absorption in the secondary vibration mode, and the sound absorption in the tertiary vibration mode (sound absorption maximum values in respective modes) were obtained.

Figure 68:
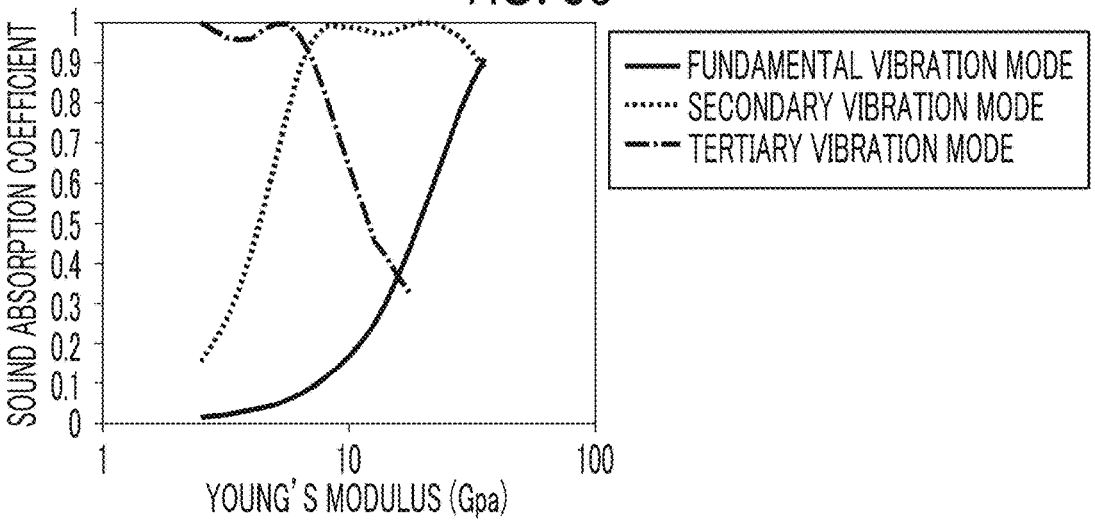
FIG. 68 is a graph showing a relationship between a Young's modulus and a sound absorption coefficient.

FIG. 68 shows a relationship between each Young's modulus and the sound absorption coefficient.

From FIG. 68, it is found that the sound absorption coefficient changes in each vibration mode by changing the hardness (Young's modulus) of the membrane. In addition, it is found that the softer the membrane, the higher the sound absorption coefficient in the high-order vibration mode. That is, it is found that, in a case where the membrane becomes soft, the sound absorption changes to the sound absorption in a higher-order vibration mode.

In the same manner as described above, in a case where the rear surface distance was 3 mm, corresponding to FIG. 30, the sound absorption peaks respectively in the sound absorption in the fundamental vibration mode, the sound absorption in the secondary vibration mode, and the sound absorption in the tertiary vibration mode were obtained.

Figure 69:
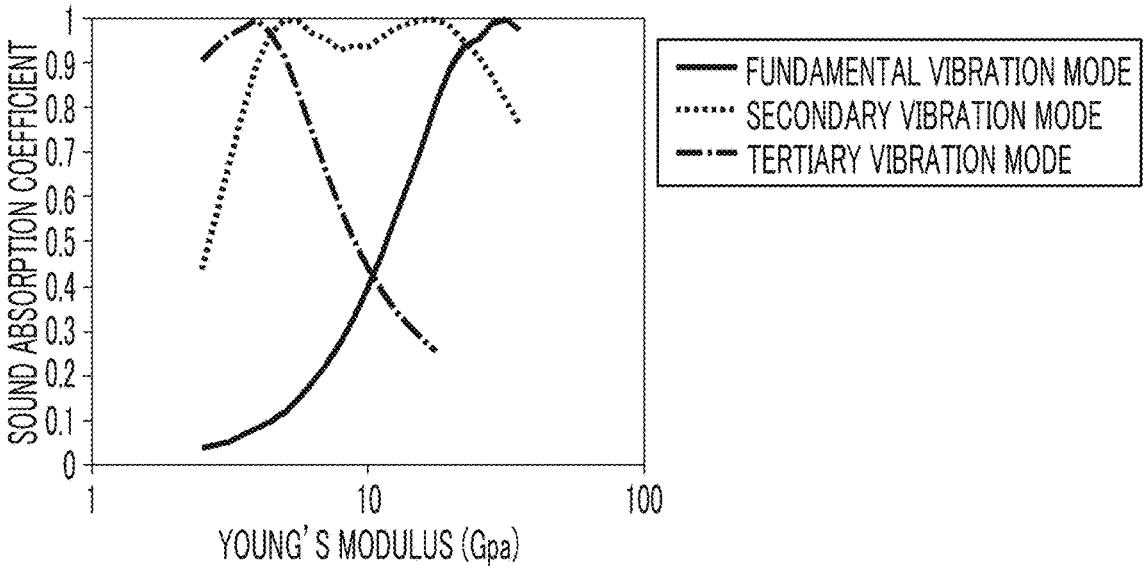
FIG. 69 is a graph showing a relationship between a Young's modulus and a sound absorption coefficient.

FIG. 69 shows a relationship between each Young's modulus and the sound absorption coefficient.

In FIGS. 68 and 69, the hardness of the membrane where the sound absorption coefficient in the fundamental vibration mode and the sound absorption coefficient in the secondary vibration mode are reversed corresponds to $21.6\times d^{-1.25}\times\Phi^{4.15}$.

Here, a relational expression $E\times t^3\leq 21.6\times d^{-1.25}\times\Phi^{4.15}$ was obtained regarding a sound absorption ratio of sound absorption in the fundamental vibration mode and sound absorption in the secondary vibration mode. In the same manner as described above, a coefficient on the right side can be obtained for the hardness of the membrane (Young's modulus×thickness$^3$). That is, assuming that the coefficient on the right side is a, from $E\times t^3=a\times d^{-1.25}\times\Phi^{4.15}$, the coefficient a corresponding to the Young's modulus E and the thickness t of the membrane that satisfies certain conditions can be obtained from $a=(E\times t^3)/(D^{-1.25}\times\Phi^{4.15})$.

The relationship between the coefficient a and the Young's modulus was obtained for each of the rear surface distance of 2 mm and the rear surface distance of 3 mm.

From FIGS. 68 and 69, a ratio of the peak sound absorption coefficient in the secondary vibration mode to the peak sound absorption coefficient in the fundamental vibration mode (sound absorption coefficient in the secondary vibration mode/sound absorption coefficient in the fundamental vibration mode, hereinafter, also referred to as sound absorption ratio) was obtained with respect to the Young's modulus.

The relationship between the sound absorption ratio and the Young's modulus was obtained for each of the rear surface distance of 2 mm and the rear surface distance of 3 mm.

From the relationship between the coefficient a and the Young's modulus and the relationship between the Young's modulus and the sound absorption ratio described above, a relationship between the coefficient a and the sound absorption ratio was obtained for each of the rear surface distance of 2 mm and the rear surface distance of 3 mm.

Figure 70:
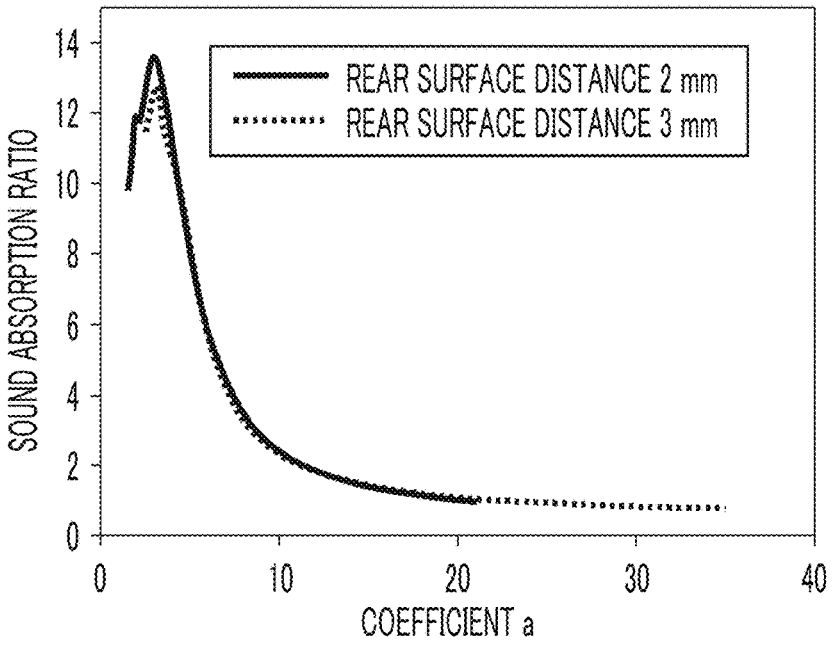
FIG. 70 is a graph showing a relationship between a coefficient a and a sound absorption ratio.

The results thereof are shown in FIG. 70.

The sound absorption coefficient with respect to the Young's modulus is different between the case where the rear surface distance is 2 mm and the case where the rear surface distance is 3 mm, since the hardness of the air spring due to the air in the rear surface of the membrane-like member is different (FIGS. 68 and 69). However, as shown in FIG. 70, in a case where the sound absorption ratio is indicated according to the coefficient a, it is found that the sound absorption ratio is determined regardless of the rear surface distance.

Table 3 shows a relationship between the sound absorption ratio and the coefficient a.

TABLE 3

| Coefficient a | Sound absorption ratio |
|---|---|
| 11.1 | 2 |
| 8.4 | 3 |
| 7.4 | 4 |
| 6.3 | 5 |
| 5 | 8 |
| 4.2 | 10 |
| 3.2 | 12 |

From FIG. 70 and Table 3, it is found that, the smaller the coefficient a, the larger the sound absorption ratio. In a case where the sound absorption ratio is high, sound absorption in a higher-order vibration mode appears more, and the effect of sound absorption by the compact and high-order vibration modes, which is a feature of the invention, can be significantly exhibited.

From Table 3, the coefficient a is preferably 11.1 or less, 8.4 or less, 7.4 or less, 6.3 or less, 5.0 or less, 4.2 or less, or 3.2 or less.

In addition, from another viewpoint, in a case where the coefficient a is 9.3 or less, the tertiary vibration sound absorption is higher than the fundamental vibration sound absorption coefficient. Therefore, it is also preferable that the coefficient a is 9.3 or less.

Next, the sound absorption peak frequency in a region where the Young's modulus was significantly low, that is, a region where the membrane is soft was examined.

Figure 38:
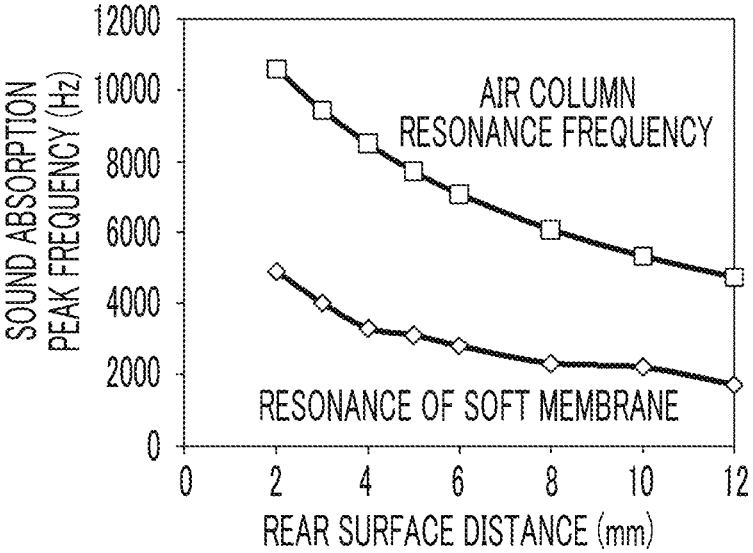
FIG. 38 is a graph showing a relationship between a rear surface distance and a sound absorption peak frequency.

First, the sound absorption peak frequency in a case where the Young's modulus was 100 MPa was read from FIG. 29 and the like, in the simulation results in a case where the density of the membrane-like member was 1.4 g/cm$^3$. The results thereof are shown in FIG. 38. FIG. 38 is a graph showing a relationship between a rear surface distance and a sound absorption peak frequency with a Young's modulus of 100 MPa.

From FIG. 38, it is found that the sound absorption peak frequency is on a low frequency side, as the rear surface distance increases.

Here, a comparison is made with a simple air column resonance tube without a membrane. For example, an soundproof structure having a rear surface distance of 2 mm is compared with air column resonance in a case where a length of the air column resonance tube is 2 mm. In a case where the rear surface distance is 2 mm, the resonance frequency in the air column resonance tube is approximately 10,600 Hz, even in a case where the opening end correction is added. The resonance frequency of the air column resonance is also plotted in FIG. 38.

From FIG. 38, it is found that, in the soundproof structure of the invention, in the region where the membrane is soft, the sound absorption peak frequency converges to a certain frequency with robustness, but the frequency is not the air column resonance frequency but the sound absorption peak at a lower frequency side. In other words, by attaching a membrane and absorbing sound in a high-order vibration mode, a compact sound absorbing structure that has robustness against a change of the membrane-like member and has a smaller rear surface distance compared to the air column resonance tube is realized.

On the other hand, in a case where the membrane is extremely soft, the sound absorption coefficient decreases. This is because the pitch of the antinodes and nodes of the membrane vibration becomes finer as the membrane vibration shifts to a higher order, and the bending due to the vibration becomes smaller, so that the sound absorbing effect is reduced.

In the same manner as described above, the sound absorption peak frequency in a case where the Young's modulus was 100 MPa was read from FIG. 36 and the like, in the simulation results in a case where the density of the membrane-like member was 2.8 g/cm$^3$. The results thereof are shown in FIG. 39.

Figure 39:
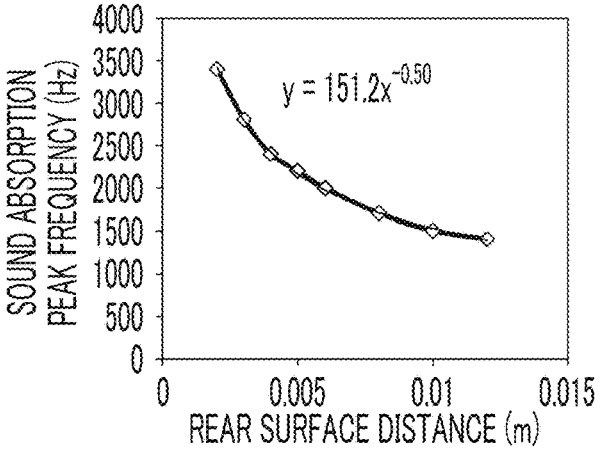
FIG. 39 is a graph showing a relationship between a rear surface distance and a sound absorption peak frequency.

From FIG. 39, since the sound absorption peak frequency is lower than that of the air column resonance tube, a compact sound absorbing structure with a small rear surface distance can be realized.

In addition, summarizing the approximate expression from the graph shown in FIG. 39, it is found that, in an area where the membrane is soft, the sound absorption peak frequency is proportional to the rear surface distance to the 0.5 power.

Figure 40:
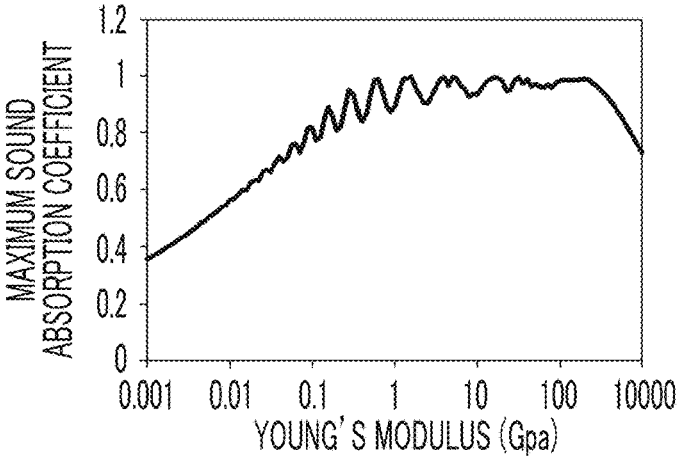
FIG. 40 is a graph showing a relationship between a Young's modulus and a maximum sound absorption coefficient.

Further, in order to examine even a soft membrane, the maximum sound absorption coefficient in a case where the Young's modulus was changed from 1 MPa to 1000 GPa was examined. The calculation was performed with a frame diameter of 20 mm, a thickness of the membrane-like member of 50 μm, and a rear surface distance of 3 mm. FIG. 40 shows the maximum sound absorption coefficient with respect to the Young's modulus. In the graph shown in FIG. 40, a waveform of the maximum sound absorption coefficient vibrates near the hardness at which the vibration mode in which a sound is absorbed is switched. In addition, it is found that the sound absorption coefficient decreases, in a case of the soft membrane in which the thickness of the membrane-like member is 50 μm and the Young's modulus is approximately 100 MPa or less.

Table 4 shows a hardness of the membrane corresponding to the Young's modulus at which the maximum sound absorption coefficient exceeds 40%, 50%, 70%, 80%, and 90%, and a hardness with which the sound absorption coefficient remains to exceed 90%, even in a case where the vibration mode order of the maximum sound absorption of the membrane is shifted.

From Table 4, it is found that, the hardness $E \times t^3$ (Pa·m$^3$) of the membrane-like member is preferably $2.49 \times 10^{-7}$ or more, more preferably $7.03 \times 10^{-7}$ or more, even more preferably $4.98 \times 10^{-6}$ or more, still preferably $1.11 \times 10^{-5}$ or more, particularly preferably $3.52 \times 10^{-5}$ or more, and most preferably $1.40 \times 10^{-4}$ or more.

TABLE 4

| Young's modulus MPa | Hardness of membrane $E \times t^3$ | Maximum sound absorption coefficient reference |
|---|---|---|
| 2 | 2.49E−07 | >40% |
| 5.6 | 7.03E−07 | >50% |
| 39.8 | 4.98E−06 | >70% |
| 89.1 | 1.11E−05 | >80% |
| 281.8 | 3.52E−05 | >90% |
| 1122 | 1.40E−04 | No vibration >90% |

Here, the sound absorption coefficient at the frequency in at least one high-order vibration mode, which has a higher sound absorption coefficient than the sound absorption at the frequency in the fundamental vibration mode, is preferably 20% or more, and more preferably 30% or more, even more preferably 50% or more, particularly preferably 70% or more, and most preferably 90% or more.

In the following description, a high-order vibration mode having a higher sound absorption coefficient than the sound absorption coefficient at the frequency of the fundamental vibration mode is simply referred to as a "high-order vibration mode", and the frequency thereof is simply referred to as a "frequency in the high-order vibration mode".

In addition, it is preferable that each of sound absorption coefficients at frequencies in two or more high-order vibration modes is 20% or more.

By setting the sound absorption coefficient to be 20% or more at frequencies in a plurality of high-order vibration mode, a sound can be absorbed at a plurality of frequencies.

In addition, a vibration mode in which high-order vibration modes having sound absorption coefficients of 20% or more continuously exist is preferable. That is, for example, it is preferable that the sound absorption coefficient at the frequency in the secondary vibration mode and the sound absorption coefficient at the frequency in the tertiary vibration mode are respectively 20% or more.

Furthermore, in a case where there are continuous high-order vibration modes in which the sound absorption coefficient is 20% or more, it is preferable that the sound absorption coefficient is 20% or more in the entire band between the frequencies of these high-order vibration modes.

Accordingly, a sound absorbing effect in a wide band can be obtained.

In addition, from a viewpoint of obtaining a sound absorbing effect in the audible range, the frequency in the high-order vibration mode in which the sound absorption coefficient is 20% or more is preferably in a range of 1 kHz to 20 kHz, more preferably in a range of 1 kHz to 15 kHz, even more preferably in a range of 1 kHz to 12 kHz, and particularly preferably in a range of 1 kHz to 10 kHz.

In the invention, the audible range is from 20 Hz to 20000 Hz.

In addition, within the audible range, the frequency at which the sound absorption coefficient is maximum is preferably at 2 kHz or higher, more preferably at 4 kHz or higher, even more preferably at 6 kHz or higher, and particularly preferably at 8 kHz or higher.

Further, in the above description, by using a case where a sound is perpendicularly incident to the membrane surface of the membrane-like member of the soundproof structure 10 as an example, it has been described that the sound absorption coefficient at the frequency in the high-order vibration mode is higher than the sound absorption coefficient at the frequency in the fundamental vibration mode, but in the soundproof structure of the invention, even in a case where a sound is obliquely incident to the membrane surface of the membrane-like member of the soundproof structure, the sound absorption coefficient at the frequency in the high-order vibration mode is preferably higher than the sound absorption coefficient at the frequency in the fundamental vibration mode.

Specifically, it is preferable that, regarding a sound incident in a direction of an angle of 0° (perpendicular incidence), 30°, and 60° with respect to a direction perpendicular to a surface of the membrane-like member, a sound absorption coefficient at a frequency in the high-order vibration mode is higher than a sound absorption coefficient at a frequency in the fundamental vibration mode.

The soundproof structure of the invention can reduce the obliquely incident sound in the same manner as the perpendicularly incident sound. With such characteristics, a specific sound can be strongly reduced, even in a case where random incident sound absorption occurs, such as in a case where the sound source and the soundproof structure are both placed in a wide space.

In addition, from a viewpoint of miniaturization, a thickness ($L_o$ in FIG. 2) of the thickest part of the soundproof structure 10 is preferably 10 mm or less, more preferably 7 mm or less, and even more preferably 5 mm or less. Further, the lower limit of the thickness is not limited as long as the membrane-like member can be suitably supported, but is preferably 0.1 mm or more, and more preferably 0.3 mm or more.

Figure 8:
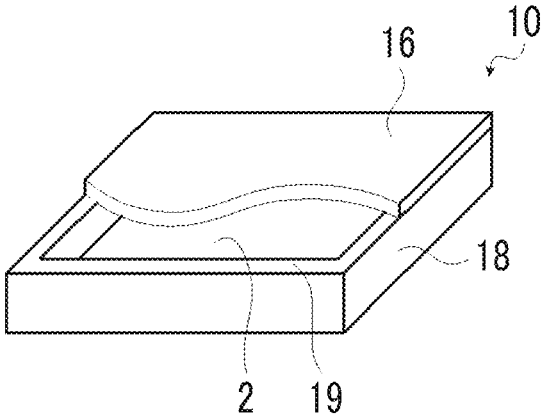
FIG. 8 is a perspective view schematically showing another example of the soundproof structure of the invention.

In addition, in the example shown in FIG. 1, the frame 18 has a cylindrical shape. However, the shape is not limited to this, and various shapes can be used, as long as the membrane-like member 16 can be supported to be vibrated. For example, as shown in FIG. 8, the frame 18 may have a rectangular parallelepiped shape in which the opening 20 having a bottom surface is formed on one surface, that is, a box shape having one surface opened. In FIG. 8, the membrane-like member 16 is partially omitted for the sake of description.

In the example shown in FIG. 1, the frame 18 includes the opening 20 that is open on one side and closed on the other side, and the membrane-like member 16 is disposed on the opening surface 19 of the frame 18, but the invention is not limited thereto, and the frame 18 may include an opening having both sides opened, and the membrane-like member 16 may be disposed on both opening surfaces.

Further, in the example shown in FIGS. 1 and 2, the rear surface space 24 is a closed space completely surrounded by the frame 18 and the membrane-like member 16, but the invention is not limited to this. It is sufficient that the space is substantially partitioned to inhibit a flow of air, and the space may be partially opened in the membrane or other portions, rather than the completely closed space. Such a state having an opening in a part is preferable from a viewpoint of preventing a change in sound absorbing properties by changing the hardness of the membrane-like member by applying tension to the membrane-like member 16 by expanding or contracting the air in the rear surface space 24 due to temperature change or a pressure change.

Figure 9:
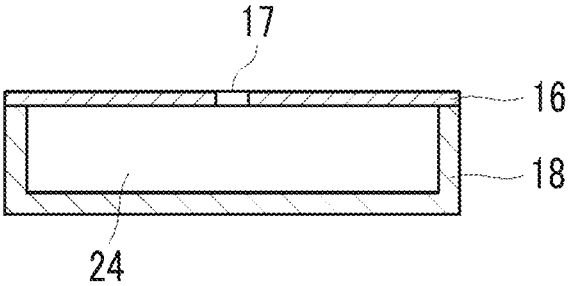
FIG. 9 is a cross-sectional view schematically showing another example of the soundproof structure of the invention.

For example, a through hole 17 may be formed in the membrane-like member 16, as in the example shown in FIG. 9.

By providing the through hole 17, the peak frequency can be adjusted.

By forming a through hole in the membrane portion, propagation by air propagation sound occurs. This changes the acoustic impedance of the membrane. In addition, the mass of the membrane is reduced due to the through hole. It is considered that the resonance frequency changed due to these. Therefore, the peak frequency can be controlled also by the size of the through hole.

Figure 64:
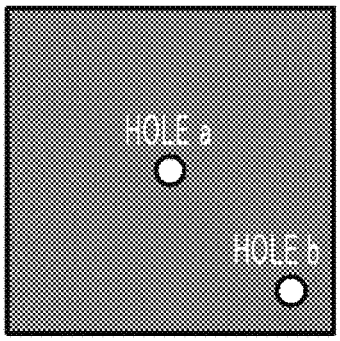
FIG. 64 is a top view for describing positions of through holes.

The position where the through hole 17 is formed is not particularly limited. For example, as shown as a hole a in FIG. 64, a through hole may be provided at a central position of the membrane-like member in the plane direction, or as shown as a hole b, a through hole may be provided at a position near the end fixed to the frame.

In this case, the sound absorption coefficient and the sound absorption peak frequency (hereinafter, also referred to as a sound absorption spectrum) change depending on the position of the through hole. For example, in a case where the through hole is formed at the position of the hole a in FIG. 64, the amount of change in the sound absorption spectrum is greater compared with a case where the through hole is not formed, more than in a case where the through hole is formed at the position of the hole b.

Figure 65:
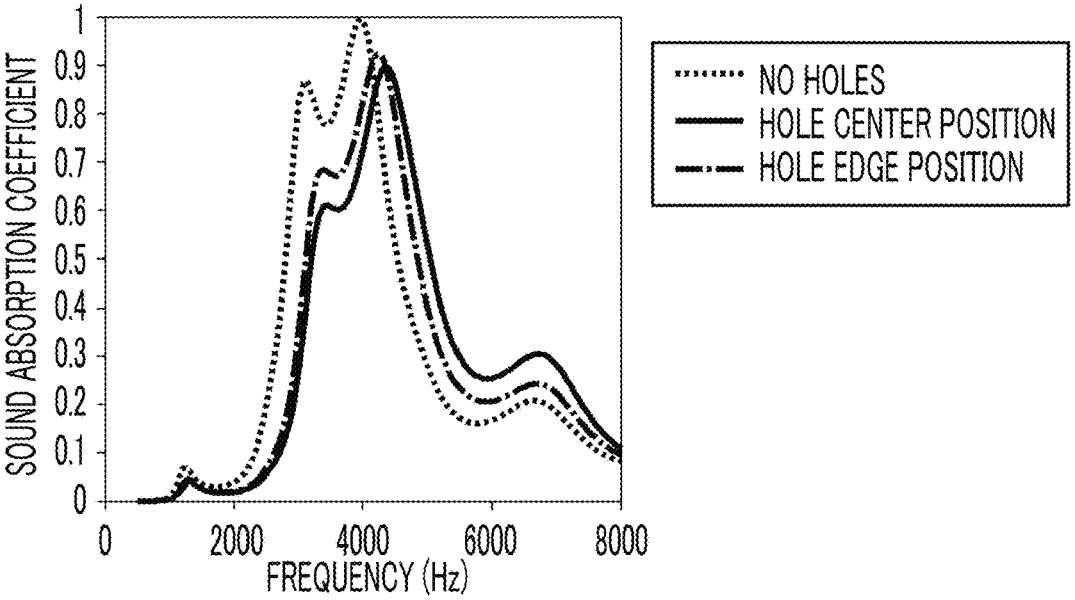
FIG. 65 is a graph showing a relationship between a frequency and a sound absorption coefficient.

FIG. 65 is a graph showing a relationship between the frequency and the sound absorption coefficient, in a case where the through hole is formed in the membrane-like member and in a case where the through hole is not formed.

FIG. 65 is a graph obtained by simulation using a PET film having a thickness of the membrane-like member of 50 and by setting an opening of the frame as 20 mm×20 mm, and a rear surface distance as 3 mm. The through holes had a diameter of 2 mm, and were formed at the center position (position of the hole a in FIG. 64) of the membrane-like member and at the end position (position of the hole b in FIG. 64) of the membrane-like member.

From FIG. 65, a sound absorption spectrum in a case where the through hole is formed at the end position (position of the hole b in FIG. 64) of the membrane-like member is closer to a sound absorption spectrum in a case where no through holes are formed, and the amount of change of the sound absorption spectrum is smaller, than a sound absorption spectrum in a case where the through hole is formed at the center position (position of the hole a in FIG. 64) of the membrane-like member.

A size of the through hole 17 is not particularly limited, as long as a flow of the air is inhibited. Specifically, in a range smaller than the size of a vibrating part, an equivalent circle diameter is preferably 0.1 mm to 10 mm, more preferably 0.5 mm to 7 mm, and even more preferably 1 mm to 5 mm.

In addition, an area of the through hole 17 is preferably 50% or less, more preferably 30% or less, even more preferably 10% or less with respect to the area of the vibrating part.

The same adjustment can be made, even in a case where there are a plurality of through holes.

In addition, the membrane-like member may have a configuration including one or more cut portions penetrating from one surface to the other surface. The cut portion is preferably formed in a region where the membrane-like member vibrates, and is preferably formed at an end of the region where the membrane-like member vibrates. In addition, the cut portion is preferably formed along a boundary between a region where the membrane-like member vibrates and a region fixed to the frame.

A length of the cut portion is not limited, as long as it is a length that the region where the membrane-like member vibrates is not completely divided, and is preferably less than 90% of the frame diameter.

In addition, one cut portion may be formed, or two or more cut portions may be formed.

By forming a cut portion in the membrane-like member, the sound absorbing frequency can be broadened (realizing a wide band).

Alternatively, a through hole may be provided in the bottom surface of the opening of the frame, that is, in the rear surface plate. Accordingly, air permeability through the soundproof structure can be ensured, and expansion (particularly, a membrane-like member) and dew condensation of each part due to a change in temperature and humidity or a change in air pressure can be prevented.

In addition, the bottom surface (rear surface plate) of the opening of the frame may be a vibrating membrane-like member. By setting the rear surface plate as a membrane-like member, the weight of the soundproof structure can be reduced. In addition, the sound absorbing effect can be obtained by vibrating the rear surface plate.

The bottom surface of the opening of the frame may be formed integrally with the frame as shown in FIG. 2, may be separately attached to the frame as a rear surface plate. Alternatively, instead of attaching the plate to the frame as the rear surface plate, a rear surface space may be formed with the frame, the housing, and the membrane-like member by using the housing in which the soundproof structure is installed, as the rear surface plate. For example, examples of the housing in which a soundproof structure is installed include electronic device housings such as a body of a vehicle, a member having a large flow resistance even with a ventilating material, other vehicle housing, a motor cover, a fan cover, and a copier housing.

In addition, the frame may be a cylindrical member having both ends of the opening opened, and a membrane-like member may be fixed to one opening surface of the frame and the other opening surface may be opened.

In a case of such a configuration, a length from the membrane-like member fixed to one opening surface of the frame to the other opening surface of the frame is set as $L_1$, the opening end correction distance is set as $\delta$, a wavelength at the frequency in any high-order vibration mode of the membrane-like member is set as $\lambda_a$, and n represents an integer of 0 or more, $$((\lambda_a/4-\lambda_a/8)+n\times\lambda_a/2-\delta)\leq L_1\leq((\lambda_a/4+\lambda_a/8)+n\times\lambda_a/2-\delta)\ldots \quad \text{Expression(1) is preferably satisfied.}$$

That is, $$((\lambda_a/4-\lambda_a/8)+n\times\lambda_a/2)\leq L_1+\delta\leq((\lambda_a/4+\lambda_a/8)+n\times\lambda_a/2)\ldots \quad \text{Expression(2) is preferably satisfied.}$$

Air column resonance can occur in a closed tube with a bottomed cylindrical shape that is formed of a cylindrical frame and a membrane-like member.

As is well known, in air column resonance in a closed tube, the closed end becomes a fixed end and becomes a node of a standing wave. On the other hand, the opening end becomes a free end and becomes an antinode in the standing wave. Here, the position of the antinode of the standing wave is actually outside the tube. This is referred to as opening end correction, and a distance from the opening end to the position of the antinode of the actual standing wave is referred to as the opening end correction length $\delta$. The length of the opening end correction in a case of a cylindrical closed tube is given by approximately 0.61× the radius of the tube.

Therefore, a quarter wavelength in the fundamental vibration in which one quarter wavelength is generated in the closed tube in the air column resonance is $L_1+\delta$.

Considering a case where n=0 in expression (2), a case where $L_1+\delta$ satisfies $(\lambda_a/4-\lambda_a/8)\leq L_1+\delta\leq(\lambda_a/4+\lambda_a/8)$ means that the quarter wavelength in the fundamental vibration of the column resonance coincides with the quarter wavelength $(\lambda_a/4)$ of the wavelength $\lambda_a$ corresponding to the resonance frequency in the high-order vibration mode of the simple membrane vibration, in terms of a width of $\pm\lambda_a/8$. In other words, the wavelength at the resonance frequency of the column resonance substantially coincides with the wavelength at the resonance frequency of the simple membrane vibration.

Here, considering a case where $L_1+\delta=\lambda_a/2$ is satisfied, in this case, the incident wave to the cylinder and the reflected wave by the closed tube cancel each other, and the standing wave generated in the closed tube becomes zero. That is, in this case, the waves cancel each other out, so that the effect of the reinforcement by the closed tube does not occur at all.

With respect to the interference between the incident wave and the reflected wave due to the closed tube, in a case where $L_1+\delta$ is in a range of $\lambda_a/4-\lambda_a/8$ to $\lambda_a/4+\lambda_a/8$, the incident wave and the reflected wave have a mutually reinforcing phase relationship. Meanwhile, in a range of, for example, $\lambda_a/4+\lambda_a/8$ to $3\times\lambda_a/4-\lambda_a/8$, the incident wave and the reflected wave have a mutually destructive phase relationship.

Accordingly, in a case of $(\lambda_a/4-\lambda_a/8)-\delta\leq L1\leq(\lambda_a/4+\lambda_a/8)-6$, in which a reinforcing relationship is involved by closing the tube, a sound field is strengthened by the presence of the tube.

The case where n=1 is a case of the triple vibration mode in which three quarter wavelengths are generated in the closed tube, and the case where n=2 is a case of the five-fold vibration mode. Considering a case of such a high-order vibration mode, in the same manner as described above, a case where the wavelength $\lambda_a$ and the length $L_1$ satisfy $(\lambda_a/4-\lambda_a/8)+n\times\lambda_a/2\delta\leq L_1\leq(\lambda_a/4+\lambda_a/8)+n\times\lambda_a/2-\delta$ means that the wavelength at the resonance frequency of the column resonance substantially coincides with the wavelength at the resonance frequency of the simple membrane vibration.

In other words, the soundproof structure that satisfies the above expression (1) means a soundproof structure in which a resonance frequency of the simple membrane vibration of the membrane-like member and a resonance frequency of air column resonance in a closed tube composed of the cylindrical member and the membrane-like member, in a case where the membrane-like member is regarded as a rigid body, substantially coincide with each other.

In a case where the soundproof structure satisfies the above expression (1), the sound absorption coefficient can be improved, and the frequency of sound absorption can be widened.

The length $L_1$ preferably satisfies $(\lambda_a/4-\lambda_a/8)-\delta\leq L_1\leq(\lambda_a/4+\lambda_a/8)-\delta$. In other words, the length $L_1$ is preferably a length in that a quarter wavelength of the fundamental vibration of the air column resonance and a quarter ($\lambda_a/4$) of the corresponding to the resonance frequency of the simple membrane vibration coincide with each other in terms of a width of $\pm\lambda_a/8$.

Thus, the length of the frame can be reduced, and the soundproof structure can be reduced in size and weight.

In addition, in the example shown in FIG. 1, the soundproof structure is configured to use a frame having one opening, but the invention is not limited to this, and the soundproof structure may have a configuration in which a frame having two or more openings are used and the membrane-like member may be disposed in each opening. In other words, a soundproof structure having a frame having one opening and one membrane-like member may be used as one soundproof cell, and a soundproof structure having a configuration in which frames of a plurality of soundproof cells are integrated. Furthermore, the membrane-like member of each soundproof cell may be integrated.

Figure 22:
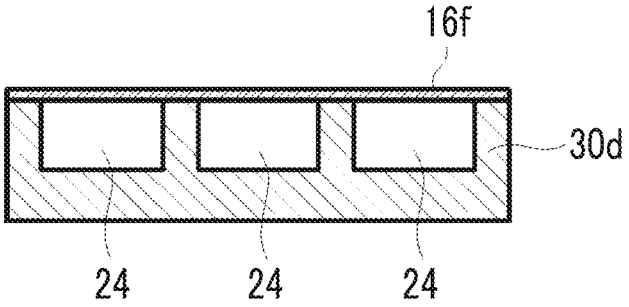
FIG. 22 is a plan view schematically showing another example of the soundproof structure of the invention.

For example, in the example shown in FIG. 22, the soundproof structure includes a frame 30*d* having three openings formed on the same surface, and a membrane-like member 16*f* large enough to cover the three openings, and the membrane-like member 16*f* is fixed to the surface of the frame 30*d* where the three openings are formed with an adhesive/pressure sensitive adhesive. The membrane-like member 16*f* covers each of the three openings, and each portion of the openings can independently vibrate. In each opening, a rear surface space 24 is formed to be surrounded by the membrane-like member 16*f* and the frame 30*d*. That is, in the example shown in FIG. 22, the soundproof structure has a configuration in which three soundproof cells are provided, and the frame of each soundproof cell and the membrane-like member are integrated.

Here, in the example shown in FIG. 22, each soundproof cell has the same thickness and is arranged in the same plane, but the invention is not limited to this. From a viewpoint of the thickness, it is preferable that these are arranged in the same plane with the same thickness.

In addition, in the example shown in FIG. 22, each soundproof cell has the same specification and has the same resonance frequency. However, the invention is not limited to this. The soundproof structure may have a configuration including soundproof cells having different resonance frequencies. Specifically, the soundproof structure may include a soundproof cell in which at least one of the thickness of the rear surface space, the material of the membrane, and the thickness of the membrane, is different.

Figure 23:
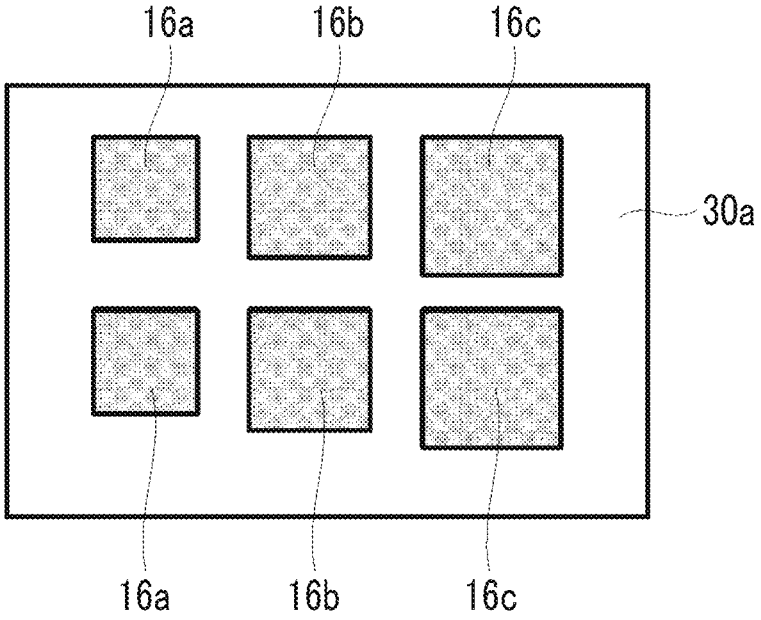
FIG. 23 is a cross-sectional view schematically showing another example of the soundproof structure of the invention.

For example, in the soundproof structure of the example shown in FIG. 23, the frame 30*a* has two openings each having three different sizes, and membrane-like members 16*a* to 16*c* having a different sizes are disposed on each opening. That is, the soundproof structure of the example shown in FIG. 23 has three types of soundproof cells having different resonance frequencies due to different areas of the region where the membrane-like member vibrates.

Figure 24:
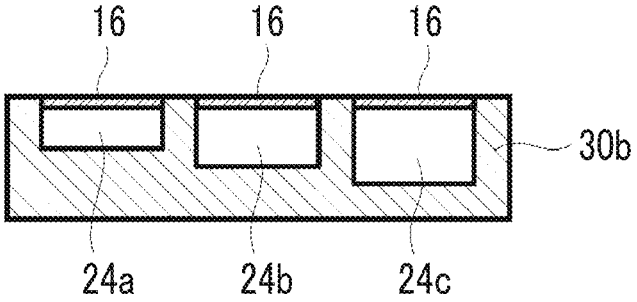
FIG. 24 is a cross-sectional view schematically showing another example of the soundproof structure of the invention.

In addition, in the soundproof structure of the example shown in FIG. 24, the frame 30*b* has openings each having three different depths, and the membrane-like member 16 is disposed on each opening. That is, each soundproof cell has rear surface spaces 24*a* to 24*c* having different thicknesses. Therefore, the soundproof structure of the example shown in FIG. 24 has a configuration of including three soundproof cells having different resonance frequencies due to different thicknesses of the rear surface space.

Figure 25:
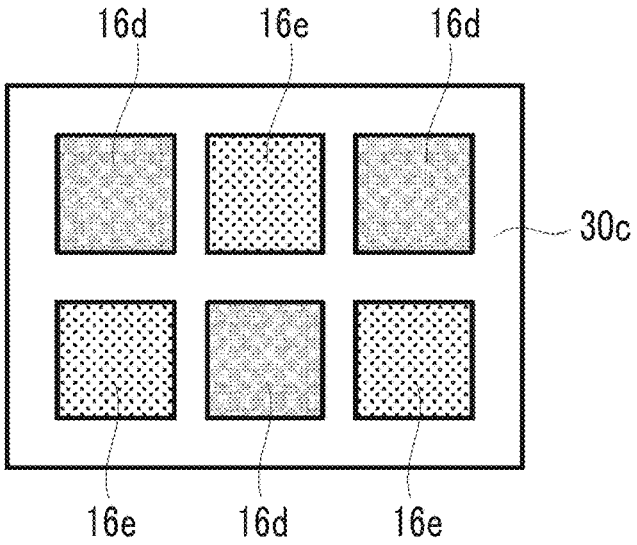
FIG. 25 is a cross-sectional view schematically showing another example of the soundproof structure of the invention.

Further, the soundproof structure of the example shown in FIG. 25 has two types of membrane-like members 16*d* and 16*e* formed of different materials and a frame 30*c* including six openings, and one of the two types of membrane-like members 16*d* and 16*e* is disposed alternately on the six openings. Accordingly, the soundproof structure of the example shown in FIG. 25 has two types of soundproof cells having different resonance frequencies due to different materials of the membrane-like members.

As in the soundproof structures of the examples shown in FIGS. 23 to 25, by using a configuration of including soundproof cells having different resonance frequencies, it is possible to reduce sounds in a plurality of frequency bands at the same time.

In the examples shown in FIGS. 23 to 25, the soundproof structure has a configuration in which the frame of each soundproof cell is integrated. However, the invention is not limited to this, and independent soundproof cells that reduce sounds in different frequency bands are arranged or lain, thereby reducing sounds at a plurality of frequencies.

Figure 10:
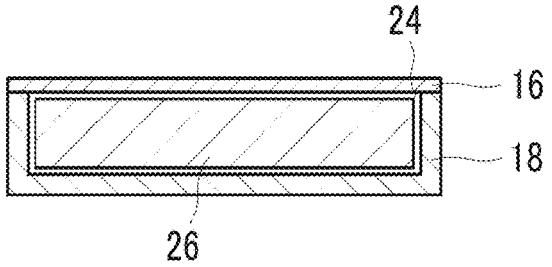
FIG. 10 is a cross-sectional view schematically showing another example of the soundproof structure of the invention.

In addition, as in the example shown in FIG. 10, the soundproof structure of the invention may be configured to include a porous sound absorbing body 26 in the rear surface space 24.

By disposing the porous sound absorbing body 26 in the rear surface space 24, it is possible to widen the band to a lower frequency side instead of reducing the peak sound absorption coefficient.

Figure 26:
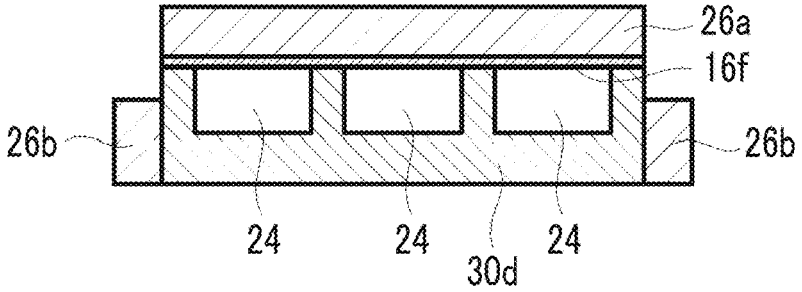
FIG. 26 is a cross-sectional view schematically showing another example of the soundproof structure of the invention.

In addition, as in the example shown in FIG. 26, the soundproof structure may include a porous sound absorbing body 26*a* disposed on an upper surface of the membrane-like member 16*f* (surface opposite to the frame 30*d*), or may include porous sound absorbing bodies 26*b* disposed on an outer surfaces such as a side surface and a bottom surface of the frame 30*d*. Accordingly, both the resonance sound reduction due to the membrane vibration and the sound absorption effect in a wide range by the porous sound absorbing body can be applied.

The porous sound absorbing body 26 is not particularly limited, and a well-known porous sound absorbing body in the related art can be suitably used. Examples thereof include various well-known porous sound absorbing bodies such as a foamed material such as urethane foam, soft urethane foam, wood, a ceramic particle sintered material, or phenol foam, and a material containing minute air; a fiber such as glass wool, rock wool, microfiber (such as THINSULATE manufactured by 3M), a floor mat, a carpet, a melt blown nonwoven, a metal nonwoven fabric, a polyester nonwoven, metal wool, felts, an insulation board, and glass nonwoven, and nonwoven materials; a wood wool cement board; a nanofiber material such as a silica nanofiber; and a gypsum board.

A flow resistance $\sigma_1$ of the porous sound absorbing body is not particularly limited, and is preferably 1,000 to 100,000 (Pa·s/m$^2$), more preferably 5,000 to 80,000 (Pa·s/m$^2$), and even more preferably 10,000 to 50,000 (Pa·s/m$^2$).

The flow resistance of the porous sound absorbing body can be evaluated by measuring the normal incidence sound absorption coefficient of a porous sound absorbing body having a thickness of 1 cm and fitting the Miki model (J. Acoustic. Soc. Jpn., 11(1) pp. 19-24 (1990). Alternatively, the evaluation may be performed according to "ISO 9053".

Examples of the material of the frame 18 include a metal material, a resin material, a reinforced plastic material, and a carbon fiber. Examples of the metal material include metal materials such as aluminum, titanium, magnesium, tungsten, iron, steel, chromium, chromium molybdenum, nichrome molybdenum, copper, and alloys thereof. Examples of the resin material include resin materials such as an acrylic resin, polymethyl methacrylate, polycarbonate, polyamideide, polyarylate, polyetherimide, polyacetal, polyetheretherketone, polyphenylenesulfide, polysulfone, polyethylene terephthalate, polybutylene terephthalate, polyimide, an ABS resin (acrylonitrile-butadiene-styrene copolymerized synthetic resin), polypropylene, and triacetyl cellulose. Examples of the reinforced plastic material include carbon fiber reinforced plastics (CFRP) and glass fiber reinforced plastics (GFRP). In addition, examples thereof include natural rubber, chloroprene rubber, butyl rubber, ethylene propylene diene rubber (EPDM), silicone rubber, and the like, and rubbers having a crosslinked structure thereof.

In addition, various honeycomb core materials can be used as materials for the frame. Since the honeycomb core material is used as a lightweight and highly-rigid material, ready-made products are easily available. The honeycomb core material formed of various materials such as an aluminum honeycomb core, an FRP honeycomb core, a paper honeycomb core (manufactured by Shin Nippon Feather Core Co., Ltd. and Showa Aircraft Industry Co., Ltd.), a thermoplastic resin (PP, PET, PE, or PC), and a honeycomb core (TECCELL manufactured by Gifu Plastics Industry Co., Ltd.) can be used as the frame.

In addition, a structure containing air, that is, a foamed material, a hollow material, a porous material, or the like can also be used as the frame material. In order to prevent the air flow between cells in a case of using a large number of membrane type soundproof structures, a frame can be formed using, for example, a closed-cell foamed material. For example, various materials such as closed-cell polyurethane, closed-cell polystyrene, closed-cell polypropylene, closed-cell polyethylene, and closed-cell rubber sponge can be selected. The use of closed-cell foam body is suitably used as the frame material, since it prevents a flow of sound, water, gas, and the like and has a high structural hardness, compared to an open-cell foam body. In a case where the above-described porous sound absorbing body has sufficient supporting properties, the frame may be formed only of the porous sound absorbing body, or the materials described as the materials of the porous sound absorbing body and the frame may be combined by, for example, mixing, kneading, or the like. As described above, the weight of the device can be reduced by using a material system containing air inside. In addition, heat insulation can be provided.

Here, the frame 18 is preferably formed of a material having higher heat resistance than a flame-retardant material, because it can be disposed at a position at a high temperature. The heat resistance can be defined, for example, by a time to satisfy Article 108-2 of the Building Standard Law Enforcement Order. In a case where the time to satisfy Article 108-2 of the Building Standard Law Enforcement Order is 5 minutes or longer and shorter than 10 minutes, it is defined as a flame-retardant material, in a case where the time is 10 minutes or longer and shorter than 20 minutes, it is defined as a quasi-noncombustible material, and in a case where the time is 20 minutes or longer, it is defined as a noncombustible material. However, heat resistance is defined for each field in many cases. Therefore, in accordance with the field in which the soundproof structure is used, the frame 18 may be formed of a material having heat resistance equivalent to or higher than flame retardance defined in the field.

A thickness (frame thickness, $t_1$ in FIG. 2) and a thickness (height in a direction perpendicular to the opening surface, $L_b$ in FIG. 2) of the frame 18 is not particularly limited, as long as the membrane-like member 16 can be reliably fixed and supported, and can be, for example, set according to the size of the opening cross section of the frame 18.

Examples of the material of the membrane-like member 16 include various metal such as aluminum, titanium, nickel, permalloy, 42 alloy, kovar, nichrome, copper, beryllium, phosphor bronze, brass, nickel silver, tin, zinc, iron, tantalum, niobium, molybdenum, zirconium, gold, silver, platinum, palladium, steel, tungsten, lead, and iridium; and resin materials such as polyethylene terephthalate (PET), triacetyl cellulose (TAC), polyvinylidene chloride (PVDC), polyethylene (PE), polyvinyl chloride (PVC), polymethylpentene (PMP), a cycloolefin polymer (COP), ZEONOR, polycarbonate, polyethylene naphthalate (PEN), polypropylene (PP), polystyrene (PS), polyarylate (PAR), aramid, polyphenylene (PPS), polyethersulfone (PES), nylon, polyester (PEs), a cyclic and olefin copolymer (COC), diacetylcellulose, nitrocellulose, cellulose derivatives, polyamide, polyamideimide, polyoxymethylene (POM), polyether imide (PEI), polyrotaxane (such as a slide ring material), and polyimide. In addition, a glass material such as thin membrane glass, and a fiber reinforced plastic material such as carbon fiber reinforced plastic (CFRP) and glass fiber reinforced plastic (GFRP) can also be used. In addition, examples thereof include natural rubber, chloroprene rubber, butyl rubber, EPDM, silicone rubber, and the like, and rubbers having a crosslinked structure thereof. Alternatively, a combination thereof may be used.

In a case of using a metal material, the surface may be plated with metal from a viewpoint of preventing rust and the like.

From a viewpoint of excellent durability against heat, ultraviolet rays, external vibration, and the like, it is preferable to use a metal material as the material of the membrane-like member 16 in applications requiring durability.

The method for fixing the membrane-like member 16 to the frame 18 is not particularly limited, and a method using a double-sided tape or an adhesive, a mechanical fixing method such as screwing, or pressure bonding can be suitably used. The fixing method can be selected from a viewpoints of heat resistance, durability, and water resistance, in the same manner as in a case of the frame and the membrane. For example, as the adhesive, "Super X" series manufactured by Cemedine Co., Ltd., "3700 series (heat resistant)" manufactured by Three Bond Co., Ltd., heat-resistant epoxy adhesive "Duralco series" manufactured by Taiyo Wire Cloth Co., Ltd. can be selected. In addition, as the double-sided tape, high heat resistant double-sided adhesive tape 9077 manufactured by 3M or the like can be selected. As described above, various fixing methods can be selected according to the required properties.

In addition, by selecting a transparent member such as a resin material for both the frame 18 and the membrane-like member 16, the soundproof structure 10 itself can be made transparent. For example, a transparent resin such as PET, acryl, or polycarbonate may be selected. Since a general porous sound absorbing material may not prevent scattering of visible light, it is specificity that a transparent soundproof structure can be realized.

In addition, an antireflection coating and/or an antireflection structure may be provided on the frame 18 and/or the membrane-like member 16. For example, an antireflection coating using optical interference by a dielectric multilayer membrane can be formed. By preventing the reflection of visible light, the visibility of the frame 18 and/or the membrane-like member 16 can be further reduced and made inconspicuous.

By doing so, the transparent soundproof structure can be attached to, for example, a window member or used as an alternative.

In addition, the frame 18 or the membrane-like member 16 may have a heat shielding function. Generally, a metallic material reflects both near-infrared rays and far-infrared rays, and accordingly, radiant heat conduction can be prevented. In addition, even in a case of a transparent resin material or the like, it is possible to reflect only the near-infrared rays while keeping it transparent by providing a heat shielding structure on a surface thereof. For example, the near-infrared rays can be selectively reflected while transmitting visible light by a dielectric multilayer structure. Specifically, multilayer Nano series such as Nano90s manufactured by 3M reflect the near-infrared rays with a layer configuration of more than 200 layers, and accordingly, such a structure can be bonded to a transparent resin material and used as the frame or the membrane-like member, or this member itself may be used as the membrane-like member 16. For example, as a substitute for the window member, a structure having sound absorbing properties and heat shielding properties can be used.

In a system in which an environmental temperature changes, it is desirable that both the material of the frame 18 and the membrane-like member 16 have a small change in physical properties with respect to the environmental temperature.

For example, in a case of using a resin material, it is desirable to use a material having a point at which a significant change in physical properties is caused (glass transition temperature, melting point, or the like) that is beyond the environmental temperature range.

In addition, in a case where different materials are used for the frame and the membrane-like member, it is desirable that thermal expansion coefficients (linear thermal expansion coefficients) at the environmental temperature are substantially the same.

In a case where the thermal expansion coefficients are greatly different between the frame and the membrane-like member, an amount of displacement between the frame and the membrane-like member changes in a case where the environmental temperature changes, and accordingly, a distortion easily occurs on the membrane. Since a distortion and a tension change affect the resonance frequency of the membrane, a sound reduction frequency easily changes according to a temperature change, and even in a case where the temperature returns to the original temperature, the sound reduction frequency may remain as changed, without reducing the distortion.

In contrast, in a case where the thermal expansion coefficients are substantially the same, the frame and the membrane-like material expand and contract in the same manner with respect to a temperature change, so that the distortion hardly occurs, thereby exhibiting sound reduction properties stable with respect to a temperature change.

A coefficient of linear thermal expansion is known as an index of the thermal expansion coefficient, and can be measured, for example, by a well-known method such as JIS K7197. A difference in the coefficient of linear thermal expansion between the frame and the membrane-like material is preferably 9 ppm/K or less, more preferably 5 ppm/K or less, and even more preferably 3 ppm/K or less, in an environmental temperature range used. By selecting a member from such a range, it is possible to exhibit a stable sound reduction properties at the environmental temperature used.

In addition, the support (frame) that supports the membrane-like member so as to be able to vibrate may be any member, as long as it can support the membrane-like member so as to perform membrane vibration, and for example, may be a part of the housing of various electronic apparatuses.

In addition, the frame may be integrally formed on the housing side in advance, and the membrane can be attached later.

Further, the support is not limited to the configuration of the frame, and may be a plate-shaped member. In a case where a flat-shaped support is used, the membrane-like member can be supported so as to perform membrane vibration by bending the membrane-like member and fixing the ends to the support.

In addition, it is also possible to perform the support so as to perform membrane vibration without the support by the frame, by a configuration in which a fixing portion of the membrane is fixed to a member with an adhesive or the like, pressure is applied from the rear surface side to inflate the membrane-like member, and then the rear surface side is covered with a plate.

Hereinabove, the soundproof structure of the invention have been described in detail with various embodiments, but the invention is not limited to these embodiments, and various modifications or changes may be made without departing from a gist of the invention.

EXAMPLES

Hereinafter, the invention will be described in more detail based on examples. The materials, amounts used, ratios, processing details, processing procedures, and the like shown in the following examples can be suitably changed without departing from the gist of the invention. Therefore, the scope of the invention should not be construed as being limited by the following examples.

Example 1

<Production of Soundproof Structure>

A PET film having a thickness of 50 μm (Lumirror manufactured by Toray Industries, Inc.) was cut to have a circular shape having an outer diameter of 40 mm as the membrane-like member.

The frame was produced as follows.

An acrylic plate (manufactured by Hikari Co., Ltd.) having a thickness of 1 mm was prepared, and one donut-shaped (ring-shaped) plate having an inner diameter of 20 mm and an outer diameter of 40 mm was produced using a laser cutter. In addition, one circular plate having an outer diameter of 40 mm was produced. The outer diameters of the donut-shaped plate and the circular plate produced were set to be identical and these were bonded to each other with a double-sided tape (GENBA NO CHIKARA manufactured by ASKUL Corporation) to produce a frame.

The membrane-like member (PET film) was bonded to the opening side of the produced frame, that is, the surface of the donut-shaped plate opposite to the circular plate with a double-sided tape to produce a soundproof structure.

A thickness of the rear surface space of the soundproof structure is 1 mm. In addition, the rear surface space is a closed space. Further, an inner diameter (equivalent circle diameter) of the frame is the size of the membrane vibrating part, which is 20 mm.

<Evaluation>

An acoustic tube measurement was performed on the produced soundproof structure in an arrangement in which a sound was incident from the membrane-like member side. The evaluation was performed by producing a measurement system for the normal incidence sound absorption coefficient based on JIS A 1405-2. The same measurement can be performed using WinZacMTX manufactured by Japan Acoustic Engineering. An inner diameter of the acoustic tube was set as 2 cm, the soundproof structure was placed at the end of the acoustic tube, the membrane-like member side was disposed as the sound incident surface side, and the normal incidence sound absorption coefficient was evaluated.

Figure 11:
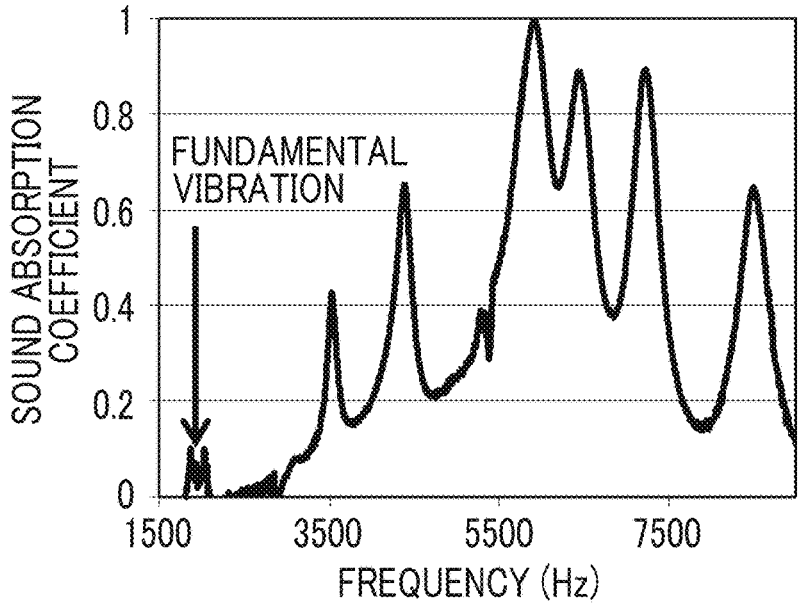
FIG. 11 is a graph showing a relationship between a frequency and a sound absorption coefficient.

FIG. 11 is a graph showing a relationship between the measured frequency and the sound absorption coefficient.

In FIG. 11, a maximum value (local peak) existing near 2,000 Hz is the sound absorption coefficient corresponding to the fundamental vibration mode. As can be seen from FIG. 11, the sound absorption coefficient at the frequency in the fundamental vibration mode was less than 10%.

FIG. 11 also shows that there are a plurality of maximum points at frequencies higher than the frequency in the fundamental vibration mode. These are sound absorption coefficients corresponding to high-order vibration mode. The sound absorption at the frequencies corresponding to the plurality of high-order vibration modes is higher than the sound absorption coefficient at the frequency in the fundamental vibration mode. Among them, the maximum sound absorption coefficients was obtained at a frequency of approximately 5.9 kHz corresponding to a quaternary vibration mode, and the sound absorption coefficient was 99% or more. In addition, a plurality of sound absorption peaks exist in a wide band from 3.5 kHz to 8.5 kHz, and a high sound absorption coefficient is shown in a wide band.

As described above, it is found that the soundproof structure of the invention can obtain a significantly great sound absorption coefficient in a high frequency region by performing the sound absorption using the high-order vibration mode. In addition, it is found that, a great sound absorbing effect over a wide band can be obtained, regardless of the resonance type soundproof structure using the membrane vibration, since the sound absorbing peaks are respectively shown at the frequencies corresponding to the plurality of high-order vibration modes.

Comparative Example 1

A soundproof structure was produced and evaluated in the same manner as in Example 1, except that the thickness of the membrane-like member was set as 250 μm, the inner diameter of the frame was set as 10 mm, and the thickness of the rear surface space was set as 20 mm.

20 donut-shaped (ring-shaped) plates having an inner diameter (diameter of the opening) of 10 mm and an outer diameter of 40 mm were produced, the outer diameters of the 20 donut-shaped plates and one circular plate were set to be identical and these were bonded to each other with a double-sided tape (GENBA NO CHIKARA manufactured by ASKUL Corporation) to produce a frame.

Figure 12:
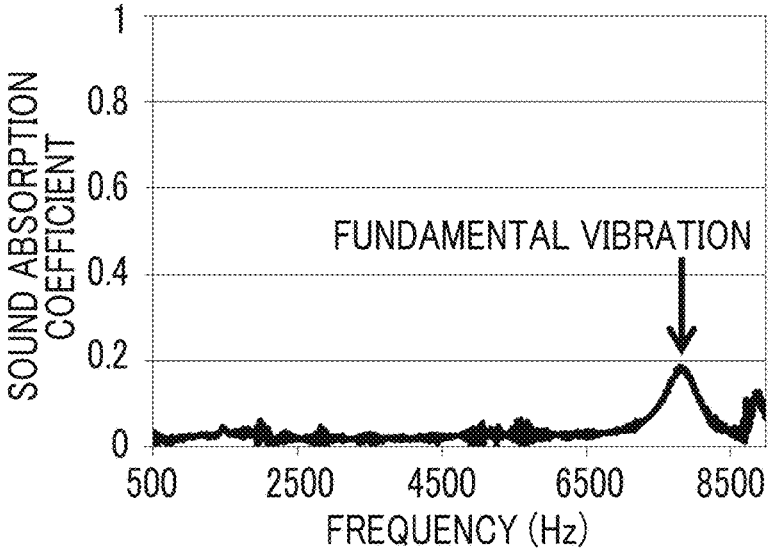
FIG. 12 is a graph showing a relationship between a frequency and a sound absorption coefficient.

FIG. 12 is a graph showing a relationship between the measured frequency and the sound absorption coefficient.

FIG. 12 shows that the frequency in the fundamental vibration mode is approximately 7.8 kHz. However, the maximum sound absorption coefficient thereof is less than 20%. That is, this indicates that, even at the resonance frequency, 80% or more of the sound is reflected and not reduced.

From the above results, it was also experimentally found that, in a design method in the related art of increasing the thickness of the membrane-like member to harden the membrane and increasing the frequency in the fundamental vibration mode, a sound was reflected in a high-frequency region, so that a high sound absorption coefficient was not obtained. Therefore, it was found that it was not suitable to perform soundproofing in a high frequency region using the fundamental vibration mode of the membrane vibration.

Example 2

A soundproof structure was produced and evaluated in the same manner as in Example 1, except that the thickness of the rear surface space was set as 2 mm.

2 donut-shaped (ring-shaped) plates having an inner diameter of 20 mm and an outer diameter of 40 mm were produced, the outer diameters of the 2 donut-shaped plates and one circular plate were set to be identical and these were bonded to each other with a double-sided tape (GENBA NO CHIKARA manufactured by ASKUL Corporation) to produce a frame.

Figure 13:
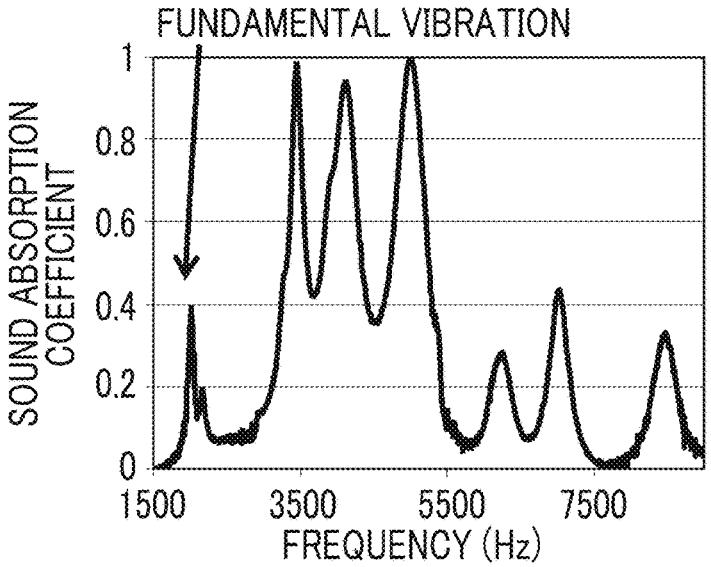
FIG. 13 is a graph showing a relationship between a frequency and a sound absorption coefficient.

FIG. 13 is a graph showing a relationship between the measured frequency and the sound absorption coefficient.

In Example 2, the thickness of the rear surface space is set to be greater than that in Example 1, and accordingly, the sound absorption peak in the high-order vibration mode appears on a lower frequency side than in Example 1. Three almost 100% sound absorption peaks could be obtained in the band of 3.5 kHz to 5.0 kHz. As described above, since a plurality of high-order vibration modes appear, a high sound absorption coefficient can be obtained in a wide band.

From the above results, it is found that the frequency of the sound absorption peak in the high-order vibration mode can be designed to a desired frequency by changing the thickness of the rear surface space.

Example 3

A soundproof structure was produced and evaluated in the same manner as in Example 1, except that the inner diameter of the frame was set as 10 mm.

One donut-shaped (ring-shaped) plate having an inner diameter of 10 mm and an outer diameter of 40 mm was produced, the outer diameters of the one donut-shaped plate and one circular plate were set to be identical and these were bonded to each other with a double-sided tape (GENBA NO CHIKARA manufactured by ASKUL Corporation) to produce a frame.

Figure 14:
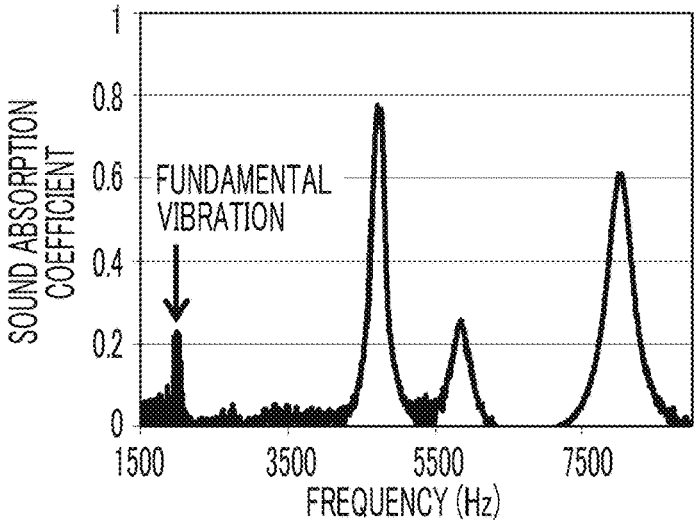
FIG. 14 is a graph showing a relationship between a frequency and a sound absorption coefficient.

FIG. 14 is a graph showing a relationship between the measured frequency and the sound absorption coefficient.

From FIG. 14, it is found that, the sound absorption frequency in the fundamental vibration mode is 2 kHz, but the sound absorption coefficient is approximately 20%, and the sound absorption coefficient of the sound absorption peak in the high-order vibration mode is higher. From FIG. 14, it is found that clear peak sound absorption due to the high-order vibration mode appears at 4.7 kHz and 8.0 kHz.

In Example 3, the frequency in the high-order vibration mode is sparser than that in Example 1, because the size of the frame, that is, the size of the region where the membrane-like member vibrates is reduced. That is, by changing the planar size of the region where the membrane-like member vibrates, the interval at which the high-order vibration mode exists can be controlled. The high-order vibration mode becomes sparser as the planar size of the region where the membrane-like member vibrates is smaller.

As described above, it is found that the frequency of the sound absorption peak in the high-order vibration mode and the sparseness thereof can be designed for a desired frequency by changing the vibration area of the membrane-like member.

Reference Example 1

A soundproof structure was produced and evaluated in the same manner as in Example 3, except that the thickness of the rear surface space was set as 20 mm.

20 donut-shaped (ring-shaped) plates having an inner diameter of 10 mm and an outer diameter of 40 mm were produced, the outer diameters of the 20 donut-shaped plates and one circular plate were set to be identical and these were bonded to each other with a double-sided tape (GENBA NO CHIKARA manufactured by ASKUL Corporation) to produce a frame.

Figure 15:
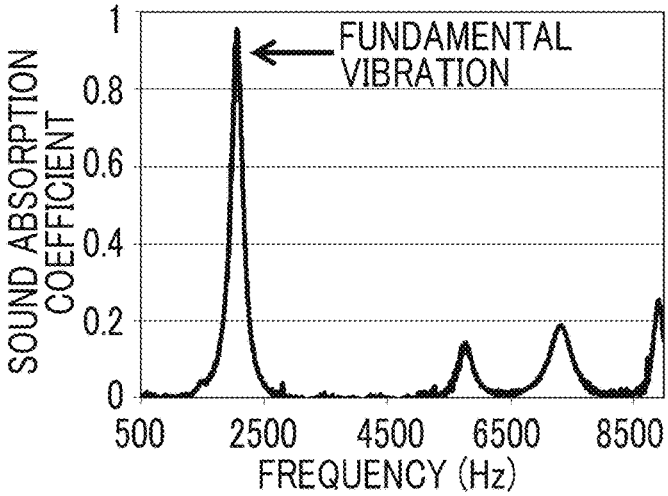
FIG. 15 is a graph showing a relationship between a frequency and a sound absorption coefficient.

FIG. 15 is a graph showing a relationship between the measured frequency and the sound absorption coefficient.

From FIG. 15, it is found that 90% or more of the sound absorption in the fundamental vibration mode occurs at 2 kHz. On the other hand, the sound absorption coefficient caused by the high-order vibration mode is much smaller than the sound absorption coefficient in the fundamental vibration mode.

Therefore, it is found that, even in a case where the configuration of the membrane-like member portion is the same, the high-order vibration mode is not necessarily excited, and in the example, a large sound absorption due to the high-order vibration mode occurs due to the interaction with the rear surface space.

Example 4

A soundproof structure was produced and evaluated in the same manner as in Example 1, except that the inner diameter of the frame was set as 15 mm.

One donut-shaped (ring-shaped) plate having an inner diameter of 15 mm and an outer diameter of 40 mm was produced, the outer diameters of the one donut-shaped plate and one circular plate were set to be identical and these were bonded to each other with a double-sided tape (GENBA NO CHIKARA manufactured by ASKUL Corporation) to produce a frame.

Figure 16:
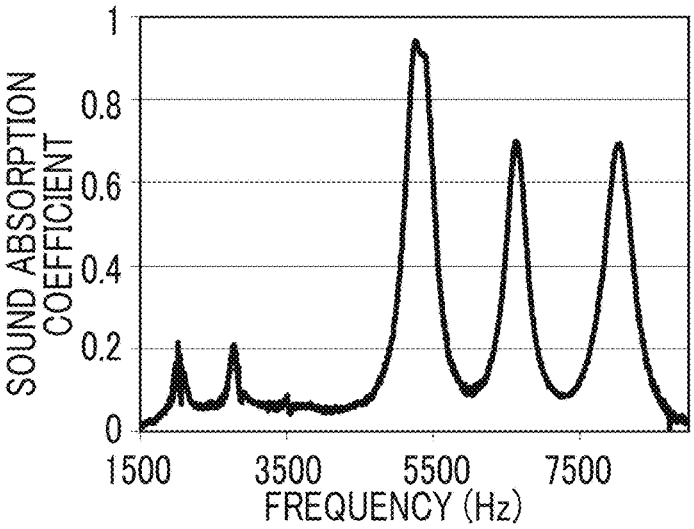
FIG. 16 is a graph showing a relationship between a frequency and a sound absorption coefficient.

FIG. 16 is a graph showing a relationship between the measured frequency and the sound absorption coefficient.

Example 5

A soundproof structure was produced and evaluated in the same manner as in Example 1, except that the inner shape of the frame was set as a square, the outer shape thereof was set as a circle having a diameter of 40 mm, a size of one side of the inner shape was set as 13.3 mm, and the shape of the vibrating portion of the membrane-like member was set as a square.

The area of the opening of this frame (13.3 mm×13.3 mm) is the same as that of the circular shape having a diameter of 15 mm in Example 4. That is, the frame diameter (equivalent circle diameter, size of the membrane vibrating part) is 15 mm.

Figure 17:
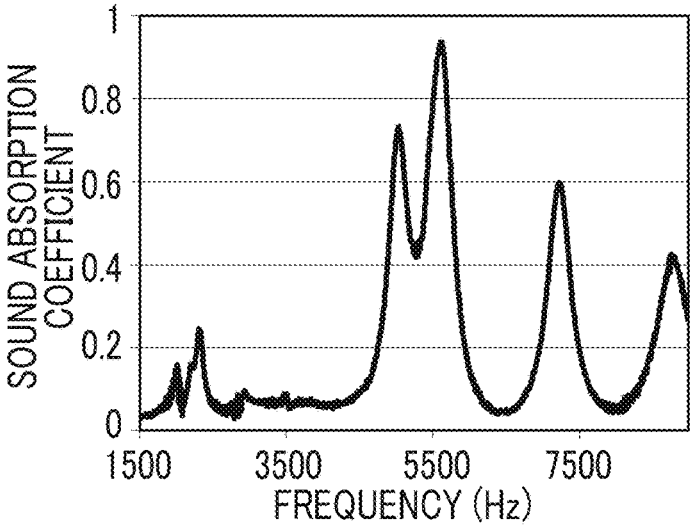
FIG. 17 is a graph showing a relationship between a frequency and a sound absorption coefficient.

FIG. 17 is a graph showing a relationship between the measured frequency and the sound absorption coefficient.

From FIGS. 16 and 17, it is found that a plurality of great sound absorption peaks due to the high-order vibration mode appear in both Example 4 and Example 5. In addition, it is found that, the higher the vibration mode is, the more the frequency in the high-order vibration mode is shifted between Example 4 and Example 5.

In Example 4 and Example 5, since the vibration area of the membrane-like member is the same, in a low-order vibration mode in which a shape of vibration is relatively simple, the influence near the edge of the membrane vibrating part is small, and the frequency in the vibration mode becomes closer. On the other hand, since the higher the vibration mode, the more complicated the vibration shape is generated on the membrane, the effect of the area of the opening of the frame, that is, not only the area where the membrane-like member can vibrate, but also the shape of the opening of the frame (corresponding to the edge of the membrane vibrating part) is easily received. Therefore, it is found that, as the vibration mode is high, the frequency in the vibration mode changes not only according to the area but also the shape of the opening of the frame.

From the above results, the soundproof structure of the invention using the high-order vibration mode not only exhibits a high sound absorption coefficient even at a high frequency, but can also perform sound absorption over a wide band by a plurality of high-order vibration modes, and perform the sound absorption at a plurality of frequencies at the same time. It is found that the frequency and band thereof can be controlled not only by the area of the membrane vibrating part (opening of the frame) but also by the shape of the membrane vibrating part (shape of the fixed end).

Table 5 shows the configurations of Examples 1 to 5, Comparative Example 1, and Reference Example 1, collectively.

TABLE 5

| | Membrane thickness μm | Size of membrane vibrating part mm | Thickness of rear surface space mm | Shape of opening |
|---|---|---|---|---|
| Example 1 | 50 | 20 | 1 | Circle |
| Comparative Example 1 | 250 | 10 | 20 | Circle |
| Example 2 | 50 | 20 | 2 | Circle |
| Example 3 | 50 | 10 | 1 | Circle |
| Example 4 | 50 | 15 | 1 | Circle |
| Example 5 | 50 | 15 | 1 | Square |
| | 50 | 20 | 20 | Circle |

[Simulation 1]

The effect of the porous sound absorbing body in the rear surface space was examined by a simulation performed using an acoustic module of the finite element method calculation software COMSOL ver.5.3 (COMSOL Inc.).

Using the porosity calculation of the COMSOL acoustic module, the effect of the porous sound absorbing body was incorporated into the calculation. This is a method for calculating the sound absorption coefficient of the porous sound absorbing body according to the Delany-Bazley equation.

In the calculation model of the soundproof structure 10, the frame 18 had a cylindrical shape as shown in FIG. 1 and an opening having a diameter of 20 mm. A thickness of the membrane-like member 16 was set as 50 μm, a Young's modulus thereof was 4.5 GPa which is a Young's modulus of a polyethylene terephthalate (PET) film, and a thickness of the rear surface space was set as 1 mm. The calculation model was a two-dimensional axially symmetric structure calculation model.

In such a calculation model, in order to set a model in that the rear surface space is filled with the porous sound absorbing body, each calculation was performed by setting the flow resistance in the rear surface space as 10,000 (Pa s/m$^2$), 20,000 (Pa s/m$^2$), and 50,000 (Pa s/m$^2$). These flow resistance values are typical values for ordinary sound absorbing glass wool and rock wool.

Figure 18:
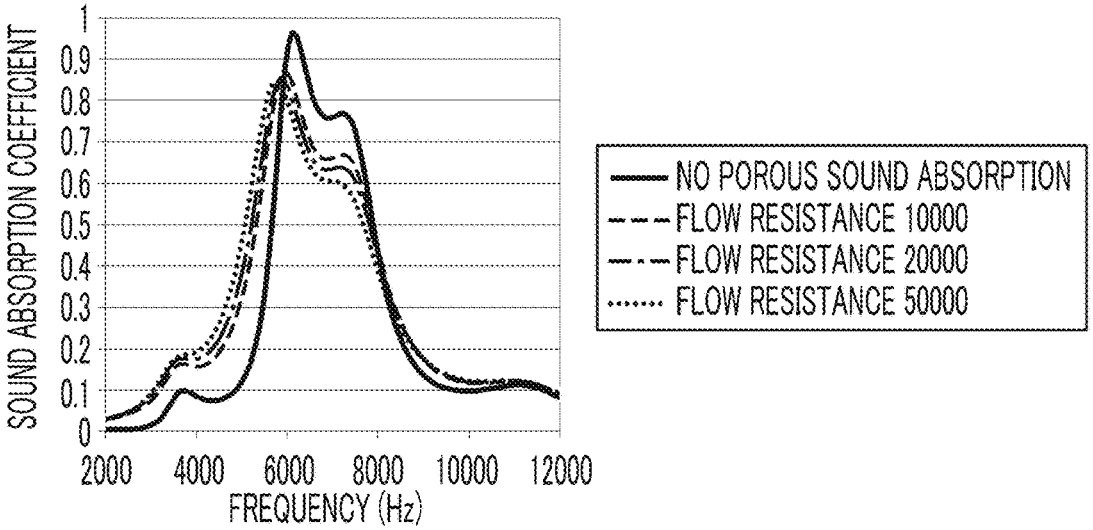
FIG. 18 is a graph showing a relationship between a frequency and a sound absorption coefficient.

FIG. 18 is a graph showing a relationship between the calculated frequency and the sound absorption coefficient, in addition to the configuration in a case where there is no porous sound absorbing body (the rear surface space has air flow resistance of 0 (Pa s/m$^2$)).

From FIG. 18, it is found that, by disposing the porous sound absorbing body in the rear surface space, the maximum value of the sound absorption coefficient can be reduced, but the band can be widened particularly on the low frequency side. As described above, it is found that, in a case where the band is important, the band can be widened by using the configuration in combination with the porous sound absorbing body.

[Simulation 2]

The effect of providing a through hole in the membrane-like member was examined by a simulation.

By applying the thermal viscous acoustic calculation of COMSOL to the through hole and performing the coupled calculation of the membrane vibration and the through hole transmission sound, the sound absorption effect in a case where the through hole was provided in the membrane-like member was calculated. Accordingly, it is possible to incorporate the sound absorbing effect due to the thermal viscous friction inside the through hole.

In the calculation model of the soundproof structure 10, the frame 18 had a cylindrical shape as shown in FIG. 1 and an opening having a diameter of 20 mm. A thickness of the membrane-like member 16 was set as 50 μm, a Young's modulus thereof was 4.5 GPa which is a Young's modulus of a polyethylene terephthalate (PET) film, and a thickness of the rear surface space was set as 1 mm. The calculation model was a two-dimensional axially symmetric structure calculation model.

In such a calculation model, the calculation was performed respectively in cases where the membrane-like member has a through hole having a diameter of 1 mm, 2 mm, 3 mm, and 4 mm in the center portion.

Figure 19:
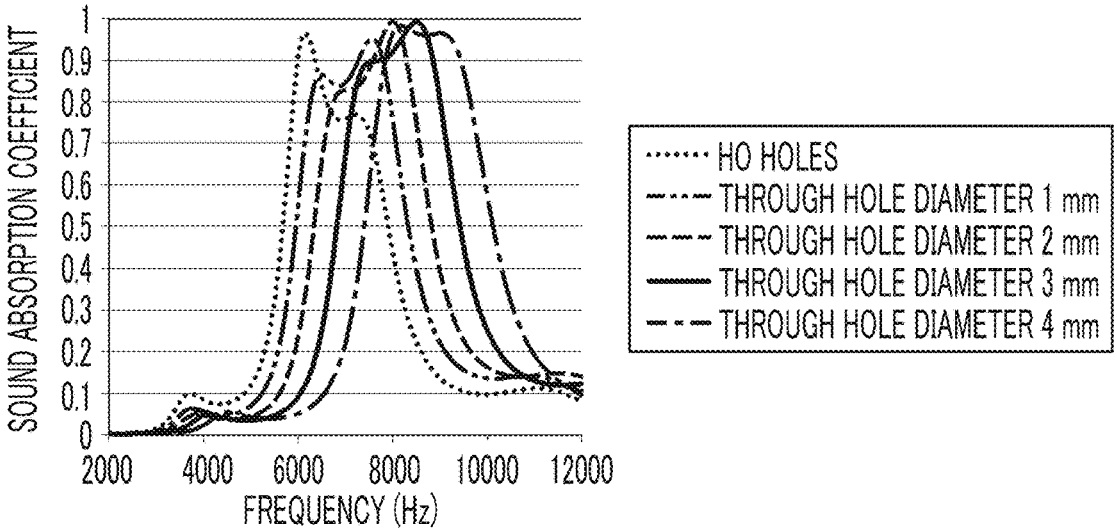
FIG. 19 is a graph showing a relationship between a frequency and a sound absorption coefficient.

FIG. 19 is a graph showing a relationship between the calculated frequency and the sound absorption coefficient, in addition to the configuration in a case where there is no through hole.

From FIG. 19, it is found that the presence of the through hole increases the frequency in the high-order vibration mode. The greater the diameter of the through hole, the higher the frequency.

In a case where the through hole is formed in the membrane-like member, a sound propagating through the air in the through hole is generated, in addition to the transmitted sound due to the membrane vibration. This changes the acoustic impedance of the membrane surface. That is, the membrane-like member can be used as a parallel equivalent circuit of the membrane vibration sound and the air propagation sound in the through hole. In addition, the mass of the membrane itself is reduced by providing the through hole, which also increases the resonance frequency. It is considered that the resonance frequency changed due to these.

Therefore, it is found that the formation of the through hole in the membrane-like member allows the frequency of the sound absorption peak in the high-order vibration mode to be designed to a desired frequency.

[Simulation 3]

Generally, the Young's modulus of a metal membrane and an inorganic membrane is larger than that of an organic membrane. The case where a metal membrane was used as the material of the membrane-like member was examined using a simulation.

Specifically, modeling was performed by setting the Young's modulus of the membrane-like member as 69 GPa which is the Young's modulus of aluminum, the thickness of the membrane-like member as 10 μm, and the diameter of the opening of the frame as 10 mm. The calculations were performed by setting the thickness of the rear surface space as 0.5 mm, 1 mm, 2 mm, and 3 mm, respectively.

Figure 20:
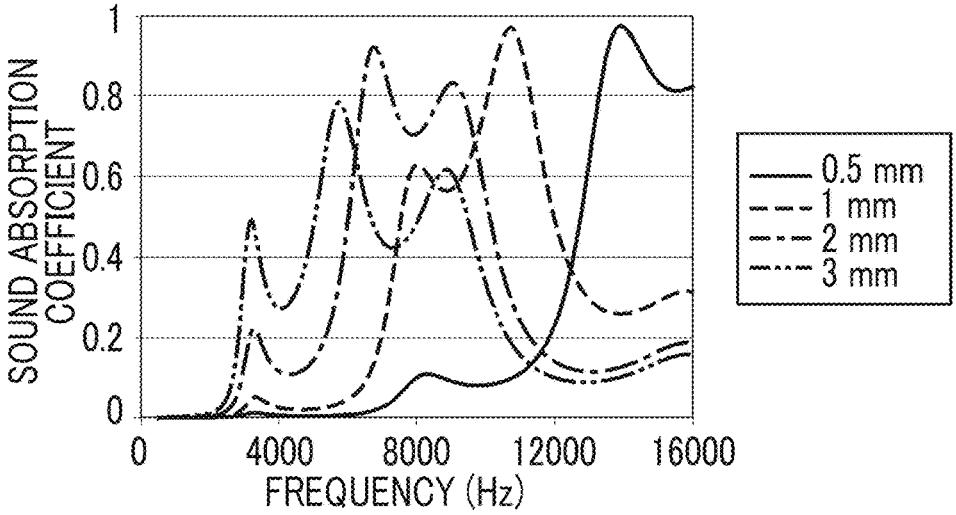
FIG. 20 is a graph showing a relationship between a frequency and a sound absorption coefficient.

FIG. 20 is a graph showing a relationship between the calculated frequency and the sound absorption coefficient.

From FIG. 20, it is found that, even in a case where a material having a high Young's modulus (aluminum) is used as the material of the membrane-like member, the sound absorption coefficient at the frequency corresponding to the high-order vibration mode on a higher frequency side is higher than the sound absorption coefficient at 2.9 kHz corresponding to the fundamental vibration mode. In addition, it is found that, as the thickness of the rear surface space decreases, the absorption coefficient becomes maximum at a frequency corresponding to a higher-order vibration mode.

A simulation was performed in the same manner as in a case of aluminum, except that the Young's modulus of the membrane-like member was set to 117 GPa which is the Young's modulus of copper. The calculations were performed by setting the thickness of the rear surface space as 0.5 mm, 1 mm, 2 mm, and 3 mm, respectively.

Figure 21:
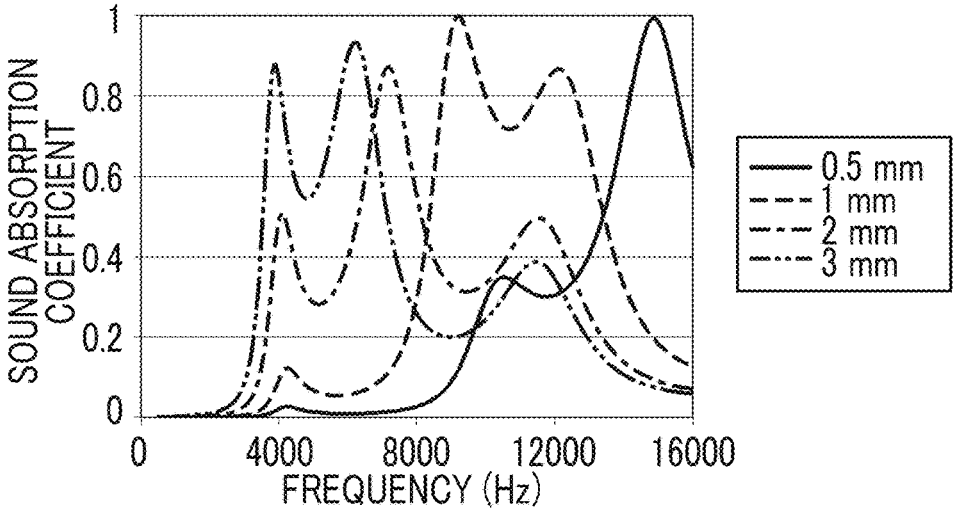
FIG. 21 is a graph showing a relationship between a frequency and a sound absorption coefficient.

FIG. 21 is a graph showing a relationship between the calculated frequency and the sound absorption coefficient.

From FIG. 21, it is found that, even in a case where a material having a higher Young's modulus (copper) is used as the material of the membrane-like member, the sound absorption coefficient becomes maximum at the frequency corresponding to the high-order vibration mode.

From the above results, it is found that, even in a case where a material having a high Young's modulus (aluminum, copper) is used as the material of the membrane-like member, the peak of the sound absorption coefficient shifts to a high frequency side by decreasing the thickness of the rear surface space, in the same manner as in a case of using a material having a low Young's modulus (PET film).

Therefore, it is found that, even in a case where a metal material having higher durability against heat or the like is used, a sound at the high frequency side can be absorbed by the high-order vibration mode with the configuration of the soundproof structure of the invention.

[Simulation 4]

The frame 18 had a cylindrical shape and an opening having a diameter of 20 mm. In addition, the rear surface plate had a Young's modulus of an acrylic plate (3 GPa) and a thickness of 2 mm. A thickness of the membrane-like member 16 was set as 50 μm, a Young's modulus thereof was 4.5 GPa which is a Young's modulus of a polyethylene terephthalate (PET) film, and a thickness of the rear surface space was set as 2 mm.

In such a calculation model, simulations were performed for a case without a through hole in the rear surface plate, a case with a through hole having a diameter of 1 mm at the center of the rear surface plate, and a case with a through hole having a diameter of 2 mm at the center of the rear surface plate, respectively, and sound absorption coefficients were calculated.

Figure 41:
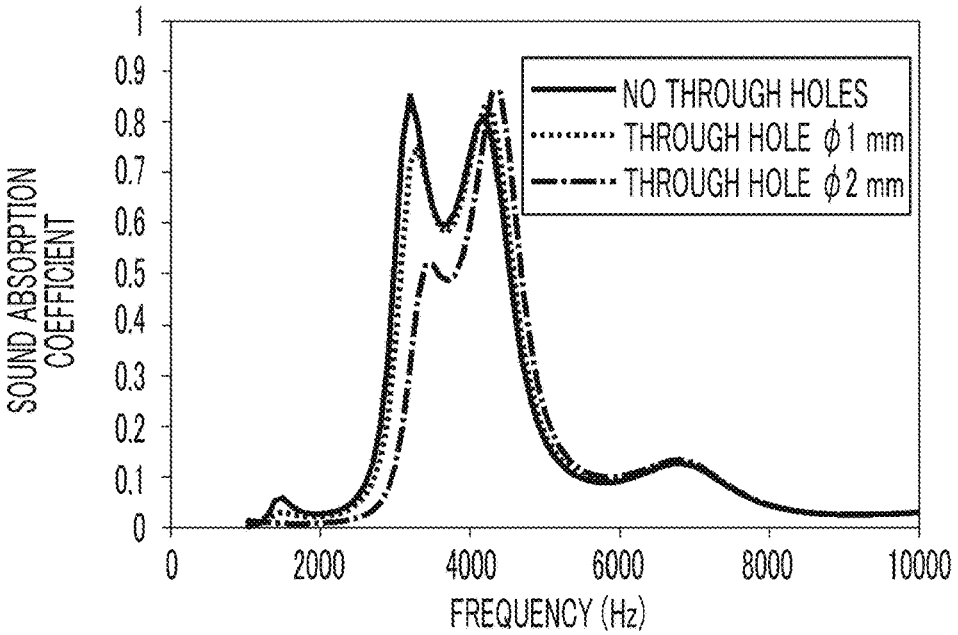
FIG. 41 is a graph showing a relationship between a frequency and a sound absorption coefficient.

The results thereof are shown in FIG. 41.

From FIG. 41, it is found that, in a case where the diameter of the through hole formed in the rear surface plate is 1 mm, a change in the spectrum is small, compared to the case without the through hole, and a high sound absorption coefficient can be maintained. In addition, it is found that, even in a case where the diameter of the through hole is 2 mm, the sound absorption coefficient is large on a high frequency side. Such a result is obtained since a sound at a high frequency hardly passes through the through holes.

From the above results, it is found that, a soundproof structure having a high sound absorption coefficient can be obtained, even in a case where the through hole is formed in the rear surface plate.

[Simulation 5]

The thickness of the rear surface space was set as 3 mm, the rear surface plate was set as a PET film (Young's modulus of 4.5 GPa), and the simulations were performed by setting the thickness of the rear surface plate as 200 μm, 500 μm, and 1000 μm, respectively, and sound absorption coefficients were calculated.

Figure 42:
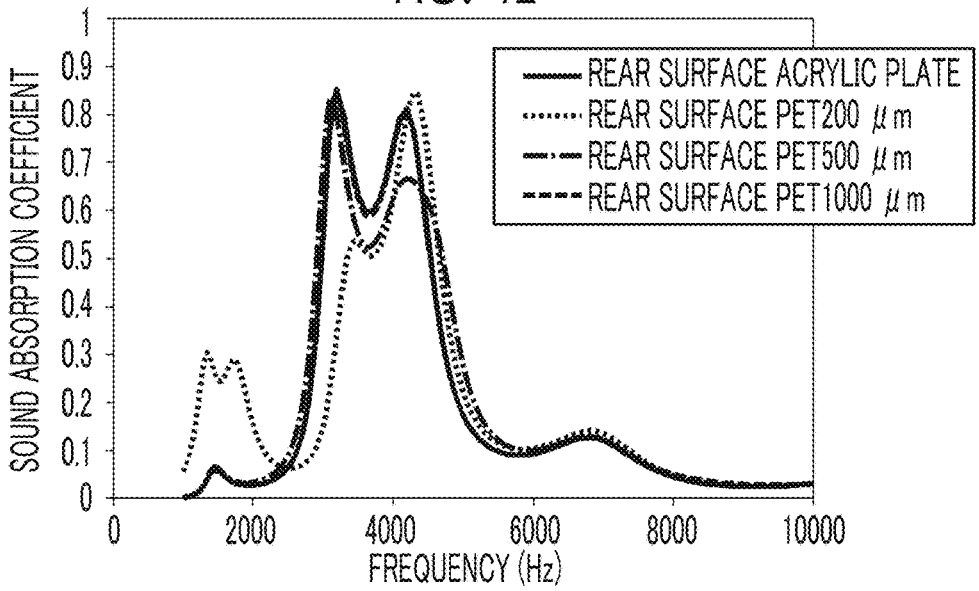
FIG. 42 is a graph showing a relationship between a frequency and a sound absorption coefficient.

The results thereof are shown in FIG. 42.

From FIG. 42, it is found that, in a case where the rear surface plate is a PET film having a thickness of 1,000 μm, there is substantially no change in spectrum, compared to a case of an acrylic plate having a thickness of 2 mm. Meanwhile, it is found that, in a case where the thickness is smaller, the spectrum shape is different, but a high sound absorption coefficient is shown near the sound absorption frequency in a case where the rear surface plate is an acrylic plate having a thickness of 2 mm.

In the same manner as described above, the rear surface plate was set as an aluminum plate (Young's modulus of 69 GPa), and simulations were performed by setting thickness as 100 μm, 200 μm, and 500 μm, respectively, and the sound absorption coefficients were calculated.

Figure 43:
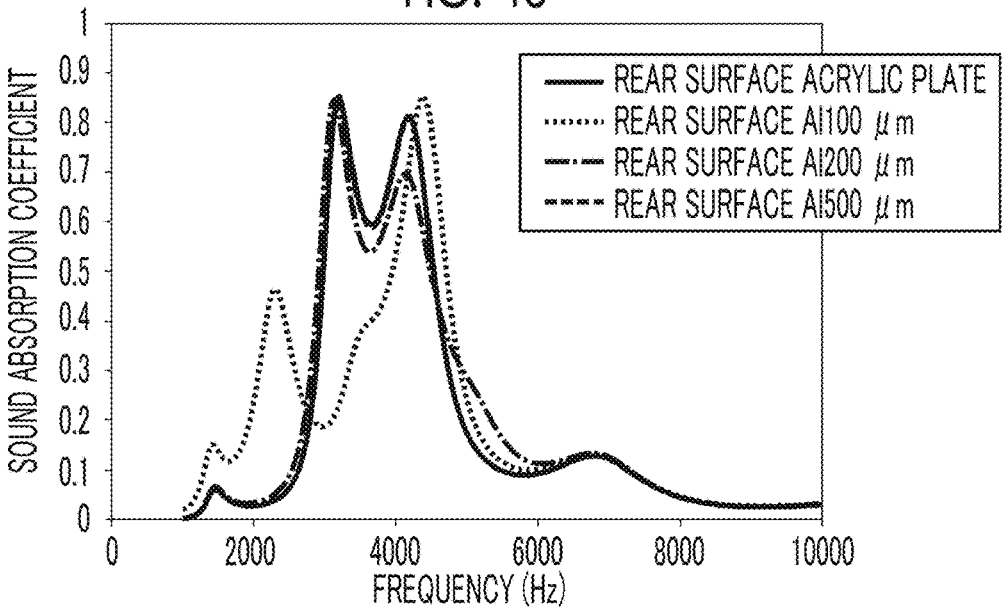
FIG. 43 is a graph showing a relationship between a frequency and a sound absorption coefficient.

The results thereof are shown in FIG. 43.

From FIG. 43, it is found that, since the aluminum plate is harder than the PET film, even in a case where the thickness is 500 μm, the sound absorbing properties that are almost the same as in a case where the rear surface plate is an acrylic plate having a thickness of 2 mm are exhibited. In addition, it is found that, in a case where the thickness is smaller, the spectrum shape is different, but a high sound absorption coefficient is shown near the sound absorption frequency in a case where the rear surface plate is an acrylic plate having a thickness of 2 mm.

[Simulation 6]

In order to enhance the absorption in the high-order vibration mode, the combination of membrane vibration resonance and air column resonance in the high-order vibration mode was examined. Accordingly, absorption with a structure in which a rear surface is not closed was examined.

First, the sound absorbing properties of the simple membrane vibration were examined.

A soundproof structure in which the size of the opening of the frame was set as 20 mm×20 mm, the frame width was set as 2 mm, the thickness was set as 1 mm, and the membrane-like member was set as a PET film having a thickness of 50 μm, and the membrane-like member was fixed to the opening of the frame was produced.

The transmittance and reflectivity of the produced soundproof structure were measured, and the absorption coefficient was obtained. At this time, in a tube structure such as a duct or a sleeve, the soundproof structure was disposed approximately at the center of an acoustic tube having a rectangular cross section of 40 mm×24 mm so that the inside of the tube structure has an opening without being closed, assuming that wind or heat passes through a part thereof. That is, the soundproof structure was disposed in the acoustic room so that openings having a width of 9 mm were formed on both sides of the soundproof structure.

As a result, in addition to the fundamental vibration mode at 1,300 Hz, absorption caused by a high-order vibration mode centered at 3,200 Hz was also observed. In Simulation 6, the examination was performed by focusing on the high-order vibration mode at 3,200 Hz.

Next, modelling of a structure in which the thickness of the frame was changed from 1 mm to 50 mm in increments of 1 mm was performed, and the absorption coefficient and transmittance were calculated by focusing on 3,200 Hz which is the frequency of the membrane vibration, respectively. That is, the absorption coefficient and the transmissivity were calculated by changing a length of the cylindrical structure formed by the frame and the membrane-like member.

Figure 44:
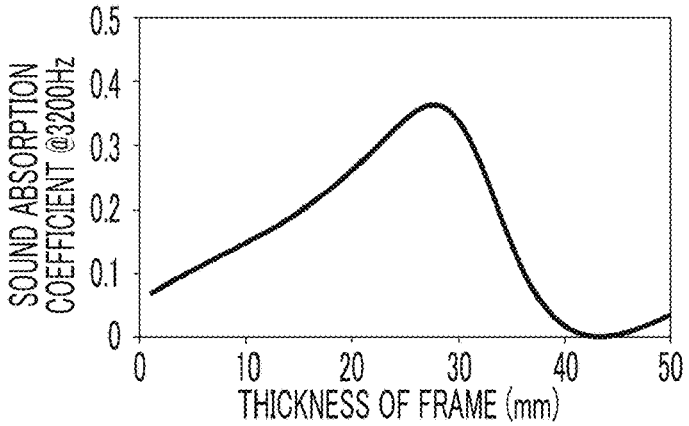
FIG. 44 is a graph showing a relationship between a thickness of a frame and an absorption coefficient.
Figure 45:
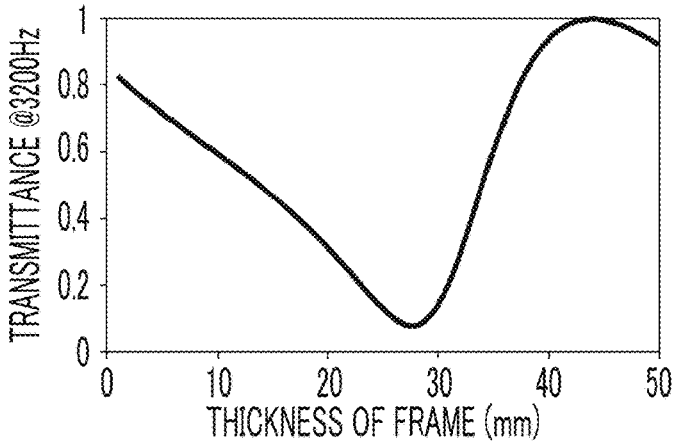
FIG. 45 is a graph showing a relationship between a thickness of a frame and a transmittance.

The results are shown in FIG. 44 and FIG. 45.

From FIGS. 44 and 45, it is found that, the absorption coefficient changes by changing the cylinder length (the thickness of the frame). FIG. 44 shows that the absorption rate is maximized in a case where the cylinder length is 28 mm.

Meanwhile, $\lambda_a/4$ corresponding to the frequency of 3,200 Hz is 27 mm, and it is found that the absorption coefficient is maximized in a case of coinciding with this $\lambda_a/4$. At this time, the frequency in the high-order vibration mode of the membrane vibration coincides with the frequency of the air column resonance formed on the rear surface in a case where the membrane-like member is assumed to be a rigid body. Therefore, it is found that, in a case where the frequency in the high-order vibration mode of the membrane vibration coincides with the frequency of the air column resonance, the absorption in the high-order vibration mode can be maximized.

Example 6

From the result of the simulation 6, a soundproof structure having a thickness of the frame, that is, a tube length of 28 mm, 25 mm, 30 mm, and 50 mm was produced, and under the same conditions as in the simulation 6, the transmittance and reflectivity were measured by a four-microphone method using an acoustic tube having a rectangular cross-section of 40 mm×24 mm. The transmittance and the reflectivity were obtained, and the absorption coefficient was obtained therefrom.

Figure 46:
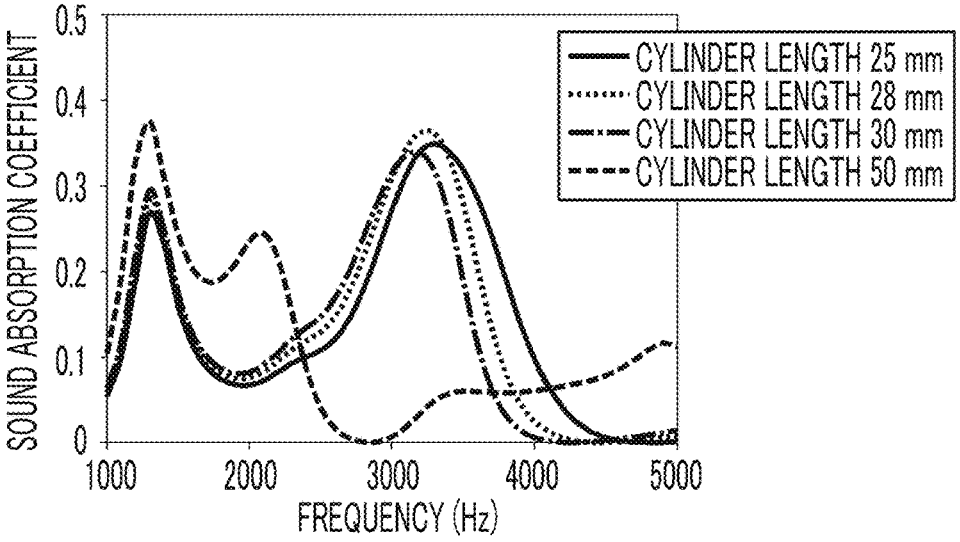
FIG. 46 is a graph showing a relationship between a frequency and a sound absorption coefficient.

FIG. 46 shows each absorption spectrum. In FIG. 46, for example, a case where the cylinder length is 28 mm is indicated as a cylinder 28 mm.

From FIG. 46, it is found that, in a case where the cylinder length is 28 mm, large absorption can be obtained near 3,200 Hz which is the frequency in the high-order vibration mode of the membrane vibration. On the other hand, in a case where the cylinder length is 50 mm, the absorption in the high-order vibration mode is not significantly obtained, since the frequency of the air column resonance and the frequency of the membrane vibration are shifted.

From the above, it is found that, by matching the frequency in the high-order vibration mode of the membrane vibration with the resonance frequency of the air column resonance, the absorption in the high-order vibration mode can be increased.

Example 7

With respect to the structure having a square vibrating part having a side of 13.3 mm in Example 5, an examination was performed in which a cut was formed by making a cut using a cutter knife on the membrane surface near the fixed end thereof.

A structure in which a cut was made in one side (Example 7-1) and a structure in which cuts was made in two opposing sides (Example 7-2) were produced, and the sound absorption coefficient was measured in the same manner as in Example 5.

Figure 47:
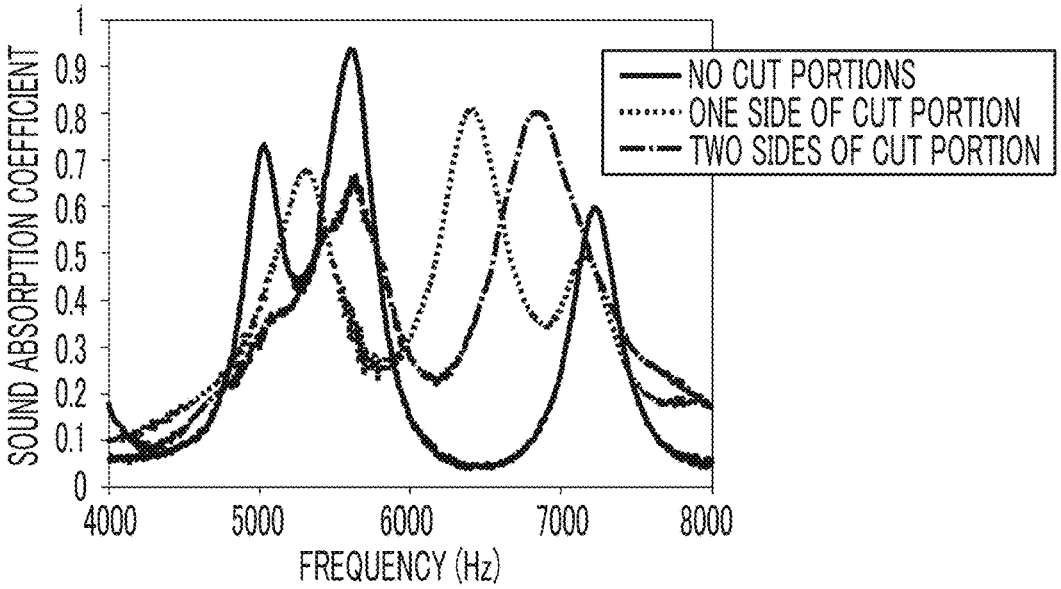
FIG. 47 is a graph showing a relationship between a frequency and a sound absorption coefficient.

The results thereof are shown in FIG. 47.

As can be seen from FIG. 47, in Example 5, the sound absorption coefficient fell around 6,000 to 7,000 Hz, and there was a region where the sound absorption coefficient became less than 10%. In contrast, in Example 7-1 and Example 7-2, by making cuts in the membrane-like member to form a cut portion, the sound absorption peak shifts and broadens, and there is no region where the sound absorption coefficient is significantly reduced, and the sound absorption coefficient of 20% or more was shown in a range of 6,000 to 7,000 Hz. In addition, in the high-frequency region of 7,500 Hz or higher, the base of sound absorption was widened, and the high sound absorption coefficient was widened to high frequencies.

In this manner, the cut formed in the membrane-like member (particularly at the end) has an effect of broadening the sound absorption.

Example 8

A soundproof structure was produced and evaluated in the same manner as in Example 1, except that the rear surface distance was changed to 4 mm.

Figure 48:
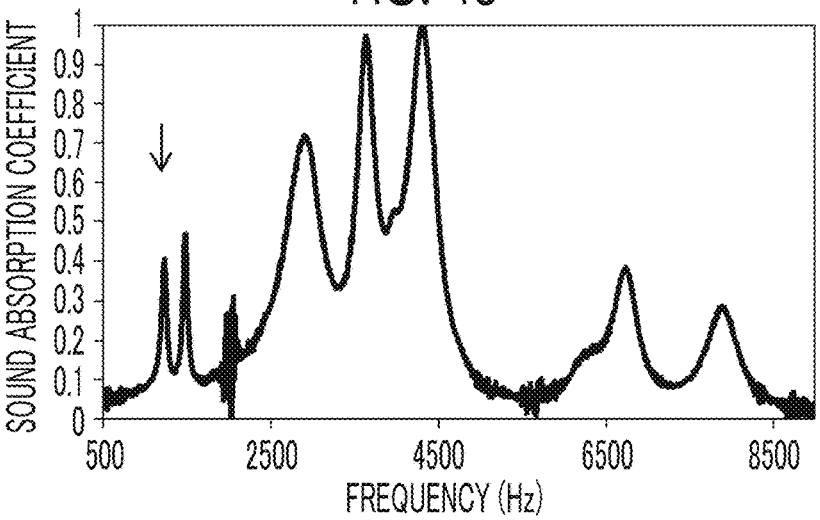
FIG. 48 is a graph showing a relationship between a frequency and a sound absorption coefficient.
Figure 49:
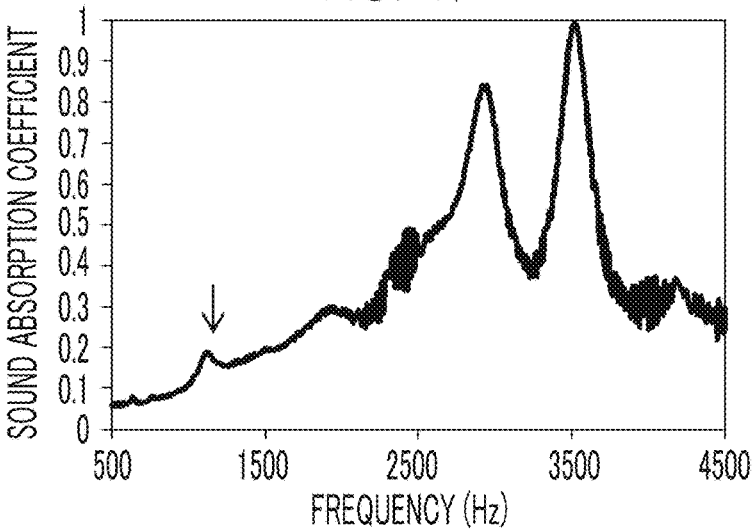
FIG. 49 is a graph showing a relationship between a frequency and a sound absorption coefficient.
Figure 50:
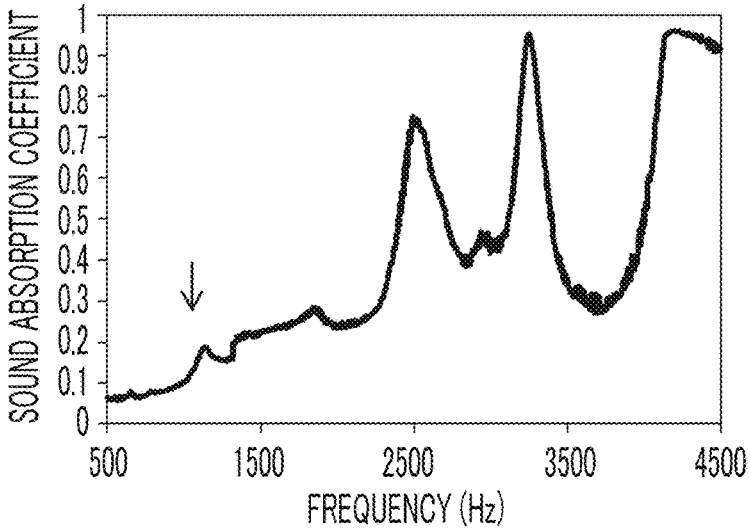
FIG. 50 is a graph showing a relationship between a frequency and a sound absorption coefficient.
Figure 51:
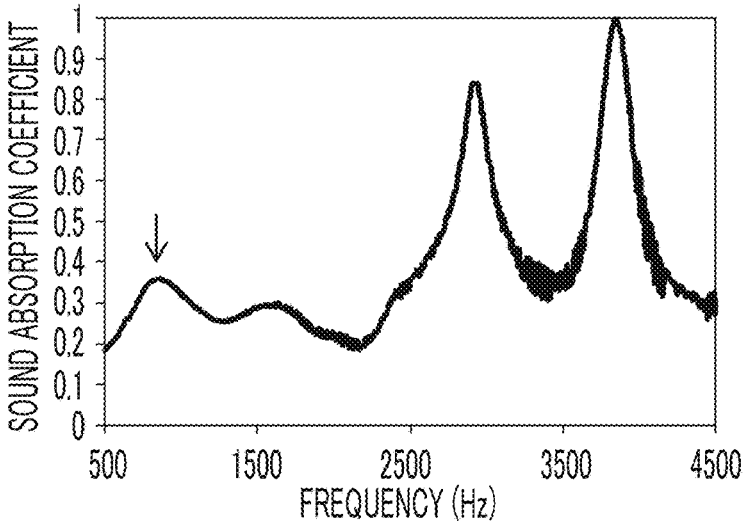
FIG. 51 is a graph showing a relationship between a frequency and a sound absorption coefficient.
Figure 52:
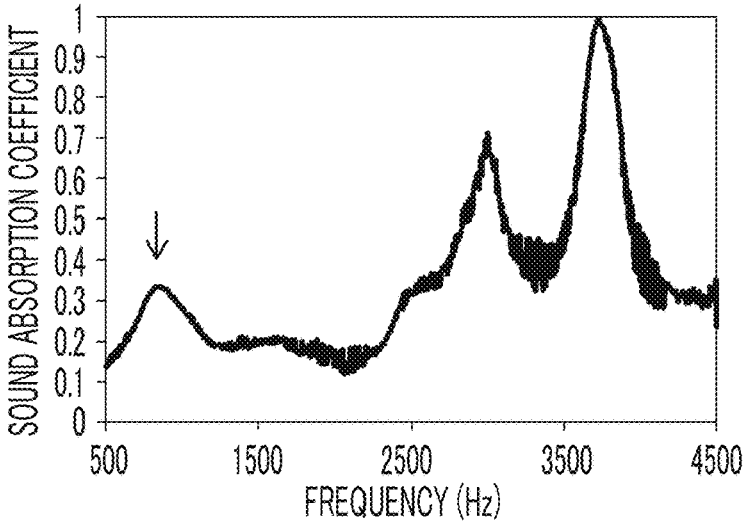
FIG. 52 is a graph showing a relationship between a frequency and a sound absorption coefficient.
Figure 53:
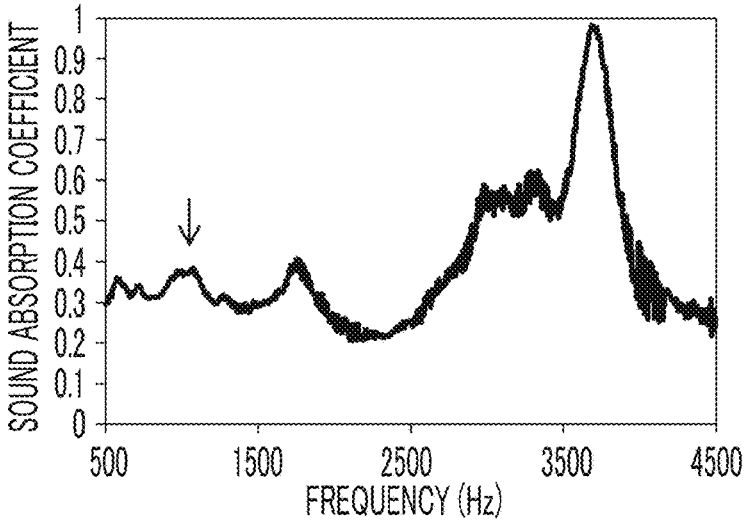
FIG. 53 is a graph showing a relationship between a frequency and a sound absorption coefficient.
Figure 54:
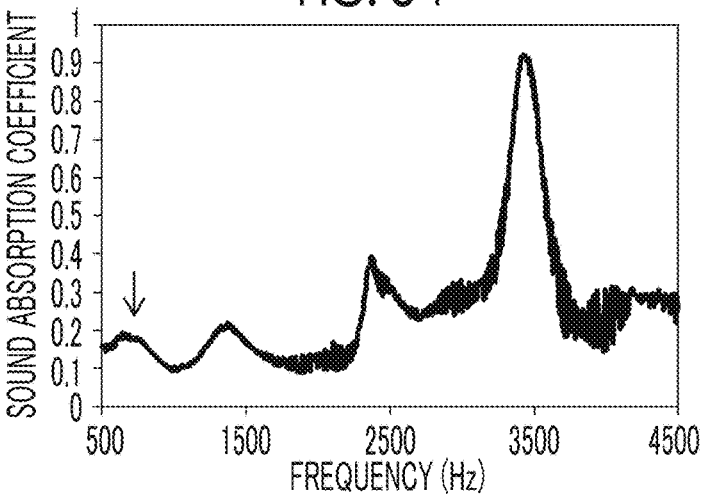
FIG. 54 is a graph showing a relationship between a frequency and a sound absorption coefficient.

The results thereof are shown in FIG. 48.

From FIG. 48, it is found that the sound absorption in the high-order vibration mode is higher than the sound absorption coefficient in the fundamental vibration mode.

Examples 9 to 14

A soundproof structure was produced and evaluated in the same manner as in Example 5, except that the rear surface distance was set as 3 mm, the size of the opening of the frame was changed from 18 mm×18 mm (equivalent circle diameter of 20 mm) to 23 mm×23 mm (equivalent circle diameter of 26 mm) in increments of 1 mm. In addition, an acoustic tube having a diameter of 40 mm was used in the measurement. With an acoustic tube having a diameter of 40 mm, the sound absorption coefficient can be measured up to a frequency near 4 kHz.

The results thereof are shown in FIGS. 49 to 54, respectively.

From FIGS. 49 to 54, it is found that the sound absorption coefficient in the high-order vibration mode is higher than the sound absorption coefficient in the fundamental vibration mode. In addition, as the size of the opening (frame diameter) is larger, even in a case where the same membrane is used, the area of the vibrating part of the membrane increases, and accordingly, the membrane as a structure tends to vibrate. For this reason, even in a case where the same membrane is used, the vibration mode having a sound absorption peak shifts to a higher order side, as the size of the opening increases. That is, in a case where the size of the opening changes, a value of Φ on the right side changes in the relational expression $E\times t^3$ (Pa·m$^3$)≤$21.6\times d^{-1.25}\times\Phi^{4.15}$ of the hardness of the membrane-like member (Pa·m$^3$), the rear surface distance d (m), and the frame diameter Φ (m). From FIG. 49 to FIG. 54, it was found that, in this region, in a case where the size of the opening is changed, in a case where the opening is large, the sound absorption increases in the quaternary vibration mode, since the membrane easily vibrates, and in a case where the opening is small, the sound absorption increases in the tertiary vibration mode, since the membrane hardly vibrates. That is, in a case where the size of the opening changes, the sound absorption peak frequency does not change uniformly. It is found that, since a shift in the vibration mode in which the sound is absorbed occurs, there is no large change in the sound absorption peak frequency.

Examples 15 and 16

A soundproof structure was produced and evaluated in the same manner as in Example 1, except that the thickness of the membrane-like member was set as an aluminum foil having a thickness of 10 μm (model number 3-2153-03 manufactured by AS ONE Corporation), and the rear surface distances were set as 2 mm and 5 mm, respectively. An acoustic tube having a diameter of 20 mm was used in the measurement.

Figure 55:
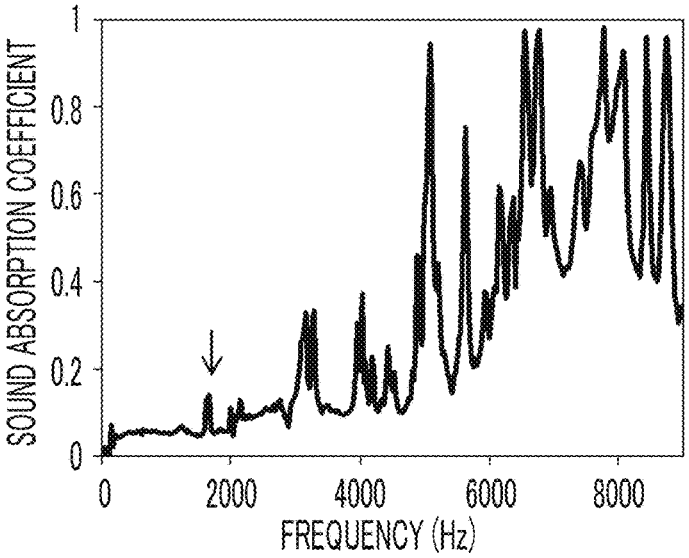
FIG. 55 is a graph showing a relationship between a frequency and a sound absorption coefficient.
Figure 56:
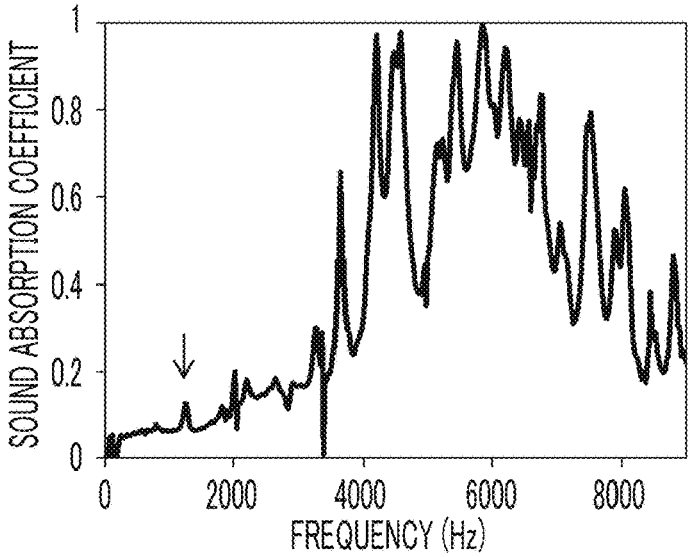
FIG. 56 is a graph showing a relationship between a frequency and a sound absorption coefficient.

The results are shown in FIG. 55 and FIG. 56.

Example 17

A soundproof structure was produced and evaluated in the same manner as in Example 15, except that the membrane-like member was set as an aluminum foil having a thickness of 12 μm (Mitsubishi foil manufactured by Mitsubishi Aluminum Co., Ltd.) and the rear surface distance was set as 3 mm.

Figure 57:
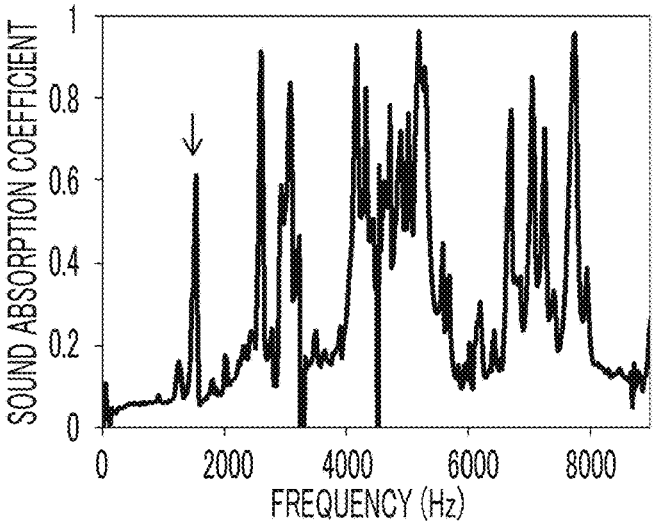
FIG. 57 is a graph showing a relationship between a frequency and a sound absorption coefficient.

The results thereof are shown in FIG. 57.

Example 18

A soundproof structure was produced and evaluated in the same manner as in Example 15, except that the membrane-like member was set as an aluminum foil having a thickness of 25 μm (My foil manufactured by Sumitomo Aluminum Foil Co., Ltd.) and the rear surface distance was set as 2 mm.

Figure 58:
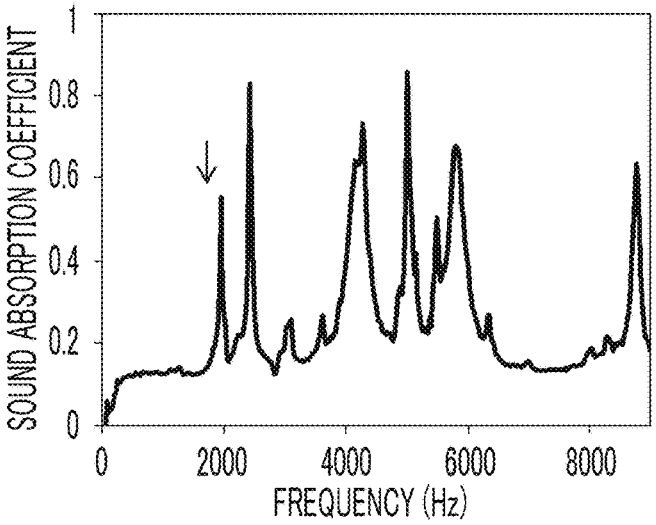
FIG. 58 is a graph showing a relationship between a frequency and a sound absorption coefficient.

The results thereof are shown in FIG. 58.

From FIGS. 55 to 58, it is found that, even in a case where aluminum foil is used as the membrane-like member, the sound absorption coefficient in the high-order vibration mode is higher than the sound absorption coefficient in the fundamental vibration mode. In addition, it is found that a commercially available aluminum foil can be used.

Example 19

A soundproof structure was produced and evaluated in the same manner as in Example 15, except that the membrane-like member was set as a copper foil having a thickness of 10 μm (Model No. 3-2349-01 manufactured by AS ONE Corporation) and the rear surface distance was set as 2 mm.

Figure 59:
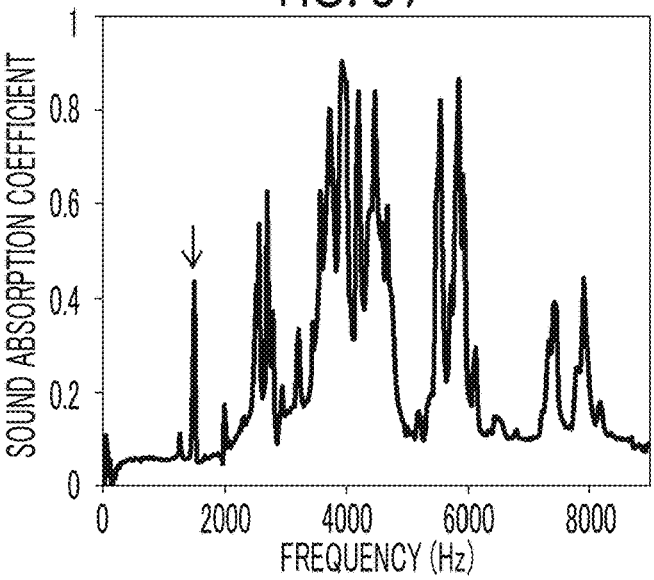
FIG. 59 is a graph showing a relationship between a frequency and a sound absorption coefficient.

The results thereof are shown in FIG. 59.

From FIG. 59, it is found that, even in a case where copper foil is used as the membrane-like member, the sound absorption coefficient in the high-order vibration mode is higher than the sound absorption coefficient in the fundamental vibration mode.

Example 20

A soundproof structure was produced and evaluated in the same manner as in Example 15, except that the membrane-like member was set as a stainless steel foil having a thickness of 5 μm (SUS304, manufactured by AS ONE Corporation, model number 3-2157-02) and the rear surface distance was set as 5 mm.

Figure 60:
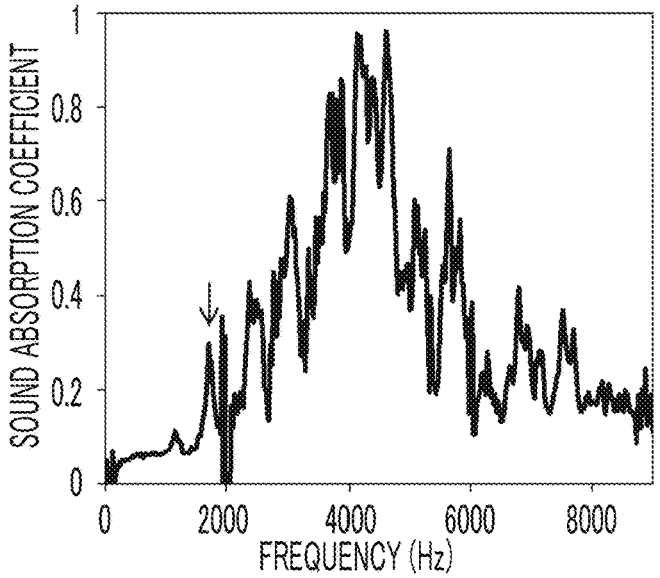
FIG. 60 is a graph showing a relationship between a frequency and a sound absorption coefficient.

The results thereof are shown in FIG. 60.

From FIG. 60, it is found that, even in a case where stainless steel foil is used as the membrane-like member, the sound absorption coefficient in the high-order vibration mode is higher than the sound absorption coefficient in the fundamental vibration mode.

As described above, from FIGS. 15 to 20, it was found that, even in a case where metal foil is used as the membrane-like member, the sound absorption coefficient in the high-order vibration mode can be higher than the sound absorption coefficient in the fundamental vibration mode.

Next, a configuration in which a through hole was formed in the membrane-like member was examined.

Example 21

A soundproof structure was produced and evaluated in the same manner as in Example 1, except that the rear surface distance was set as 3 mm.

Figure 61:
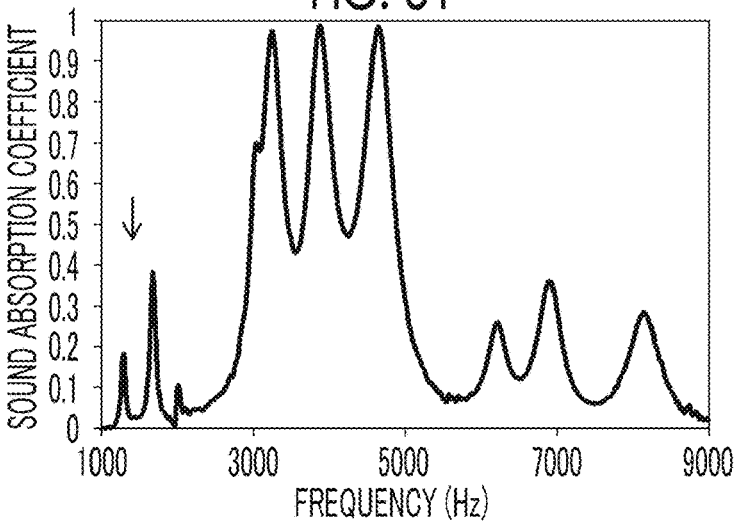
FIG. 61 is a graph showing a relationship between a frequency and a sound absorption coefficient.

The results thereof are shown in FIG. 61.

Examples 22 and 23

A soundproof structure was produced and evaluated in the same manner as in Example 21, except that a through hole was formed at the center of the membrane-like member using a punch. The diameters of the through holes are 2 mm and 4 mm, respectively.

Figure 62:
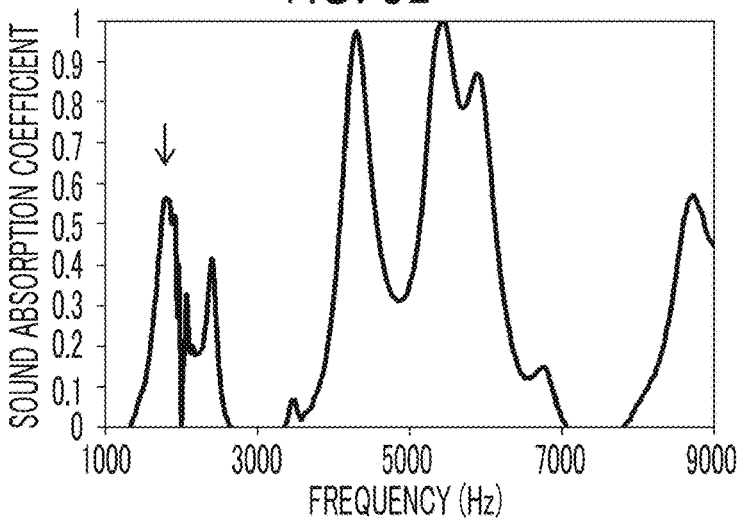
FIG. 62 is a graph showing a relationship between a frequency and a sound absorption coefficient.
Figure 63:
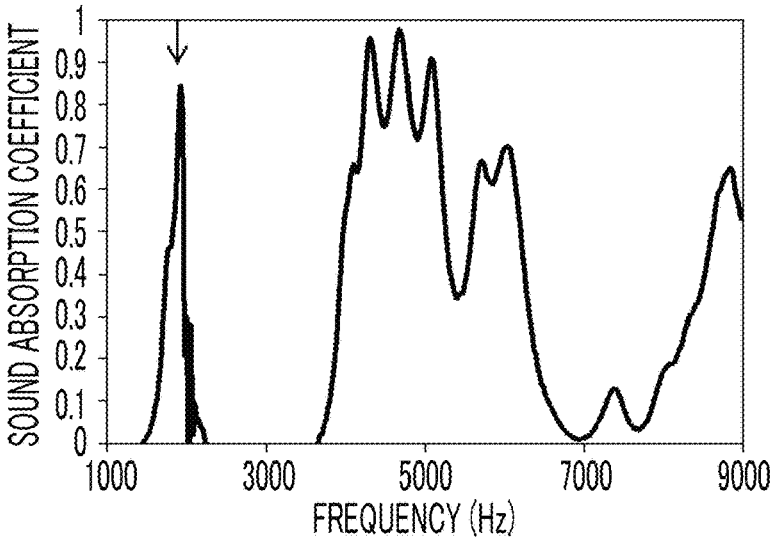
FIG. 63 is a graph showing a relationship between a frequency and a sound absorption coefficient.

The results thereof are shown in FIGS. 62 and 63.

From FIGS. 61 to 63, it is found that, in Examples 21 to 23, the sound absorption coefficient in the high-order vibration mode is higher than the sound absorption coefficient in the fundamental vibration mode. In addition, from the comparison between Example 21, Example 22, and Example 23, it is found that, even in a case where the through hole is formed in the membrane-like member, the sound absorption by the membrane vibration is sufficiently functioned. Further, it is found that, in the structure in which the through hole is formed in the membrane-like member, the sound absorption in the high-order vibration mode is shifted to a high frequency side, compared to the soundproof structure without the through hole. In addition, it was found that, the sound absorption coefficient in the fundamental vibration mode was increased by forming the through holes.

Therefore, by using a membrane-like member having a through hole formed therein, it is clear that it is possible to obtain soundproof structure having a compact structure with a small rear surface distance, which exhibits a great sound absorbing effect even at a low frequency side near the frequency in the fundamental vibration mode, and shows a high sound absorption coefficient at the frequency in the high-order vibration mode on the high frequency side.

Example 24

A soundproof structure was produced and evaluated in the same manner as in Example 5, except that the membrane-like member was set as a PET film having a thickness of 100 μm, the size of the opening of the frame was set as 30 mm×30 mm (equivalent diameter of 34 mm), and the rear surface distance was 5 mm, and the measurement was performed in the same manner as in Example 1, by using an acoustic tube having a diameter of 40 mm.

Figure 66:
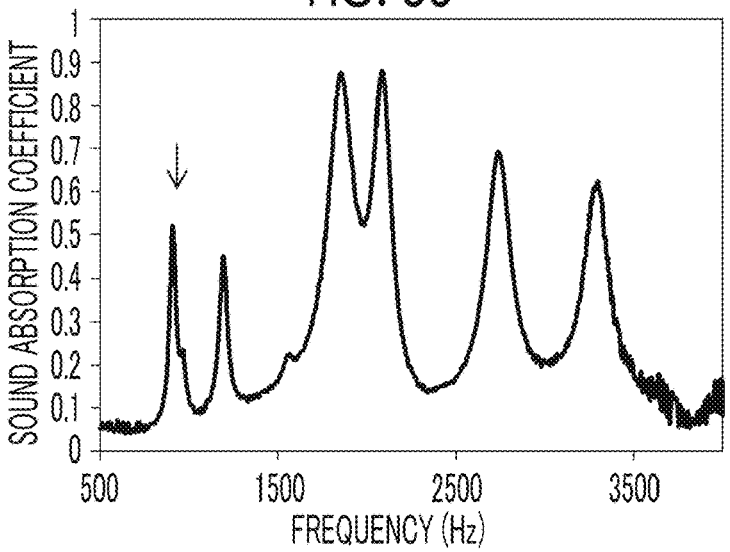
FIG. 66 is a graph showing a relationship between a frequency and a sound absorption coefficient.

The results thereof are shown in FIG. 66.

From FIG. 66, it is found that, even in Example 24, the sound absorption coefficient in the high-order vibration mode is higher than the sound absorption coefficient in the fundamental vibration mode. The peak frequencies of the sound absorption coefficient are 1.86 kHz and 2.08 kHz, and a higher sound absorption coefficient is obtained on a low frequency side, compared to the other examples of the invention.

As described above, a sound at a frequency near 2 kHz can also be absorbed by sound absorption in the high-order vibration mode.

Example 25

A soundproof structure was produced and evaluated in the same manner as in Example 1, except that the membrane-like member was set as a biaxially stretched polypropylene membrane having a thickness of 50 μm (OPP, manufactured by Futamura Chemical Co., Ltd., FOS), the size of the opening of the frame was set as 18 mm in terms of diameter, and the rear surface distance was set as 3 mm, and the measurement was performed in the same manner as in Example 1, by using an acoustic tube having a diameter of 20 mm.

Figure 67:
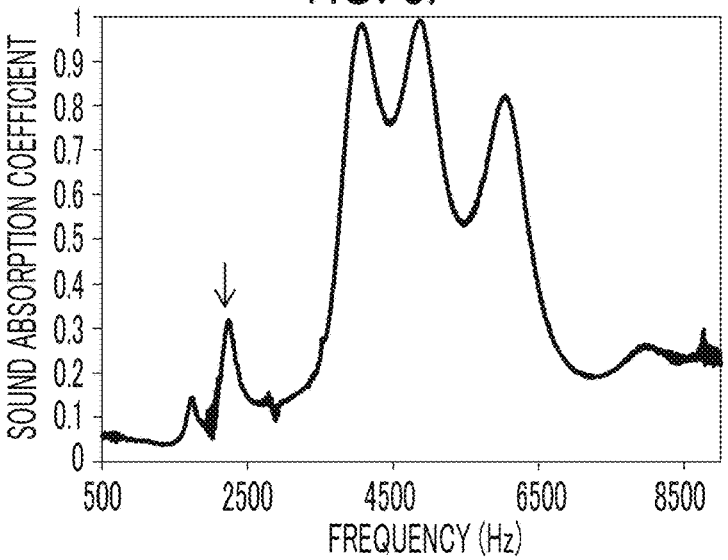
FIG. 67 is a graph showing a relationship between a frequency and a sound absorption coefficient.

The results thereof are shown in FIG. 67.

From FIG. 67, it is found that, even in Example 25, the sound absorption coefficient in the high-order vibration mode is higher than the sound absorption coefficient in the fundamental vibration mode, and a sound is absorbed in a wide band.

Since the OPP film is a film formed by biaxial stretching, the Young's modulus differs in the direction perpendicular to the flow direction of the film. The OPP film used in Example 25 had the Young's modulus in a flow direction (MD) of 1.7 GPa and the Young's modulus in a vertical direction (TD) of 3.4 GPa. As described above, it was found that, there is a phenomenon in which the sound absorption coefficient in the high-order vibration mode increases, even in a case where the Young's modulus differs for each direction.

Table 6 shows the results of the examples, the comparative examples, and the reference example, collectively. Table 6 shows the material, Young's modulus, thickness, and hardness (Young's modulus×thickness$^3$) of the membrane-like member, the thickness of the frame (rear surface distance), the equivalent circle diameter of the opening (frame diameter), the shape of the opening, the value on the right side of the relational expression $E \times t^3$ $(Pa \cdot m^3) \leq 21.6 \times d^{-1.25} \times \Phi^{4.15}$, and whether or not the relational expression is satisfied (appropriateness). As can be seen from Table 6, in all of the examples of the invention, the relational expression is satisfied, and accordingly, a soundproof structure in which the sound absorption coefficient at the frequency of the high-order vibration mode is higher than the sound absorption coefficient at the frequency in the fundamental vibration mode is obtained.

Example 26

In the same configuration as in Example 21, a foamed PP sheet (Sumicella having thickness of 3 mm, Model No. 3030090, manufactured by Sumika Plustech Co., Ltd.) was used instead of acryl as the frame material. This structure is a closed cell foam structure. The areal density of this material is 900 g/m$^2$, which is approximately ¼ of the weight of acryl. This foamed PP sheet was processed into a frame having an inner diameter of 20 mm using a laser cutter, and a soundproof structure having a thickness of a PET film of 50 μm and a rear surface distance of 3 mm was produced in the same manner as in Example 21.

The measurement was performed in the same manner as in Example 21 using the acoustic tube. As a result, the same sound absorption spectrum as in Example 21 was obtained. As described above, a foamed structure can be used as a frame material.

obliquely incident noise. To show this, the obliquely incident sound absorption coefficient was measured using an acoustic tube.

Figure 71:
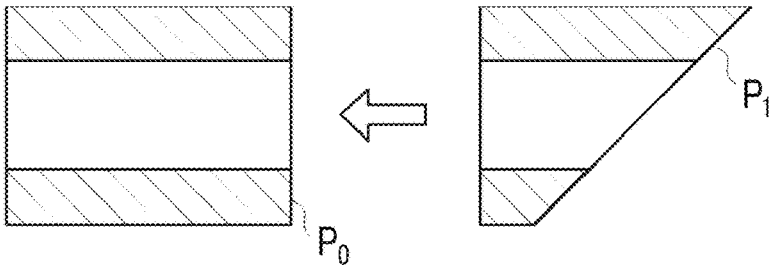
FIG. 71 is a schematic cross-sectional view for describing a shape of an acoustic tube used in the example.

As an attachment to be attached to the end of the acoustic tube, a cylindrical acoustic tube tip $P_1$ having one opening end inclined as shown in FIG. 71 was produced and attached to the end of the acoustic tube $P_0$.

In acoustic tube measurement, the upper limit of the frequency at which only a plane wave can exist is determined by a system without a tube, and measurement is performed in that range. For a tube having a diameter of 2 cm, the upper limit is approximately 9 kHz. This upper limit of the frequency (cutoff frequency) can be measured by extracting only the plane wave component (tube direction component), even in a case where the reflected sound from the terminal end is an oblique sound. Therefore, by disposing the acoustic tube tip $P_1$ having an oblique opening end as described above, the reflectivity for oblique incidence can be measured. From this, a sound absorption coefficient for oblique incidence can be measured.

In this measurement, the acoustic tube tips $P_1$ were produced in which the angle of the opening end was 15°, 30°, 45°, and 60° with respect to a plane perpendicular to the central axis of the acoustic tube $P_0$, and the measurement was performed.

In the soundproof structure, the frame was made of acryl in which the inner diameter was set as 19 mm, the rear surface distance was set as 3 mm, and the membrane-like member was set as a PET film having a thickness of 50 μm.

TABLE 6

| | Membrane-like member | | | | | Frame | | | Relationship expression | |
|---|---|---|---|---|---|---|---|---|---|---|
| | Material | Young's modulus Pa | Thickness m | Hardness Pa · m$^3$ | Through hole diameter mm | Rear surface distance | Frame diameter | Shape of opening | Diameter | appropriateness |
| Example 1 | PET | 4.50E+09 | 5.00E−05 | 5.63E−04 | — | 0.001 | 0.02 | Circle | 1.08E−02 | OK |
| Comparative Example 1 | PET | 4.50E+09 | 2.50E−04 | 7.03E−02 | — | 0.02 | 0.01 | Circle | 6.09E−04 | NG |
| Example 2 | PET | 4.50E+09 | 5.00E−05 | 5.63E−04 | — | 0.002 | 0.02 | Circle | 4.54E−03 | OK |
| Example 3 | PET | 4.50E+09 | 5.00E−05 | 5.63E−04 | — | 0.001 | 0.01 | Circle | 6.09E−04 | OK |
| Reference Example 1 | PET | 4.50E+09 | 5.00E−05 | 5.63E−04 | — | 0.02 | 0.01 | Circle | 1.44E.05 | NG |
| Example 4 | PET | 4.50E+09 | 5.00E−05 | 5.63E−04 | — | 0.001 | 0.015 | Circle | 3.28E−03 | OK |
| Example 5 | PET | 4.50E+09 | 5.00E−05 | 5.63E−04 | — | 0.001 | 0.015 | Square | 3.28E−03 | OK |
| Example 8 | PET | 4.50E+09 | 5.00E−05 | 5.63E−04 | — | 0.004 | 0.02 | Circle | 1.91E−03 | OK |
| Example 9 | PET | 4.50E+09 | 5.00E−05 | 5.63E−04 | — | 0.003 | 0.02 | Square | 2.92E−03 | OK |
| Example 10 | PET | 4.50E+09 | 5.00E−05 | 5.63E−04 | — | 0.003 | 0.021 | Square | 3.65E−03 | OK |
| Example n | PET | 4.50E+09 | 5.00E−05 | 5.63E−04 | — | 0.003 | 0.023 | Square | 4.52E−03 | OK |
| Example 12 | PET | 4.50E+09 | 5.00E−05 | 5.63E−04 | — | 0.003 | 0.024 | Square | 5.53E−03 | OK |
| Example 13 | PET | 4.50E+09 | 5.00E−05 | 5.63E−04 | — | 0.003 | 0.025 | Square | 6.71E−03 | OK |
| Example 14 | PET | 4.50E+09 | 5.00E−05 | 5.63E−04 | — | 0.003 | 0.026 | Square | 8.07E−03 | OK |
| Example 15 | Al | 6.90E+10 | 1.00E−05 | 6.90E−05 | — | 0.002 | 0.02 | Circle | 4.54E−03 | OK |
| Example 16 | Al | 6.90E+10 | 1.00E−05 | 6.90E−05 | — | 0.005 | 0.02 | Circle | 1.45E−03 | OK |
| Example 17 | Al | 6.90E+10 | 1.20E−05 | 1.19E−04 | — | 0.003 | 0.02 | Circle | 2.74E−03 | OK |
| Example 18 | Al | 6.90E+10 | 2.50E−05 | 1.08E−03 | — | 0.003 | 0.02 | Circle | 2.74E−03 | OK |
| Example 19 | Copper | 1.17E+11 | 1.00E−05 | 1.17E−04 | — | 0.002 | 0.02 | Circle | 4.54E−03 | OK |
| Example 20 | SUS304 | 1.97E+11 | 5.00E−06 | 2.46E−05 | — | 0.005 | 0.02 | Circle | 1.45E−03 | OK |
| Example 21 | PET | 4.50E+09 | 5.00E−05 | 5.63E−04 | — | 0.003 | 0.02 | Circle | 2.74E−03 | OK |
| Example 22 | PET | 4.50E+09 | 5.00E−05 | 5.63E−04 | 2 | 0.003 | 0.02 | Circle | 2.74E−03 | OK |
| Example 23 | PET | 4.50E+09 | 5.00E−05 | 5.63E−04 | 4 | 0.003 | 0.02 | Circle | 2.74E−03 | OK |
| Example 24 | PET | 4.50E+09 | 1.00E−04 | 4.50E−03 | — | 0.005 | 0.034 | Square | 1.28E−02 | OK |
| Example 25 | OPP | 2.25E+09 | 5.00E−05 | 2.81E−04 | — | 0.003 | 0.018 | Circle | 1.77E−03 | OK |

Example 27

The soundproof structure of the invention can exhibit not only the noise reduction for the vertically incident noise, but also the peak noise reduction for general noise including This soundproof structure has a structure in which the angle of the opening end is 0°, that is, in a case of normal incidence, the sound absorption peak is near 4 kHz.

Sound absorption coefficients were measured three times with respect to the angle of each opening end, and an average was calculated. The results thereof are shown in FIG. 72.

Figure 72:
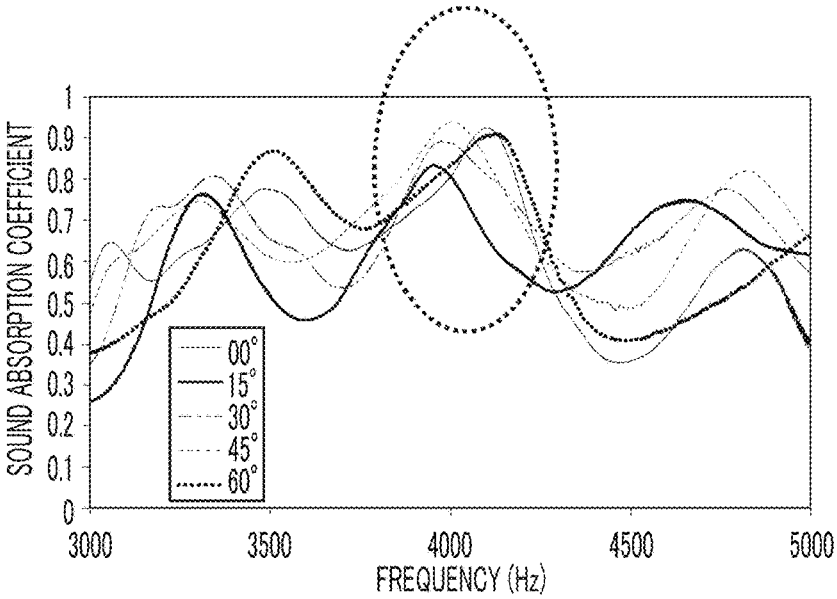
FIG. 72 is a graph showing a relationship between a frequency and a sound absorption coefficient.

FIG. 72 shows the results near the resonance frequency. It is found that, the portion surrounded by a broken-line circle is the maximum sound absorption coefficient peak, a difference in peak frequency is within 100 Hz and hardly changes from the case where the angle is 0 degree (normal incidence) to the case where the angle is 60°, and a high sound absorption coefficient of 80% or more is shown.

As described above, it is found that the soundproof structure of the invention exhibits a high peak sound absorption coefficient not only for normal incident sound but also for obliquely incident sound.

In addition, it is found that, even at oblique incidence, the sound absorption coefficient in the high-order vibration mode is higher than the sound absorption coefficient in the fundamental vibration mode.

[Simulation 7]

In order to confirm the effect of the soundproof structure on the obliquely incident sound in the invention from a viewpoint of the simulation, a simulation in a case of oblique incidence was performed using COMSOL. The oblique incidence of the sound wave was implemented by setting the incidence angle at the plane wave radiation boundary as the incident condition and setting the side wall to the periodic condition (Floquet Boundary).

In the calculation model of the soundproof structure, the frame was set as a square frame of 20 mm×20 mm, and the rear surface distance was set as 3 mm. The membrane-like member was made of PET and had a thickness of 50 μm.

The simulation was performed by changing the incidence angle of the sound wave to the surface of the membrane-like member of the soundproof structure from 0° to 80° in increments of 10°. The results thereof are shown in FIG. 73.

Figure 73:
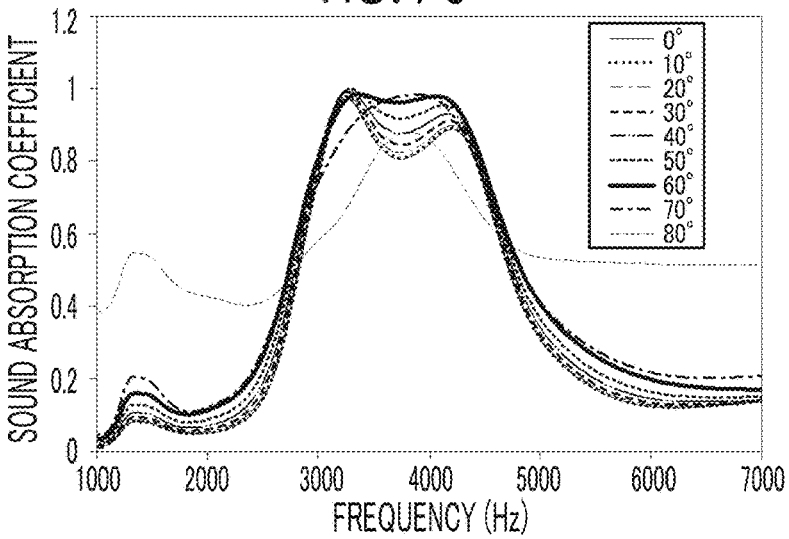
FIG. 73 is a graph showing a relationship between a frequency and a sound absorption coefficient.

From FIG. 73, it is found that, at any angle from 0° to 80°, the sound absorption coefficient in the high-order vibration mode at 3,000 Hz to 4,000 Hz is higher than the sound absorption coefficient in the fundamental vibration mode near 1,500 Hz.

Figure 74:
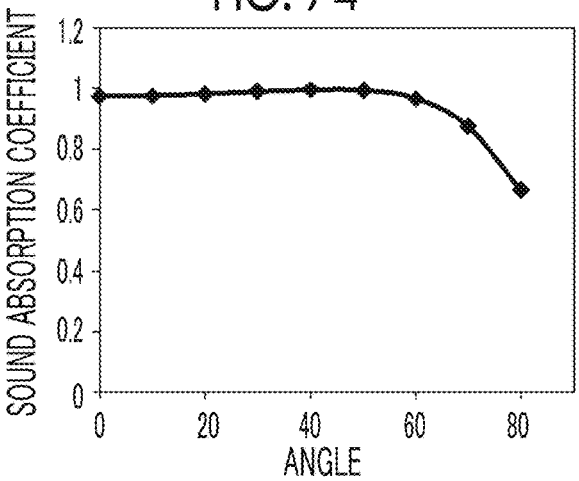
FIG. 74 is a graph showing a relationship between an angle and a sound absorption coefficient.

In particular, at an incidence angle from 10° to 60°, substantially no shift in the sound absorption peak frequency is observed, and it is found that the sound absorption in the same band of frequencies can be achieved at normal incidence and oblique incidence. FIG. 74 shows the sound absorption coefficient at 3,250 Hz for each incidence angle as an example. It was found that, a high sound absorption coefficient could be maintained, even in a case where the angle was changed from normal incidence(0°) to 60°.

As described above, as a result of measurement of the sound absorbing properties of the sound obliquely incident to both the experiment and the simulation, the soundproof structure of the invention functioned not only for the vertically incident sound, but also for the obliquely incident sound.

Such characteristics show that a specific sound can be strongly reduced, even in a case where random incident sound absorption occurs, such as in a case where the sound source and the soundproof structure are both placed in a wide space.

Example 28

As a membrane-like member, a polyimide film having a thickness of 50 μm (upilex S manufactured by Ube Industries, Ltd., coefficient of linear expansion of 16 ppm/K) was cut into a circular shape having an outer diameter of 40 mm, and a 1-mm through hole was provided at the center. A steel material (SS400, coefficient of linear expansion of 11.6 ppm/K) was used and cut with machining center to have the same shape as described in Example 25 (rear surface distance of 3 mm, size of the opening of the frame of 18 mm) to produce the frame. A soundproof structure was produced by bonding a membrane-like member (polyimide film) to the opening side of the produced frame with a double-sided tape (467MP manufactured by 3M), and the sound absorption coefficient was measured in the same manner as in Example 1, by using an acoustic tube having a diameter of 20 mm.

In addition, after heating the obtained soundproof structure in a constant-temperature oven controlled at 120° C. for 30 minutes, the soundproof structure was allowed to cool to room temperature, and the same measurement was performed.

As a result of the evaluation, a strong sound absorption peak was observed near 2,670 Hz before and after heating, and no clear difference was confirmed in the sound absorption behavior.

Example 29

A soundproof structure was produced in the same manner as in Example 28, except that an EPDM film having a thickness of 100 μm (EB81NNK, manufactured by Kureha Elastomer Co., Ltd., coefficient of linear expansion of 225 ppm/K) was used and an EPDM material (coefficient of linear expansion of 225 ppm/K) was used as the frame, and the sound absorption coefficient was measured in the same manner as in Example 1 using an acoustic tube having a diameter of 20 mm.

As a result of the evaluation, a strong sound absorption peak was observed near 3,750 Hz before and after heating, and no clear difference was confirmed in the sound absorption behavior.

From the above, it is clear that the effect of the invention is obtained.

EXPLANATION OF REFERENCES

10: soundproof structure
16, 16*a* to 16*f*: membrane-like member
17: through hole
18, 30*a* to 30*d*: frame
19: opening surface
20: opening
24, 24*a* to 24*c*: rear surface space
26, 26*a*, 26*b*: porous sound absorbing body

What is claimed is:

1. A soundproof structure comprising:

at least one membrane-like member, a support which supports the membrane-like member so as to perform membrane vibration, wherein a rear surface space is formed on one surface side of the membrane-like member, and a sound is absorbed due to vibration of the membrane-like member, the support is a frame having an opening with a bottom surface, the membrane-like member is fixed to an opening surface of the frame where the opening is formed, and the rear surface space is a space surrounded by the frame and the membrane-like member, in a case where a Young's modulus of the membrane-like member is set as E (Pa), a thickness of the membrane-like member is set as t (m), a thickness of the rear surface space is set as d (m), and an equivalent circle diameter of a region where the membrane-like member vibrates is set as Φ(m), a hardness $E \times t^3 (Pa \cdot m^3)$ of the membrane-like member is $21.6 \times d^{-1.25} \times \Phi^{4.15}$ or less, and a sound absorption coefficient of the vibration of the membrane-like member at a frequency in at least one high-order vibration mode existing at frequencies of 1 kHz or higher is higher than a sound absorption coefficient at a frequency in a fundamental vibration mode.

2. The soundproof structure according to claim 1, wherein the hardness $E \times t^3 (Pa \cdot m^3)$ of the membrane-like member is $2.49 \times 10^{-7}$ or more.

3. The soundproof structure according to claim 1, wherein each of sound absorption coefficients at frequencies in two or more high-order vibration modes is 20% or more.

4. The soundproof structure according to claim 3, wherein two or more high-order vibration modes with frequencies having sound absorption coefficients of 20% or more continuously exist.

5. The soundproof structure according to claim 1, wherein a frequency in the high-order vibration mode having a sound absorption coefficient of 20% or more is in a range of 1 kHz to 20 kHz.

6. The soundproof structure according to claim 1, wherein, regarding a sound incident in a direction of each of angles of 0°, 30°, and 60° with respect to a direction perpendicular to a surface of the membrane-like member, a sound absorption coefficient at a frequency in the high-order vibration mode is higher than a sound absorption coefficient at a frequency in the fundamental vibration mode.

7. The soundproof structure according to claim 1, wherein the frame is a cylindrical member in which both ends of the opening are opened, and in a case where a length from the membrane-like member fixed to one opening surface of the frame to the other opening surface of the frame is set as $L_1$, an opening end correction distance is set as $\delta$, and a wavelength at a frequency in any high-order vibration mode of the membrane-like member is set as $\lambda_a$, and n is an integer of 0 or more, $$((\lambda_a/4-\lambda_a/8)+n\times\lambda_a/2-\delta)\leq L_1\leq((\lambda_a/4+\lambda_a/8)+n\times\lambda_a/2-\delta)$$

is satisfied.

8. The soundproof structure according to claim 7, wherein n is 0, and thus $(\lambda_a/4-\lambda_a/8-6)\leq L_1\leq(\lambda_a/4+\lambda_a/8-6)$ is satisfied.

9. The soundproof structure according to claim 1, wherein a through hole is provided in at least one of the frame or the bottom surface.

10. The soundproof structure according to claim 1, wherein the rear surface space is a closed space.

11. The soundproof structure according to claim 1, wherein the membrane-like member has a through hole.

12. The soundproof structure according to claim 1, wherein the membrane-like member has one or more cut portions penetrating from one surface to the other surface.

13. The soundproof structure according to claim 1, wherein a sound absorption coefficient at a frequency in the high-order vibration mode is 20% or more.

14. The soundproof structure according to claim 1, wherein a frequency having a maximum sound absorption coefficient in an audible range is 2 kHz or more.

15. The soundproof structure according to claim 1, wherein a thickness of the rear surface space is 10 mm or less.

16. The soundproof structure according to claim 1, wherein a thickness of a thickest portion of the soundproof structure is 10 mm or less.

17. The soundproof structure according to claim 1, wherein a thickness of the membrane-like member is less than 100 μm.

* * * * *